US006555279B2

(12) United States Patent
Nakata et al.

(10) Patent No.: US 6,555,279 B2
(45) Date of Patent: Apr. 29, 2003

(54) ELECTROPHOTOGRAPHIC PHOTOSENSITIVE MEMBER, PROCESS CARTRIDGE AND ELECTROPHOTOGRAPHIC APPARATUS

(75) Inventors: Kouichi Nakata, Numazu (JP); Yosuke Morikawa, Yokohama (JP); Kimihiro Yoshimura, Odawara (JP); Hiroshi Saito, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/885,052

(22) Filed: Jun. 21, 2001

(65) Prior Publication Data

US 2002/0119382 A1 Aug. 29, 2002

(30) Foreign Application Priority Data

Jun. 21, 2000 (JP) ..... 2000-186125
Jun. 21, 2000 (JP) ..... 2000-186200

(51) Int. Cl.[7] ..... G03G 5/14
(52) U.S. Cl. ..... 430/66; 430/58.75; 399/147
(58) Field of Search ..... 430/66, 59, 58.75; 399/147, 262

(56) References Cited

U.S. PATENT DOCUMENTS 5,436,099 A 7/1995 Schank et al. ..... 430/59
6,010,810 A 1/2000 Uesaka et al. ..... 430/58.8

FOREIGN PATENT DOCUMENTS

| | | |
|---|---|---|
| JP | 57-030846 | 2/1982 |
| JP | 62-19254 | 1/1987 |
| JP | 62-295066 | 12/1987 |
| JP | 2-50167 | 2/1990 |
| JP | 5-181299 | 7/1993 |
| JP | 10-228126 | 8/1998 |
| JP | 10-228127 | 8/1998 |

OTHER PUBLICATIONS

Database WPI, Section Ch, Week 198739, Derwent Pub., AN 1987–274941 (XP002183387) JP 62–192754.

Database WPI, Section Ch, Week 199050, Derwent Pub., AN 1990–373167 (XP002183388) for JP 2–271363.

*Primary Examiner*—John Goodrow
(74) *Attorney, Agent, or Firm*—Fitzpatrick, Cella, Harper & Scinto

(57) ABSTRACT

An electrophotographic photosensitive member exhibiting a good durability and stable electrophotographic performances regardless of environmental change is provided by coating the photosensitive layer with a specific protective layer. The protective layer comprises a cured phenolic resin and a charge-transporting compound having at least one group selected from the group consisting of hydroxyalkyl groups, hydroxyalkoxy groups and hydroxyphenyl groups capable of having a substituent.

13 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electro-photographic photosensitive member, particularly to one characterized by having a protective layer comprising specific particles and a specific resin, and also to a process cartridge and an electrophotographic apparatus including such a photosensitive member.

In recent years, extensive research and development works have been made on electrophotographic photosensitive members using organic photoconductors in view of their advantages, such as high level of safety, excellent productivity and inexpensiveness. Many proposals have been made, and many of them have been commercialized up to now.

Among such photosensitive members using organic photoconductors, those using a photoconductor principally comprising a photoconductive polymer as represented by poly-N-vinylcarbazole and a charge transfer complex formed of 2,4,7-trinitrofluorene, etc., have not been necessarily satisfactory.

On the other hand, a function separation-type electrophotographic photosensitive member wherein separate substances are in charge of a charge-generating function and a charge-transporting function, respectively, has resulted in remarkable improvements in photosensitivity and durability which have been regarded as defects of conventional organic photosensitive members. Further, the function separation-type electrophotographic photosensitive member also has an advantage that the charge-generating substance and the charge-transporting substance respectively allow large latitude of material selection, thus allowing relatively easy production of a photosensitive member having arbitrary desired performances.

As the charge-generating substance, there have been known various azo pigments, polycyclic quinone pigments, phthalocyanine pigments, cyanine colorants, squaline acid dyes, pyrylium salt dyes, etc.

As the charge-transporting substance, pyrazoline compounds, hydrazone compounds, triphenylamine compounds, etc., are known.

On the other hand, accompanying increasing demands for image forming machines capable of providing high-quality images and exhibiting high speed and high durability in recent years, such an organic electrophotographic photosensitive member is also required to exhibit a further increased mechanical durability.

Further, image forming machines, such as printers, copying machines and facsimile apparatus, using electrophotographic photosensitive members are becoming used in a wide variety of fields, and therefore are further required to always provide stable images in various environments, so that the surface layer of the photosensitive member is liable to be exposed to chemical, electrical and mechanical impacts at a higher possibility, thus being required of further performances.

More specifically, an electrophotographic photosensitive member is subjected to a repetition of an image forming cycle including steps of charging, exposure, development, transfer, cleaning, charge removal, etc. An electrostatic latent image formed by the charging and exposure is developed with a fine powdery developer called a toner to form a toner image on the photosensitive member. The toner image is then transferred onto a transfer(-receiving) material, such as paper, but all the toner is not transferred but a portion thereof remains as a residual toner on the photosensitive member.

A large amount of the residual toner, if caused, can promote a further transfer failure to result in a toner image on the transfer material with noticeable lack of portion of image and image uniformity. Further, the residual toner causes problems, such as melt-sticking and filming of the toner onto the photosensitive member. In order to cope with these problems, an electrophotographic photosensitive member is required to have a surface layer with improved releasability.

Further, an electrophotographic photosensitive member is subjected to direct application of electrical and mechanical external forces, so that the photosensitive member is required to be durable against such forces. More specifically, the photosensitive member is required to be durable against the occurrences of surface abrasion and scars due to rubbing and surface layer degradation due to attachment of active substances, such as ozone and $NO_x$, occurring during the charging of the photosensitive member.

In order to comply with the above-mentioned requirements of the photosensitive member, it has been proposed to dispose various protective layers. For example, Japanese Laid-Open Patent Application (JP-A) 57-30846 discloses a protective layer comprising a resin to which a metal oxide is added as electro-conductive powder for resistivity control.

The dispersion of electroconductive powder in such a protective layer of an electrophotographic photosensitive member is performed principally for the purpose of controlling the electrical resistivity of the protective layer per se to prevent an increase in residual potential in the photosensitive member liable to be caused along with the repetition of the electro-photographic image forming cycles. It is known that an appropriate range of volume resistivity of a protective layer is $10^{10}$ to $10^{15}$ ohm.cm. The resistivity in the above-mentioned range of protective layer is liable to be affected by ionic conduction and is therefore liable to result in a remarkable change in resistivity due to an environmental change. Particularly, in the case of a resinous film containing metal oxide powder dispersed therein, it has been very difficult to keep the resistivity of the protective layer in the above-mentioned range under various environmental conditions since the metal oxide powder surface exhibits a high moisture absorptivity. Further, many resins per se exhibit high moisture absorptivity and are liable to lower the resistivity of the protective layer formed therefrom.

Particularly, in a high-humidity environment, the surface layer of a photosensitive member is liable to have a lower resistivity by standing or repetitive surface-attachment of active substances, such as ozone and $NO_x$, and also cause a lowering in toner releasability, thus causing image defects such as image flow and insufficient image uniformity.

In the case of dispersing electroconductive particles in a protective layer, it is generally preferred that the particles have a particle size (diameter) smaller than the wavelength of light incident thereto, that is, at most 0.3 $\mu$m, in order to prevent the scattering of incident light due to the dispersed particles. Moreover, electroconductive particles generally tend to agglomerate with each other when dispersed in a resin solution, are difficult to disperse, and even if once dispersed, are liable to cause secondary agglomeration or precipitation, so that it has been difficult to form a resinous film in which fine particles of at most 0.3 μm in particle size are uniformly dispersed. Further, in order to provide a protective layer with a better transparency and a better uniformity of electro-conductivity, it is particularly preferred to disperse fine particles (of at most 0.1 μm in primary particle size), but such fine particles are liable to exhibit even worse dispersibility and dispersion stability.

In order to alleviate the above-mentioned difficulties, JP-A 1-306857 has disclosed a protective layer containing a fluorine-containing silane coupling agent or titanate coupling agent, or a compound such as $C_7F_{15}NCO$; JP-A 62-295066 has disclosed a protective layer containing metal or metal oxide fine powder subjected to a water-repelling treatment for improved dispersibility and moisture resistance dispersed in a binder resin; and JP-A 2-50167 has disclosed a protective layer containing metal oxide fine powder surface-treated with a titanate coupling agent, a fluorine-containing silane coupling agent or acetoalkoxyaluminum diisopropylate dispersed in a binder resin.

However, even such a protective layer still shows a lower resistivity to cause image blurring in a high-humidity environment and exhibits insufficient durability against abrasion or scars due to rubbing, thus being not fully satisfactory as a protective layer for providing electrophotographic performances complying with demands for high image qualities in recent years.

On the other hand, the use of fluorinated carbon as moderately electroconductive particles together with various binder resins including a thermosetting phenolic resin for providing a protective layer has been proposed in JP-A 62-19254. However, the resultant protective layer is not sufficient with respect to dispersion of the fluorinated carbon and environmental stability of the resistivity, thus being liable to result in increases in resistivity and residual potential in a low humidity environment, and a lower humidity to cause image blurring in a high humidity environment.

The use of various thermosetting resins, inclusive of a phenolic resin, together with various filler materials, inclusive of a metal oxide, for providing a protective layer, has been proposed in JP-A 5-181299. However, the metal oxide fine particles disclosed therein are non-conductive reinforcing particles preferably having a particle size of 0.05–3 μm. Accordingly, the metal oxide particles are not effective for providing a protective layer exhibiting a low resistivity, and a sufficient consideration has not been paid to the provision of a transparent protective layer.

The inclusion of a charge-transporting substance having a hydroxyl group for providing a controlled resistivity in a protective layer has been proposed in JP-A 10-228126 and JP-A 10-228127.

However, even an electrophotographic photosensitive member provided with such a protective layer has not fully succeeded in exhibiting sufficient durability against various external forces including mechanical forces causing surface abrasion and scars, and sufficient releasability, as required for complying with further demands for higher durability and higher image quality in recent years.

SUMMARY OF THE INVENTION

Accordingly, a generic object of the present invention is to provide an electrophotographic photosensitive member having solved the above-mentioned problems of the conventional electrophotographic photosensitive members.

A more specific object of the present invention is to provide an electrophotographic photosensitive member capable of effectively suppressing a lowering in photosensitivity and an increase in residual potential liable to be caused by provision of a protective layer.

Another object of the present invention is to provide an electrophotographic photosensitive member which has a surface layer exhibiting excellent releasability and excellent durability against abrasion and scars and thus can maintain high-quality images.

A further object of the present invention is to provide a process cartridge and an electro-photographic apparatus including such an electro-photographic photosensitive member.

According to the present invention, there is provided an electrophotographic photosensitive member, comprising: a support, a photosensitive layer and a protective layer in this order; wherein said protective layer comprises a cured phenolic resin and a charge-transporting compound having at least one group selected from the group consisting of hydroxyalkyl groups, hydroxyalkoxy groups and hydroxyphenyl groups capable of having a substituent.

According to the present invention, there is further provided a process cartridge, comprising: the above-mentioned electrophotographic photosensitive member and at least one means selected from the group consisting of charging means, developing means and cleaning means; said electrophotographic photo-sensitive member and said at least one means being integrally supported and detachably mountable to a main assembly of an electrophotographic apparatus.

The present invention further provides an electrophotographic apparatus, comprising: the above mentioned electrophotographic photosensitive member, and charging means, developing means and transfer means respectively disposed opposite to the electro-photographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
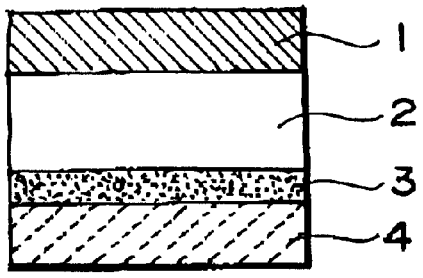
FIGS. 1A–1C are schematic sectional views each showing a laminate structure of an embodiment of the electrophotographic photosensitive member according to the invention.

As a result of our study, it has been found effective to provide a protective layer comprising a combination of a specific binder resin and a specific compound.

More specifically, the electrophotographic photosensitive member of the present invention is characterized by having a protective layer wherein a cured phenolic resin (that is a cured product of a phenolic resin principally obtained by a condensation reaction between a phenol compound and an aldehyde compound) is used as a binder resin and combined with a charge-transporting compound having a function of quickly dissipating a charge present at a boundary between a charge transport layer and the protective layer. As a result, the electrophotographic photosensitive member according to the present invention, though it is provided with a protective layer, can effectively retain the sensitivity and suppress the increase in residual potential, without impairing the protective strength of the protective layer.

Now, the organization of the protective layer will be described more specifically.

The phenolic resin usable as a binder precursor for the protective layer can be any phenolic resin provided with curability. The phenolic resin is generally a resin formed by reaction between a phenol compound and an aldehyde compound and includes two types, i.e., a resole obtained reaction between a phenolic compound and an excessive amount of aldehyde compound in the presence of a basic catalyst, and a novolak obtained by reaction between an excessive amount of phenolic compound and an aldehyde compound in the presence of an acid catalyst.

A resole-type phenolic resin is soluble in a solvent, such as an alcohol or a ketone, and crosslinks on heating to provide a cured product. On the other hand, a novolak-type phenolic resin is not generally curable when heated by itself but can provide a cured product when heated together with a curing agent, such as paraformaldehyde or hexamethylenetetramine. Commercially, a resole-type phenolic resin is generally used as a varnish for a paint, an adhesive, a cast product or a laminate product, and a novolak-type phenolic resin is principally used as a molding material or a binding agent.

In the present invention, the above-mentioned resole-type and novolak-type phenolic resins both can be used as the binder resin, but the resole-type phenolic resin may preferably be used because of its curability without requiring a curing agent, and a processability in the form of a coating agent. In the present invention, these phenolic resins may be used singly or in a mixture of two or more species. It is also possible to use a mixture of a resole and a novolak.

The protective layer according to the present invention may be formed by application of a coating liquid including such a curable phenolic resin and also a charge-transporting compound as described hereinbelow dissolved or diluted in a solvent onto a photosensitive layer, followed by addition and condensation under heating for curing of the phenolic resin. The cured state of the phenolic resin can be confirmed by insolubility in an alcohol solvent, such as methanol or ethanol.

The charge-transporting compound used for constituting the protective layer together with the cured phenolic resin is a charge-transporting compound having at least one group selected from hydroxyalkyl groups, hydroxyalkoxy groups and hydroxyphenyl groups capable of having a substituent. Such a charge-transporting compound having a specific group generally has a good mutual solubility with the above-mentioned curable phenolic resin and can provide a cured phenolic resin with good dispersion state. However, the charge-transporting compound used in the present invention may preferably assume a basic structure similar to a triphenylamine derivative and also has a specific group as mentioned above, in order to ensure a particularly good mutual solubility with the curable phenolic resin.

In the above, examples of the substituent possibly attached to the hydroxyphenyl groups may include: halogen atoms inclusive of fluorine, chlorine, bromine and iodine: alkyl groups, such as methyl, ethyl, propyl and butyl, each capable of having a subsituent; alkoxy groups, such as methoxy, ethoxy, propoxy and butoxy, each capable of having a substituent; aryl groups, such as phenyl, naphthyl, anthryl and pyrenyl, each capable of having a substituent; and heterocylic groups, such as pyridyl, thienyl, furyl and quinolyl, each capable of having a substituent.

Further to say, the charge-transporting compound having a hydroxyalkyl or hydroxyalkoxy group may preferably be a triphenylamine derivative represented by any of the following formulae (1)–(3):

(1)

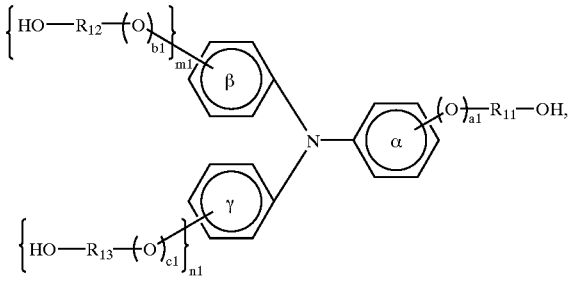

wherein $R_{11}$, $R_{12}$ and $R_{13}$ independently denote a linear or branched divalent hydrocarbon group having 1–8 carbon atoms; α, β and γ independently denote a benzene ring capable of having one or more subtituents selected from halogen atoms, alkyl groups, alkoxy groups, aryl groups and heterocyclic groups each being further capable of a substituent except for the halogen atoms; a1, b1and c1 are independently 1 or 0; and m1 and n1 are independently 1 or 0;

(2)

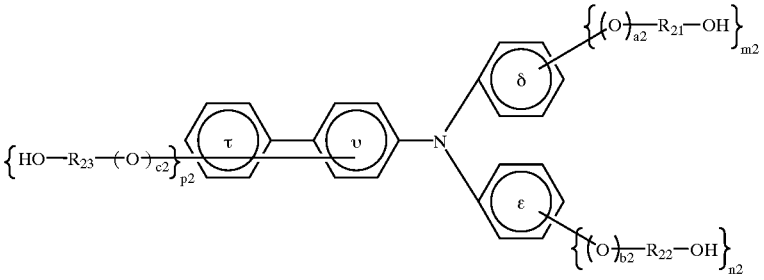

wherein $R_{21}$, $R_{22}$ and $R_{23}$ independently denote a linear or branched divalent hydrocarbon group having 1–8 carbon atoms; τ, ν, δ and ϵ independently denote a benzene ring capable of having one or more substituents selected from halogen atoms, alkyl groups, alkoxy groups, aryl groups and heterocyclic group each being further capable of a having a substituent except for the halogen atoms, with the proviso that τ and ν can form a ring together via a substituent; a2, b2 and c2 are independently 1 or 0; and m2, n2 and p2 are independently 1 or 0 with the proviso that at least one of m2, n2 and p2 is 1.

(3)

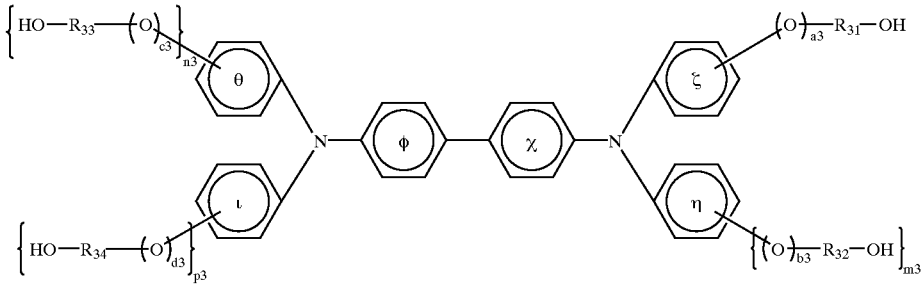

wherein $R_{31}$, $R_{32}$, $R_{33}$ and $R_{34}$ independently denote a linear or branched divalent hydrocarbon group having 1–8 carbon atoms; ξ, ζ, θ, ι, ϕ and χ independently denote a benzene ring capable of having one or more substituents selected from halogen atoms, alkyl groups, alkoxy groups, aryl groups and heterocyclic group each being further capable of a having a substituent except for the halogen atoms, with the proviso that ϕ and χ can form a ring together via a substituent; a3, b3, c3 and d3 are independently 1 or 0; and m3, n3 and p3 are independently 1 or 0.

Incidentally, in the above-formulae (1)–(3), the case of suffixes a1–c1 in (1), a2–c2 in (2) and a3–d3 in (3) being 0 represents that the charge-transporting compounds have a hydroxyalkyl group, and the case of the suffixes being 1 represents that the charge-transporting compounds have a hydroxyalkoxy group.

The structures of the substituents involved in the charge-transporting compound of the formulae (1)–(3) will be described in some more detail.

In the formulae, $R_{11}$—$R_{13}$, $R_{21}$—$R_{23}$ and $R_{31}$—$R_{34}$ independently denote a linear or branched divalent hydrocarbon group, such as methylene, ethylene, propylene or butylene. Examples of the substituent possibly attached to the benzene group of α, β, γ, δ, ϵ, ξ, ζ, θ, ι, τ, ν, ϕ and χ may include: halogen atoms, such as fluorine, chlorine, bromine and iodine; alkyl groups, such as methyl, ethyl, propyl and butyl, each capable of having a substituent; alkoxy groups, such as methoxy, ethoxy, propoxy and butoxy, each capable of having a substituent; aryl groups, such as phenyl, naphthyl, anthryl and pyrenyl, each capable of having a substituent; and heterocyclic groups, such as pyridyl, thienyl, furyl and quinolyl, each capable of having a substituent. Incidentally, τ and ν or ϕ and χ can form a ring together with a substituent group to provide a polycyclic structure, such as a fluorene skeleton or dihydrophenanthrene.

Further, examples of the substituent optionally possessed by the above-enumerated groups may include: alkyls, such as methyl, ethyl, propyl and butyl; aralkyls, such as benzyl, phenethyl and naphthylmethyl: aromatic cyclic groups, such as phenyl, naphthyl, anthryl, pyrenyl, fluorenyl, carbazolyl, dibenzofuryl and dibenzothiophenyl; alkoxy groups, such as methoxy, ethoxy and propoxy; aryloxy groups, such as phenoxy and naphthoxy; halogens, such as fluorine, chlorine, bromine and iodine; nitro and cyano.

Some specific examples of the charge-transporting compounds having a hydroxyalkyl group or a hydroxyalkoxy group represented by the formulae (1)–(3) are enumerated hereinbelow. These are however not exhaustive, Example Compounds (1-1)

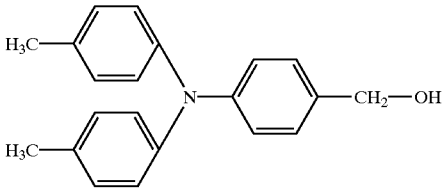

(1-2)

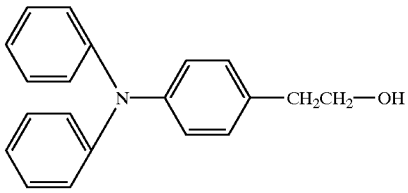

(1-3)

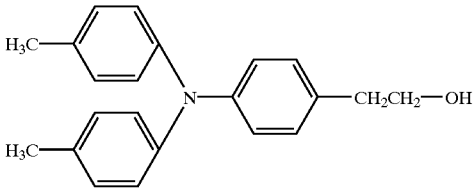

(1-4)

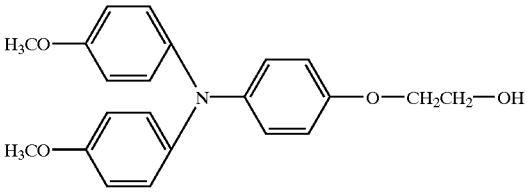

-continued
(1-5)
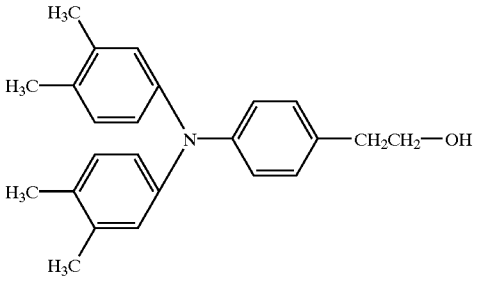
(1-6)
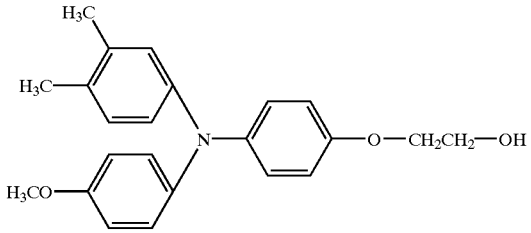
(1-7)
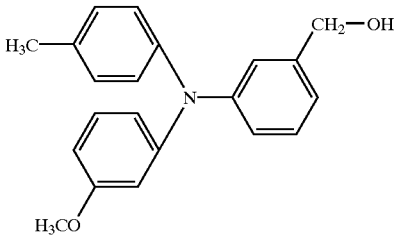
(1-8)
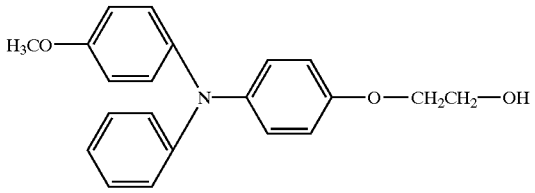
(1-9)
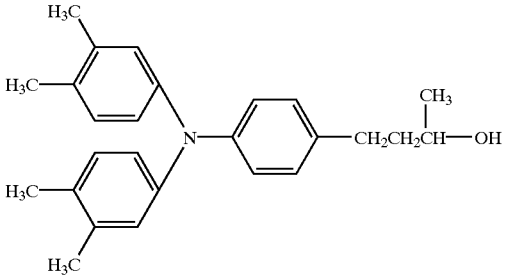
(1-10)
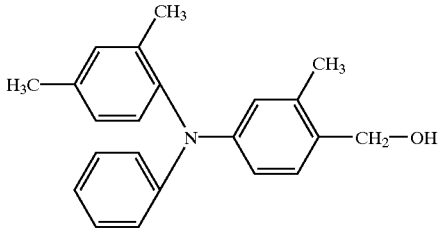
(1-11)
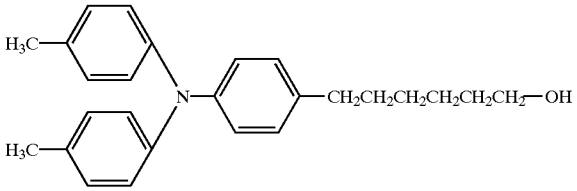
(1-12)
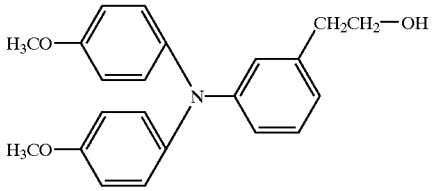
(1-13)
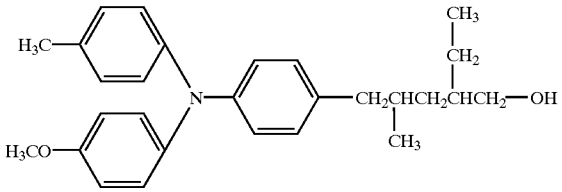
(1-14)
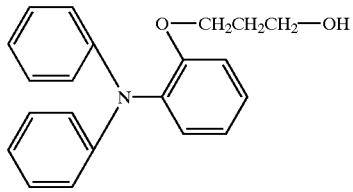
(1-15)
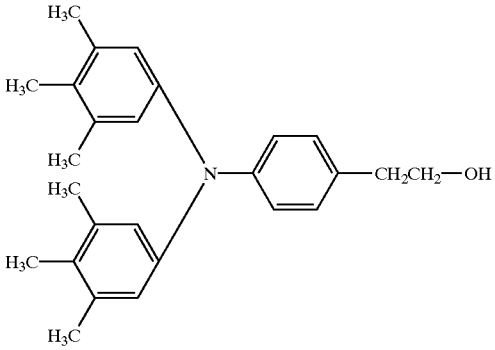
(1-16)
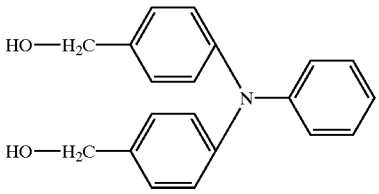

-continued
(1-17)
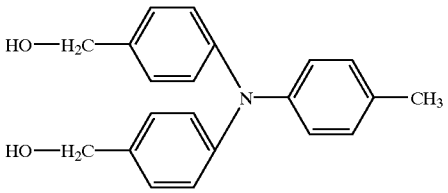
(1-18)
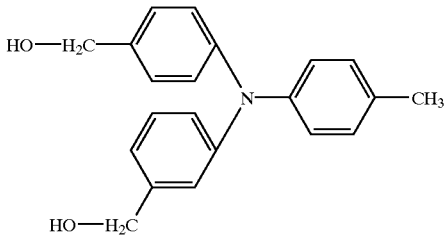
(1-19)
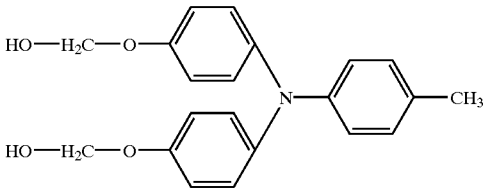
(1-20)
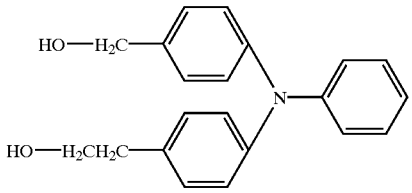
(1-21)
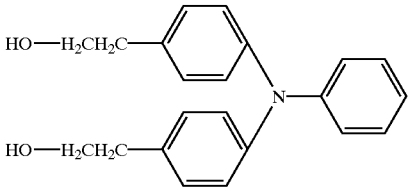
(1-22)
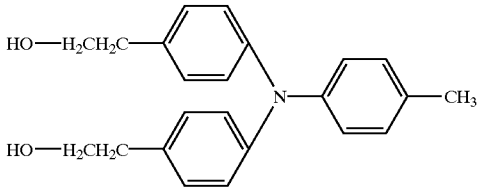
(1-23)
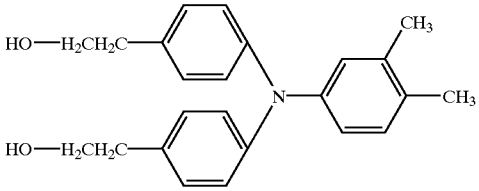
(1-24)
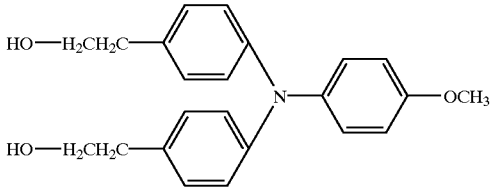
(1-25)
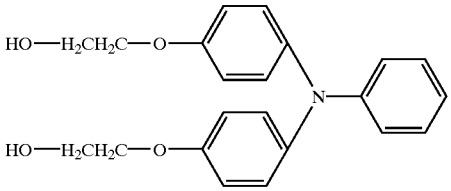
(1-26)
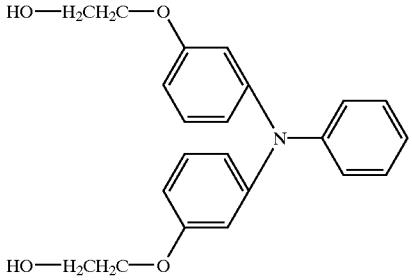
(1-27)
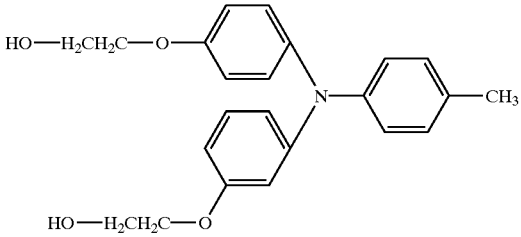
(1-28)
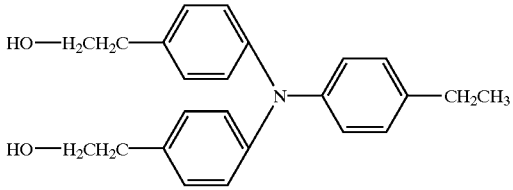

-continued
(1-29)
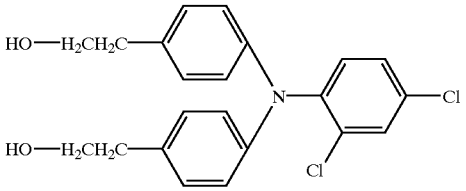
(1-30)
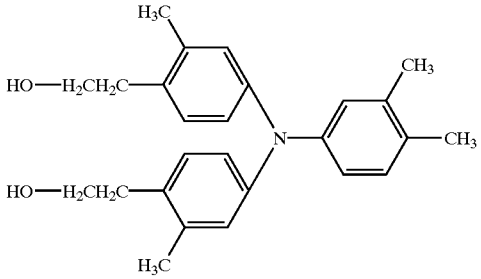
(1-31)
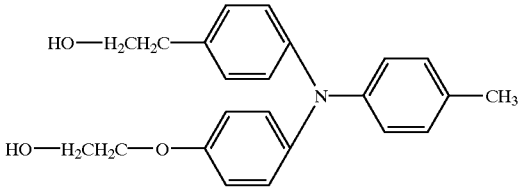
(1-32)
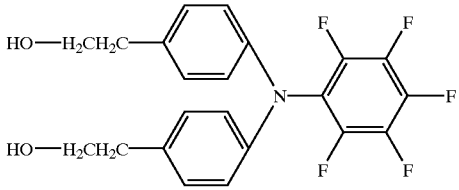
(1-33)
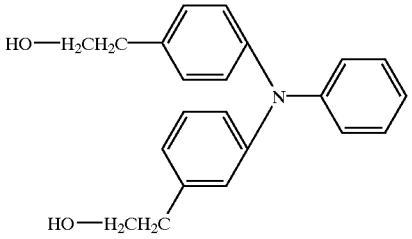
(1-34)
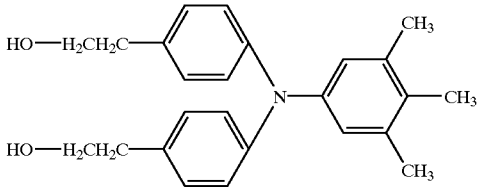
(1-35)
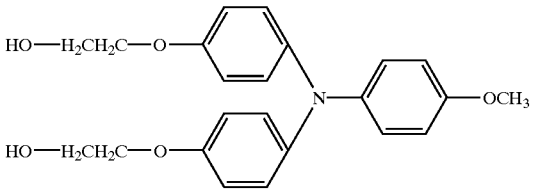
(1-36)
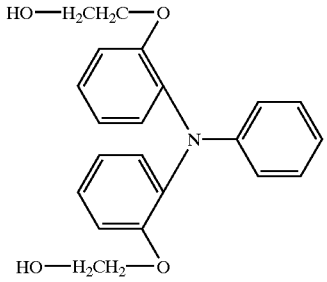
(1-37)
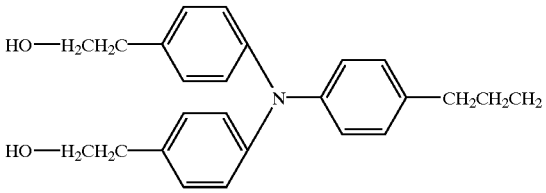
(1-38)
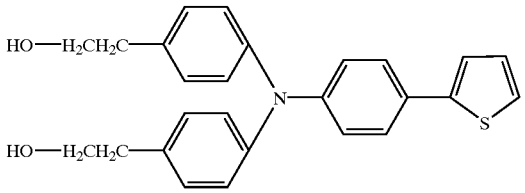
(1-39)
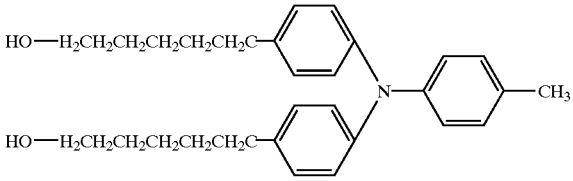
(1-40)
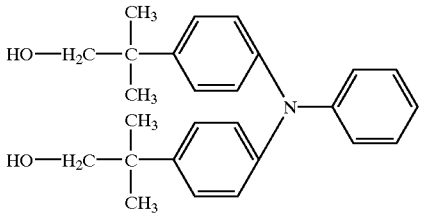

-continued
(1-41)
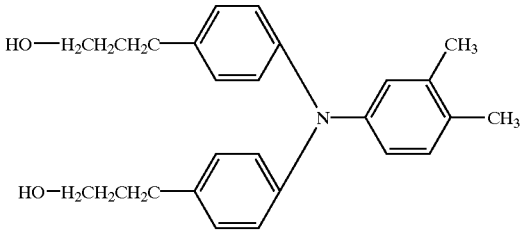
(1-42)
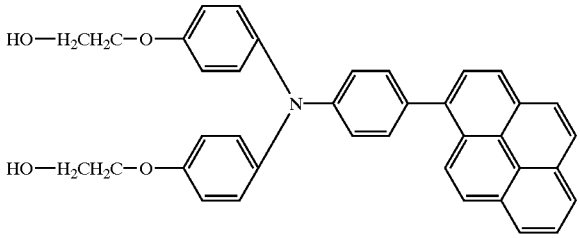
(1-43)
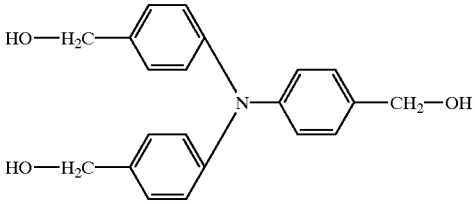
(1-44)
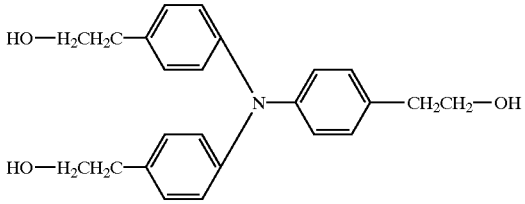
(1-45)
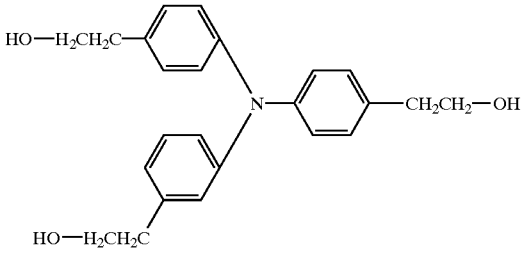
(1-46)
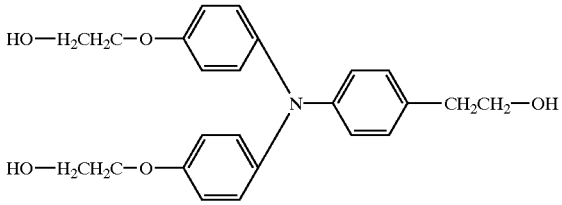
(1-47)
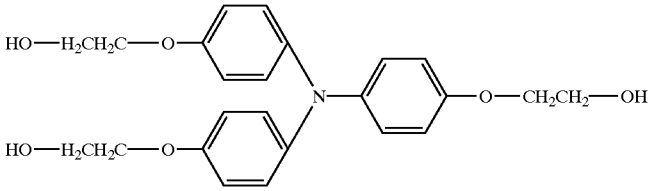
(1-48)
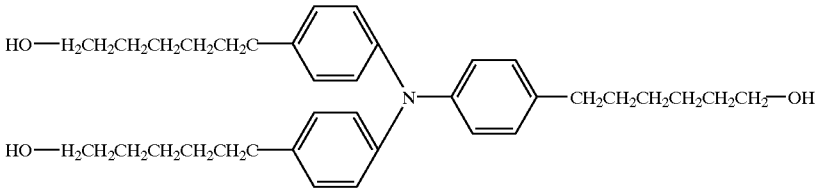
(1-49)
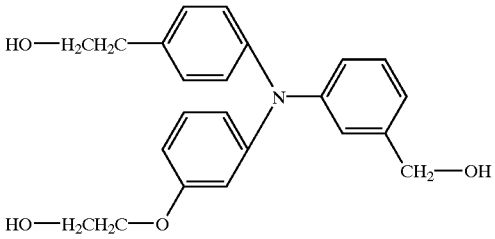
(1-50)
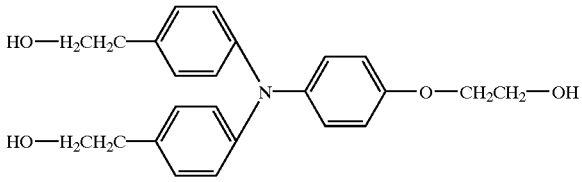

-continued
(1-51)
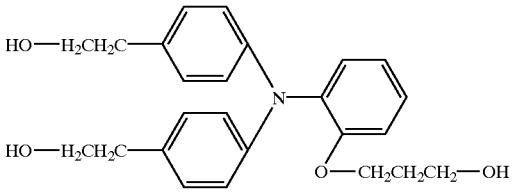
(1-52)
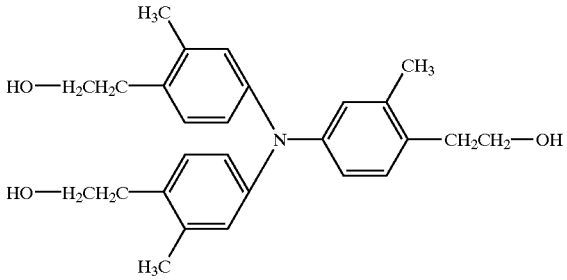
(1-53)
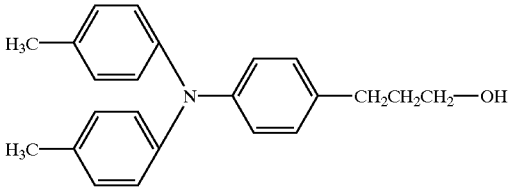
(1-54)
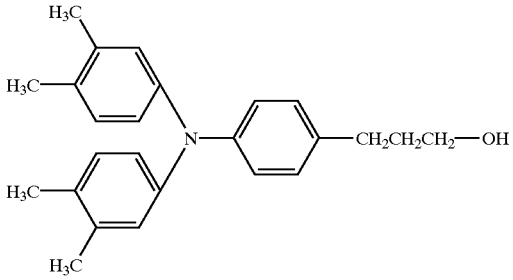
(1-55)
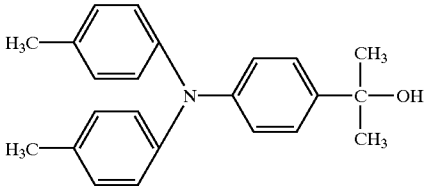
(1-56)
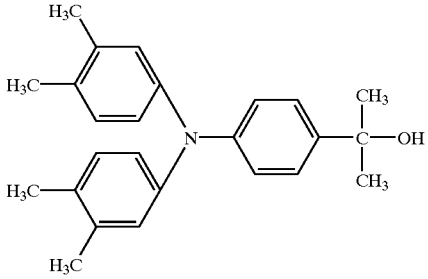
(1-57)
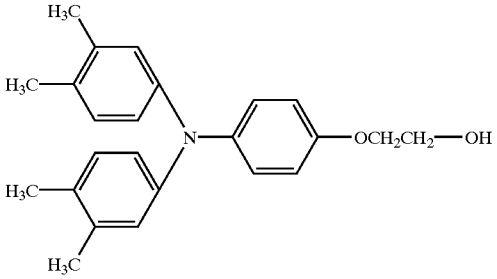
(1-58)
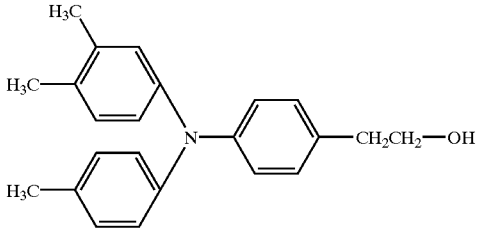
(1-59)
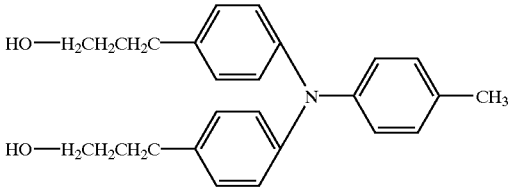
(1-60)
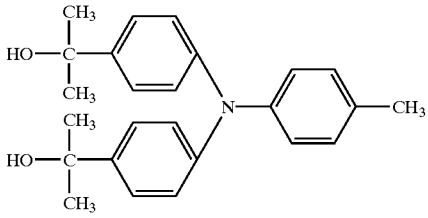
(1-61)
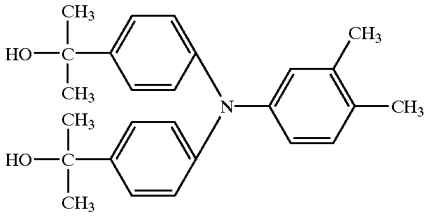
(2-1)
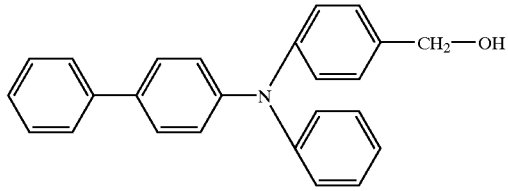

-continued
(2-2)
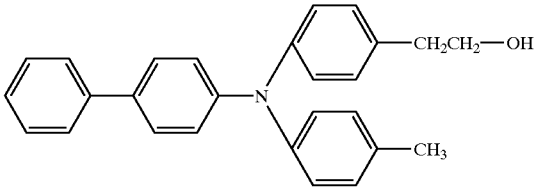
(2-3)
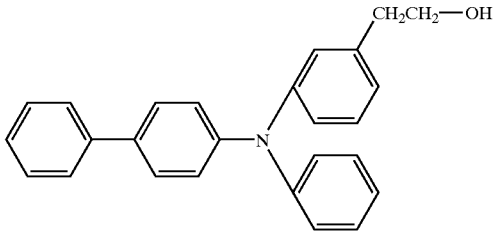
(2-4)
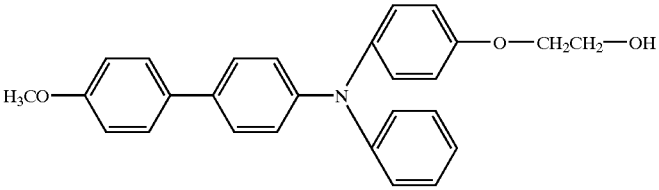
(2-5)
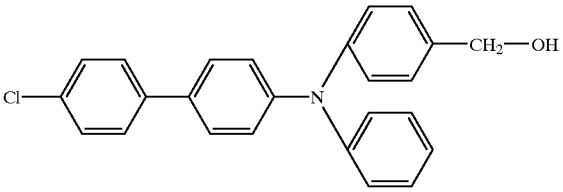
(2-6)
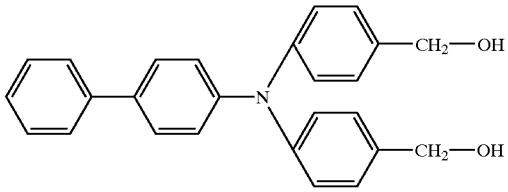
(2-7)
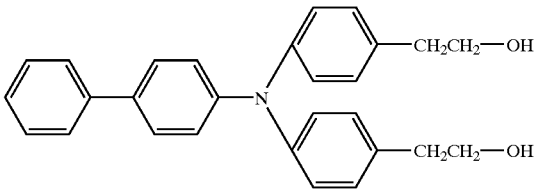
(2-8)
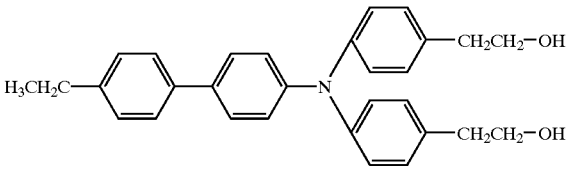
(2-9)
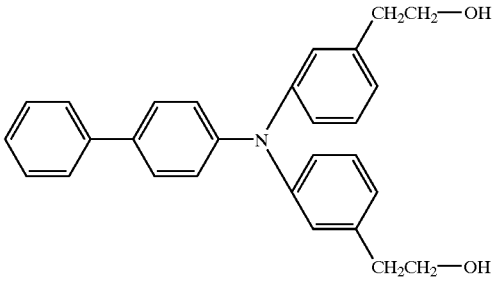
(2-10)
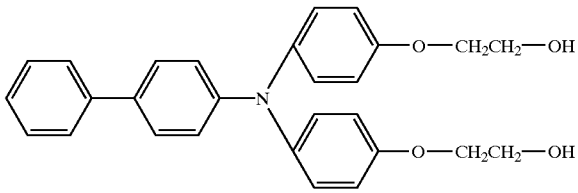
(2-11)
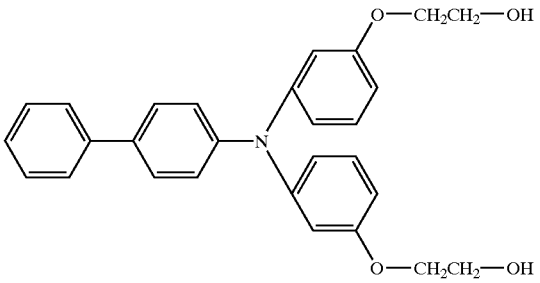
(2-12)
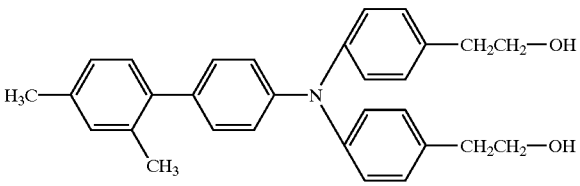

-continued
(2-13)
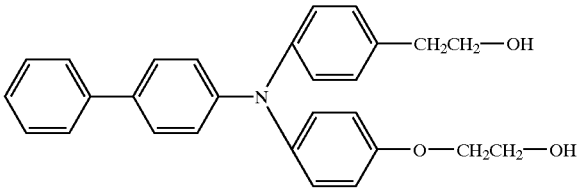
(2-14)
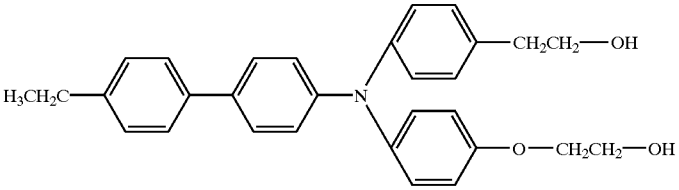
(2-15)
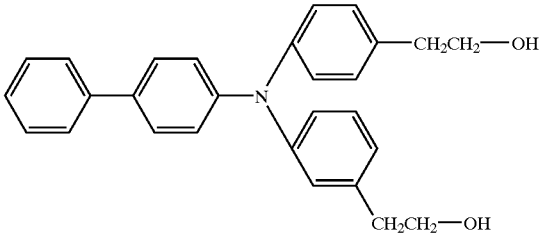
(2-16)
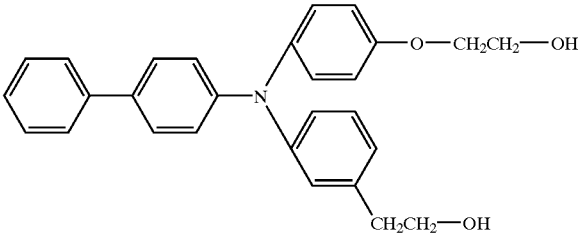
(2-17)
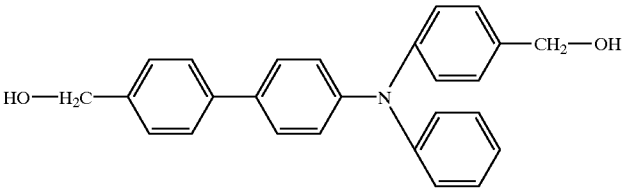
(2-18)
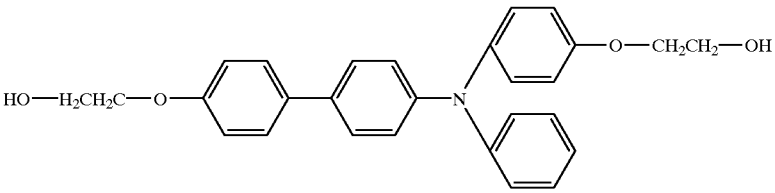
(2-19)
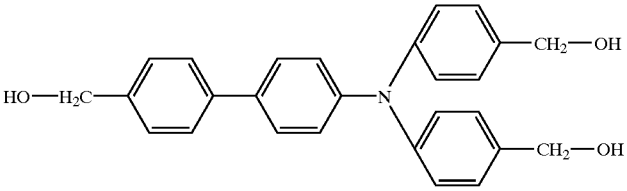
(2-20)
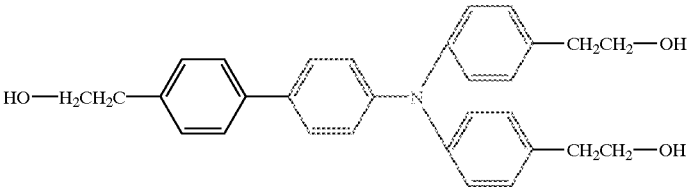

-continued
(2-21)
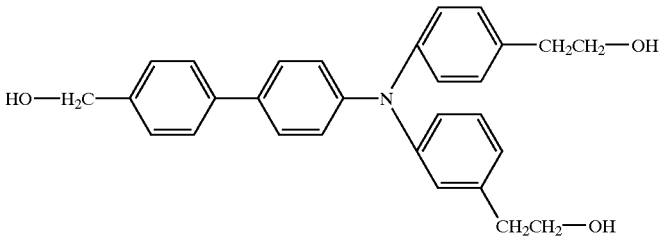
(2-22)
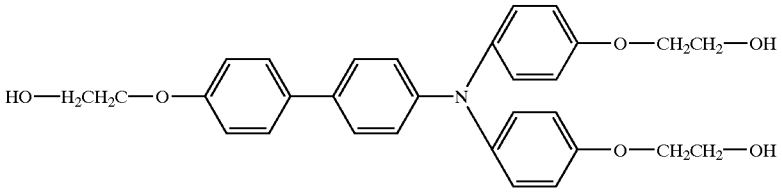
(2-23)
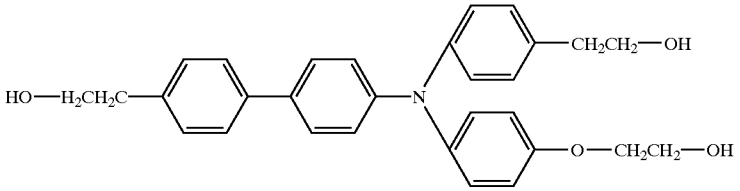
(2-24)
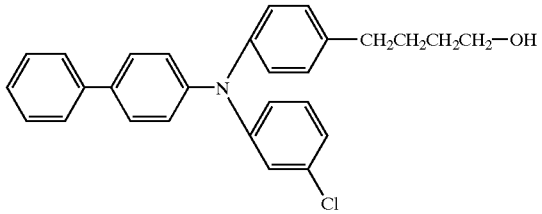
(2-25)
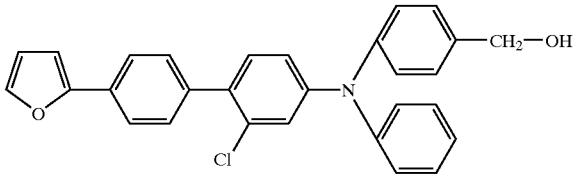
(2-26)
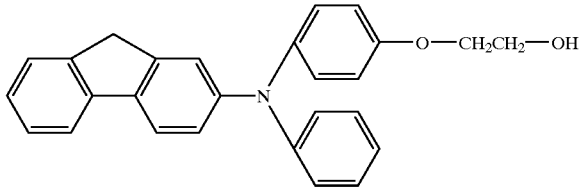
(2-27)
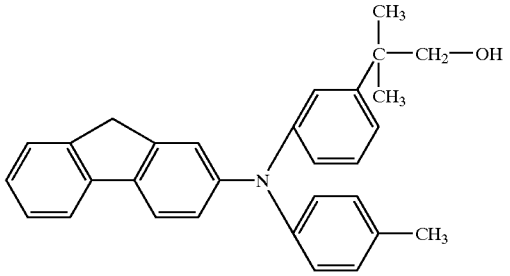
(2-28)
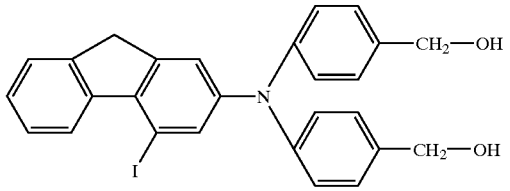
(2-29)
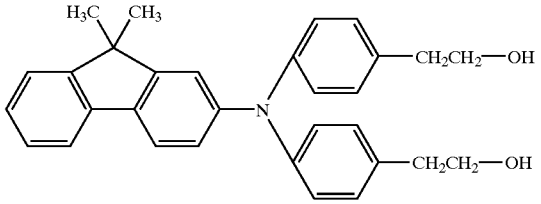
(2-30)
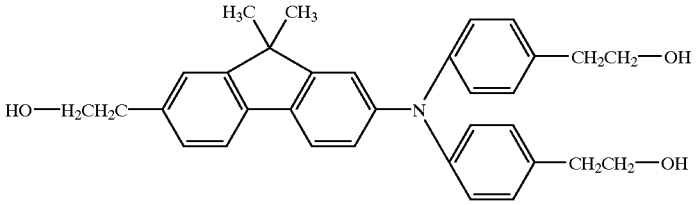

-continued
(2-31)
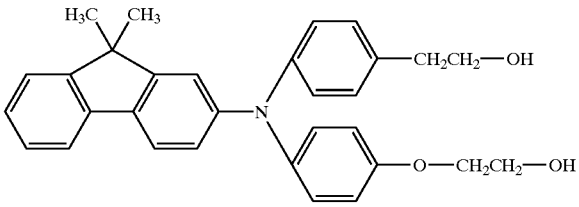
(2-32)
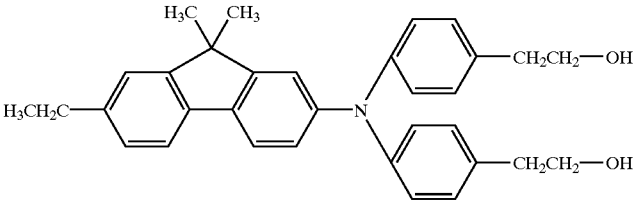
(2-33)
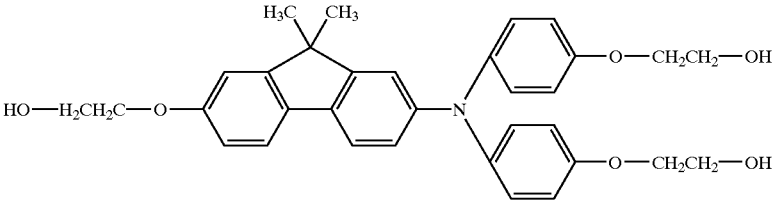
(2-34)
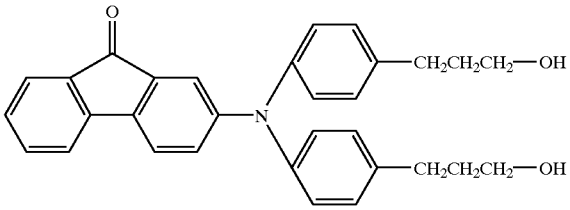
(2-35)
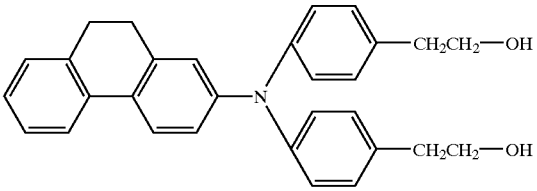
(2-36)
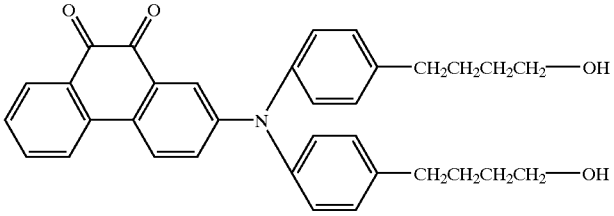
(3-1)
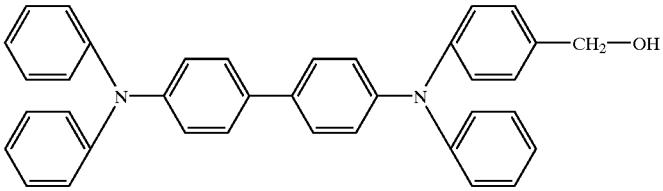
(3-2)
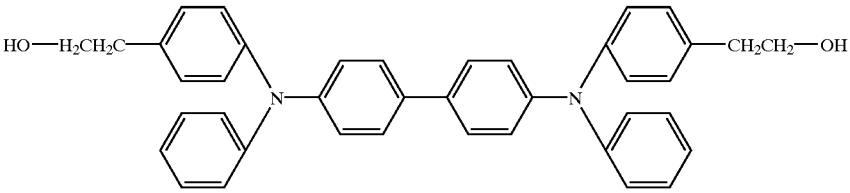

-continued
(3-3)
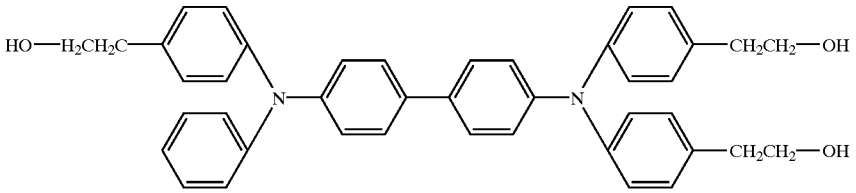
(3-4)
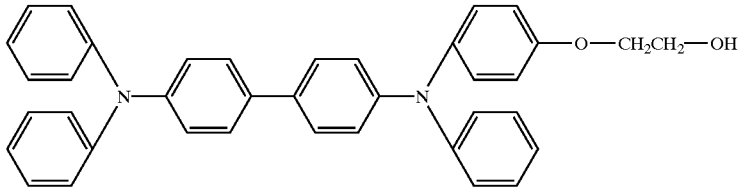
(3-5)
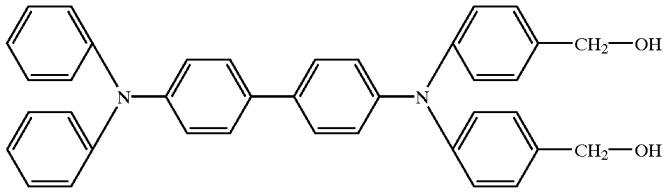
(3-6)
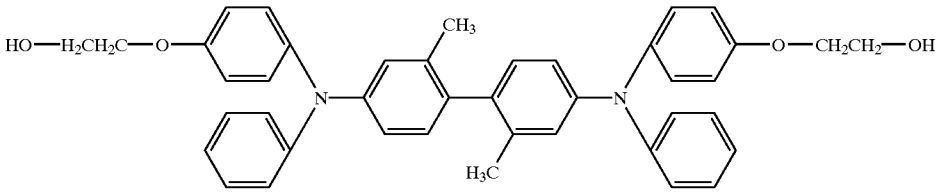
(3-7)
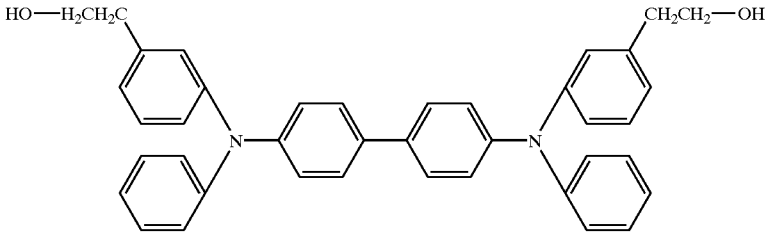
(3-8)
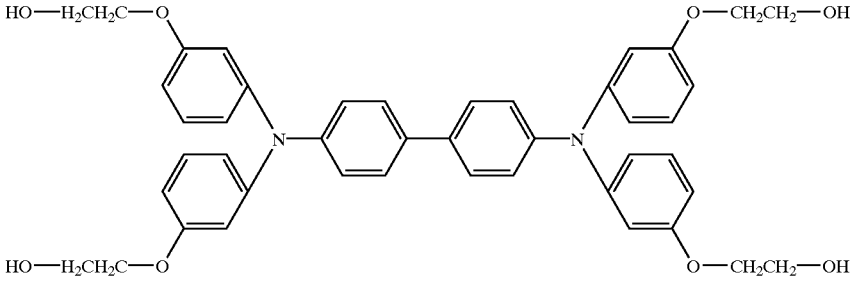

-continued
(3-9)
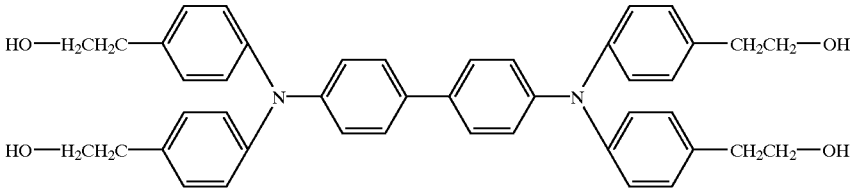
(3-10)
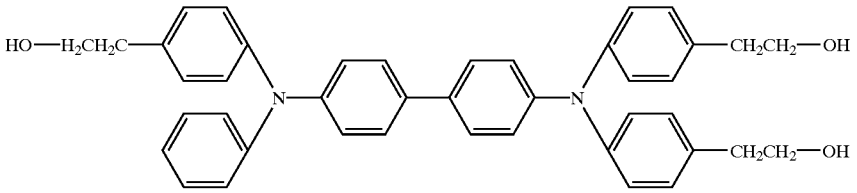
(3-11)
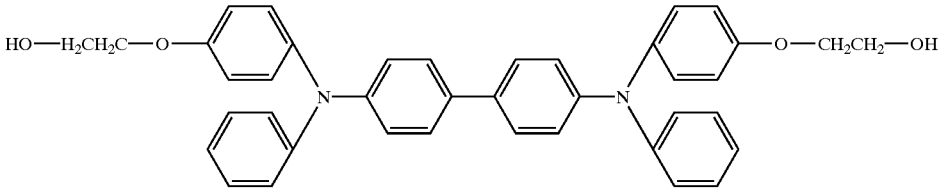
(3-12)
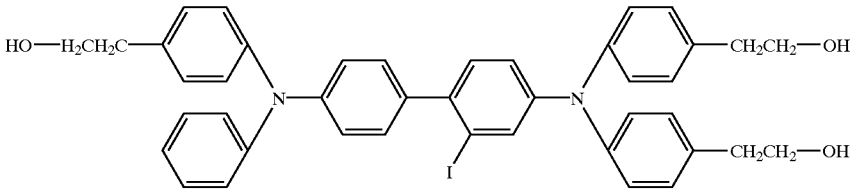
(3-13)
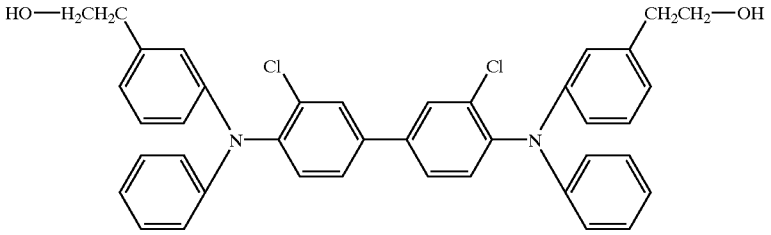
(3-14)
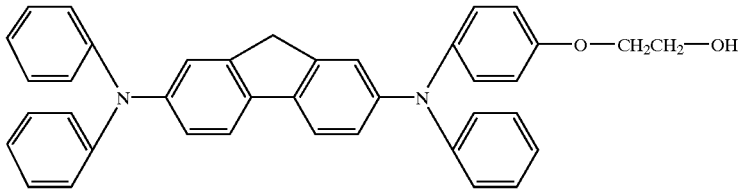
(3-15)
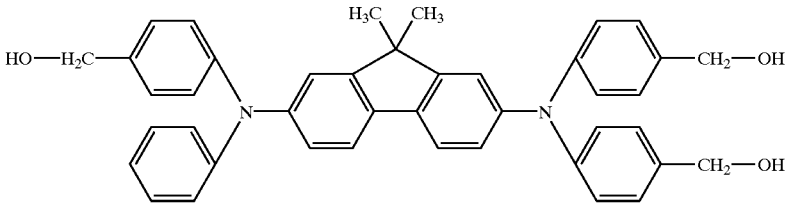

-continued
(3-16)
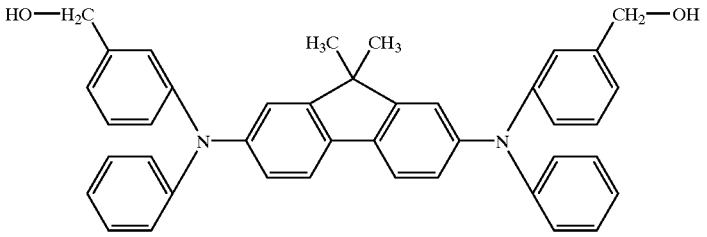
(3-17)
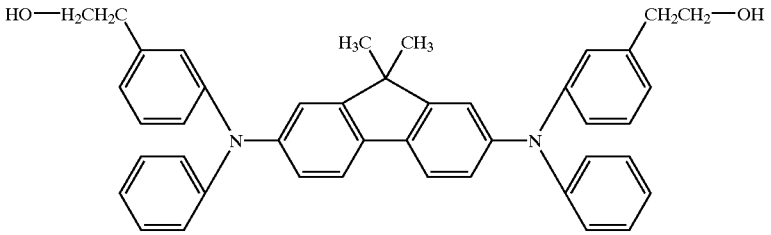
(3-18)
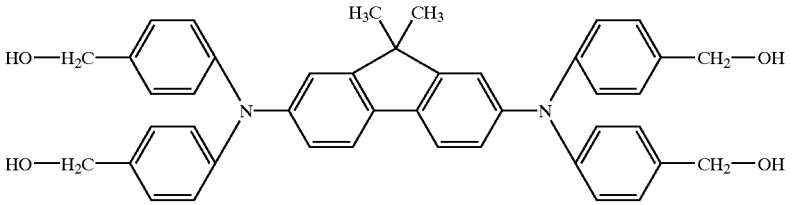
(3-19)
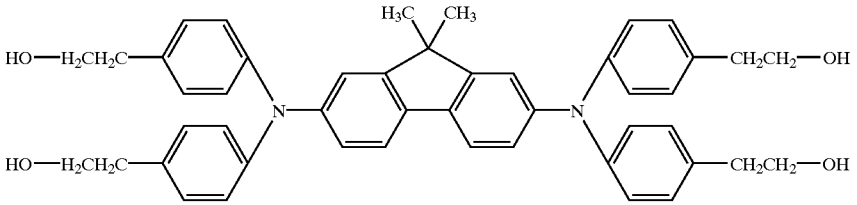
(3-20)
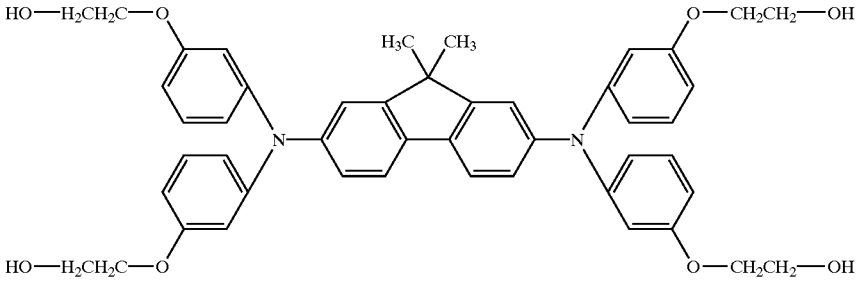
(3-21)
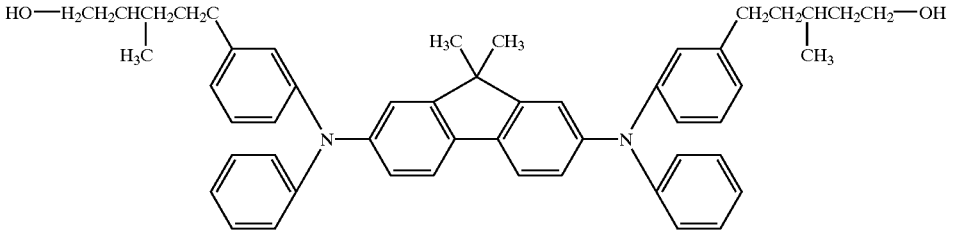
(3-22)
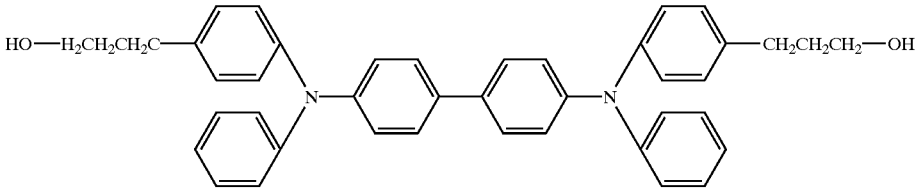

-continued (3-23)

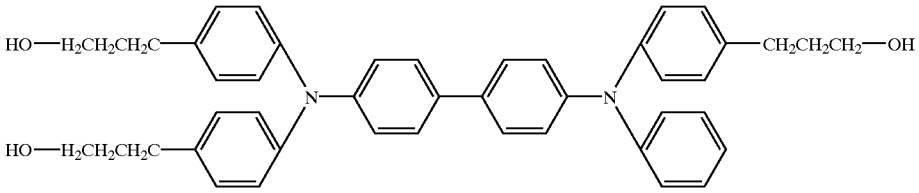

Among the charge-transporting compounds represented by the above formula (1), Example Compounds (1-3), (1-5), (1-21), (1-22), (1-23), (1-28), (1-40), (1-41), (1-44), (1-53), (1-54), (1-55), (1-56), (1-57), (1-58), (1-59), (1-60) and (1-61) are preferred; and Example Compounds (1-5), (1-22), (1-23), (1-41), (1-54) and (1-59) are particularly preferred.

Among the charge-transporting compounds represented by the above-formula (2), Example Compounds (2-7), (2-20), (2-29), (2-30) and (2-32) are preferred; and Example Compounds (2-20) and (2-30) are particularly preferred.

Among the charge-transporting compounds represented by the above formulae (3), Example Compounds (3-7), (3-9), (3-10), (3-17), (3-22) and (3-23) are preferred; and Example Compounds (3-10) and (3-23) are particularly preferred.

On the other hand, the charge-transporting compound having a hydroxyphenyl group capable of having a substituent may preferably be a compound represented by any one of the following formulae (4)–(6):

(4)

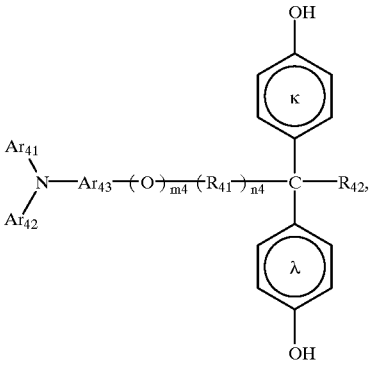

wherein $R_{41}$ denote a linear or branched divalent hydrocarbon group; $R_{42}$ denotes a hydrogen atom, an alkyl group, an aralkyl group or a phenyl group, each capable of having a substituent except for the hydrogen atom; $Ar_{41}$ and $Ar_{42}$ independently denote an alkyl group, an aralkyl group, an aryl group or a heterocyclic group each capable of having a substituent; $Ar_{43}$ denotes an arylene group or a divalent heterocyclic group each capable of having a substituent; m4 and n4 are independently 0 or 1 with the proviso that m4=0 when n4=0, and κ and λ independently denote a benzene ring capable of having one or more substituents selected from halogen atoms, alkyl groups, alkoxy groups, aryl groups, and heterocyclic groups each capable of having a substituent except for the halogen atoms.

(5)

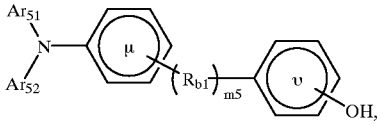

wherein $R_{51}$ denote a linear or branched divalent hydrocarbon group; $Ar_{51}$ and $Ar_{52}$ independently denote an alkyl group, an aralkyl group, an aryl group or a heterocyclic group each capable of having a substituent; μ and ν independently denote a benzene ring capable of having one or more substituents selected from halogen atoms, alkyl groups, alkoxy groups, aryl groups, and heterocyclic groups each capable of having a substituent except for the halogen atoms with the proviso that μ and ν can form a ring together with a substituent; and m5 is 0 or 1.

(6)

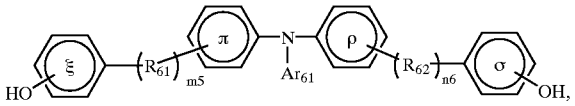

wherein $R_{61}$ and $R_{62}$ independently denote a linear or branched divalent hydrocarbon group; $Ar_{61}$ denotes an alkyl group, an aralkyl group, an aryl group or a heterocyclic group each capable of having a substituent; ξ, π, ρ, and σ independently denote a benzene ring capable of having one or more substituents selected from halogen atoms, alkyl groups, alkoxy groups, aryl groups, and heterocyclic each capable of having a substituent except for the halogen atoms with the proviso that ξ and π or ρ and σ can form a ring together with a substituent and m1 and n1 are independently 0 or 1.

The structures of the substituents involved in the charge-transporting compound of the formulae (4)–(6) will be described in some more detail.

In the formulae, $R_{41}$, $R_{51}$, $R_{61}$ and $R_{62}$ independently denote a linear or branched divalent hydrocarbon group, such as methylene, ethylene, propylene or butylene.

$R_{42}$ denotes a hydrogen atom; an alkyl group, such as methyl, ethyl, propyl or butyl, each capable of having a substituent; an aralkyl group, such as benzyl, phenetyl or naphthyl methyl, each capable of having a substituent; or a phenyl capable of having a substituent.

Examples of the substituent possibly attached to the benzene group of κ, λ, μ, γ, ξ, π, ρ and σ may include: halogen atoms, such as fluorine, chlorine, bromine and iodine; alkyl groups, such as methyl, ethyl, propyl and butyl, each capable of having a substituent; alkoxy groups, such as methoxy, ethoxy, propoxy and butoxy, each capable of having a substituent; aryl groups, such as phenyl, naphthyl, anthryl and pyrenyl, each capable of having a substituent; and heterocyclic groups, such as pyridyl, thienyl, furyl and quinolyl, each capable of having a substituent Incidentally, $\mu$ and $\nu$, $\xi$ and $\pi$, or $\rho$ and $\sigma$ can form a ring together with a substituent group to provide a polycyclic structure, such as a fluorene skeleton or dihydrophenanthrene.

$Ar_{41}$, $Ar_{42}$, $Ar_{51}$, $Ar_{52}$ and $Ar_{61}$ independently denote an alkyl group, such as methyl, ethyl, propyl or butyl, each capable of having a substituent; an aralkyl group, such as benzyl, phenethyl or naphthylmethyl, each capable of having a substituent; an aralkyl group, such as benzyl, phenetyl or naphthylmethyl, each capable of having a substituent; an aryl group, such as phenyl, naphthyl, anthryl or pyrenyl, each capable of having a substituent: or a heterocyclic group, such as pyridyl, thienyl, furyl or quinolyl, each capable of having a substituent.

$Ar_{43}$ denotes an arylene group, such as phenylene, naphthylene, anthrylene or pyrenylene, each capable of having a substituent; or a divalent heterocyclic group, such as pyridylene or thienylene, each capable of having a substituent.

Further, examples of the substituent optionally possessed by the above-enumerated groups may include: alkyls, such as methyl, ethyl, propyl and butyl; aralkyls, such as benzyl, phenethyl and naphthylmethyl; aromatic cyclic groups, such as phenyl, naphthyl, anthryl, pyrenyl, fluorenyl, carbazolyl, dibenzofuryl and dibenzothiophenyl; alkoxy groups, such as methoxy, ethoxy and propoxy; aryloxy groups, such as phenoxy and naphthoxy; halogens, such as fluorine, chlorine, bromine and iodine; nitro and cyano.

Some specific examples of the charge-transporting compounds having a hydroxyphenyl group represened by the formulae (4)–(6) are enumerated hereinbelow These are however not exhaustive.

[Example Compounds]

(4-1)

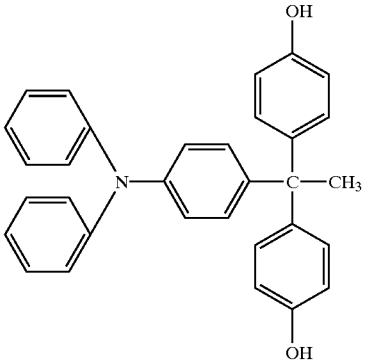

(4-2)

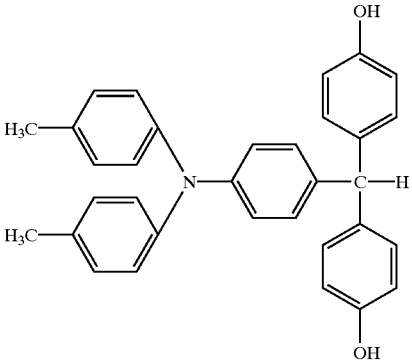

(4-3)

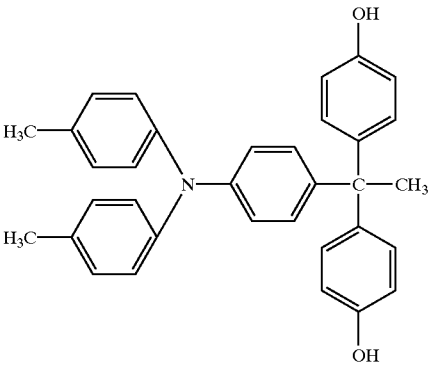

(4-4)

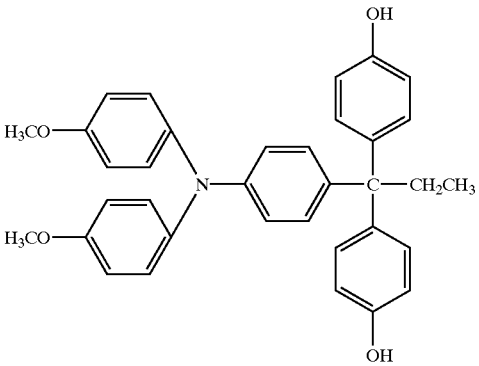

(4-5)

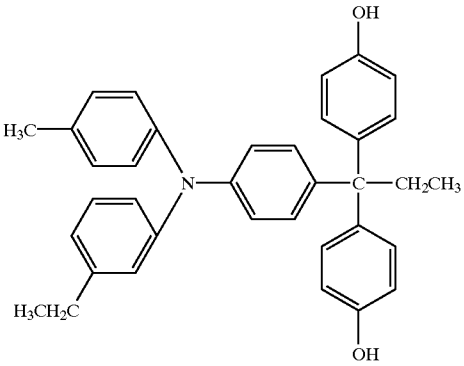

(4-6)

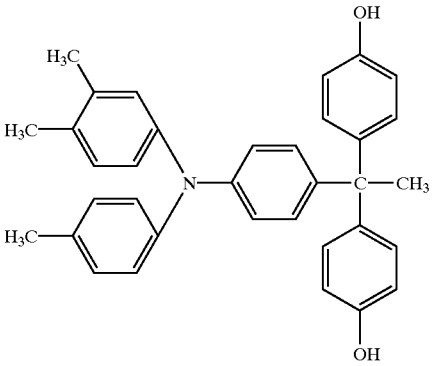

-continued
(4-7)
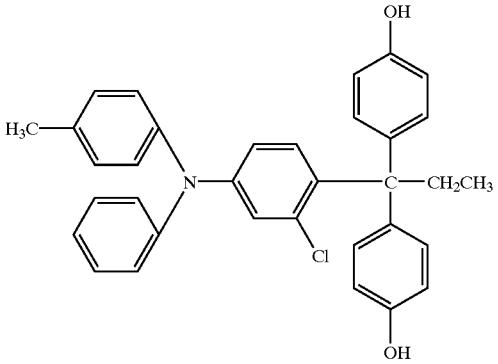
(4-8)
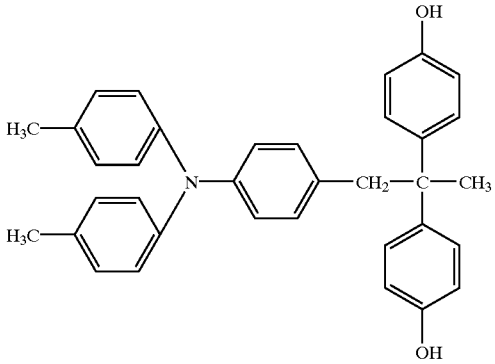
(4-9)
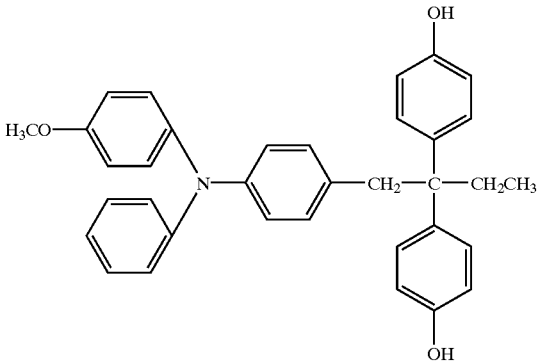
(4-10)
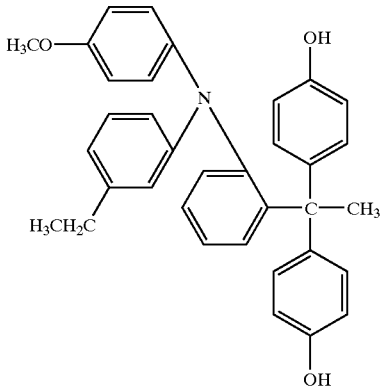
(4-11)
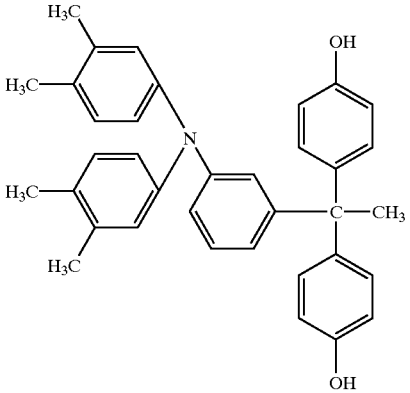
(4-12)
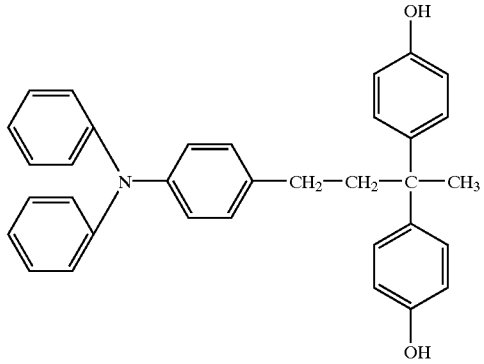
(4-13)
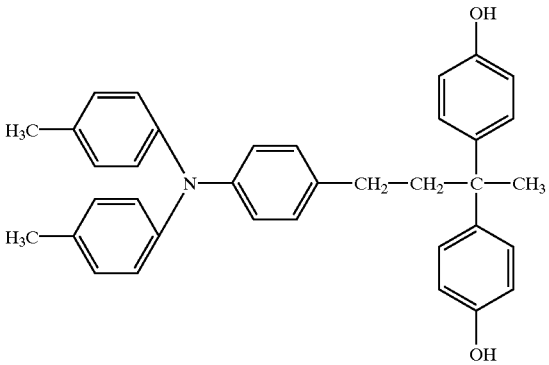
(4-14)
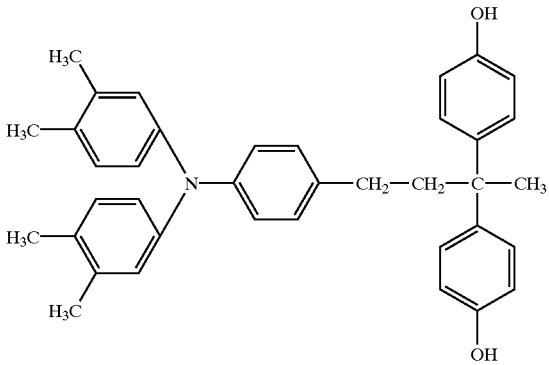

-continued
(4-15)
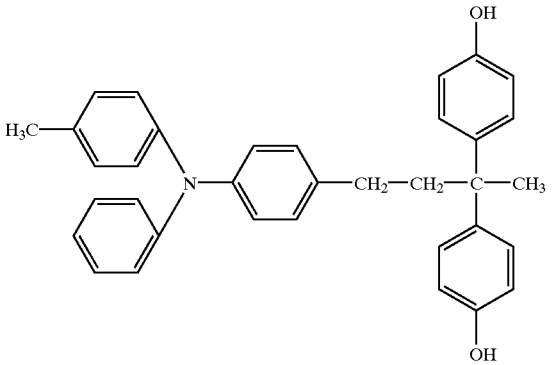
(4-16)
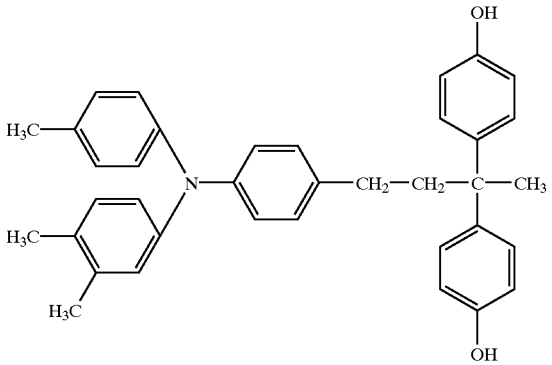
(4-17)
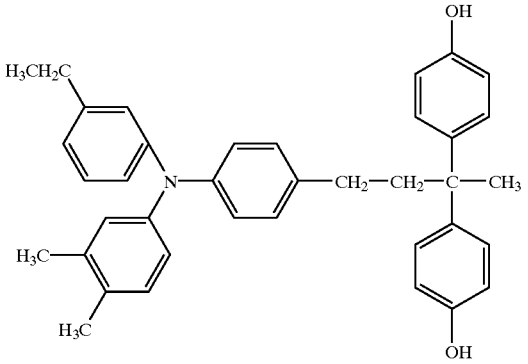
(4-18)
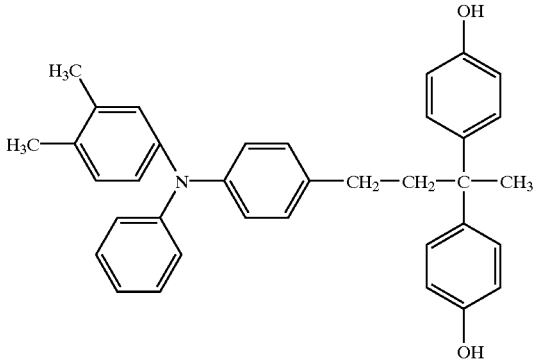
(4-19)
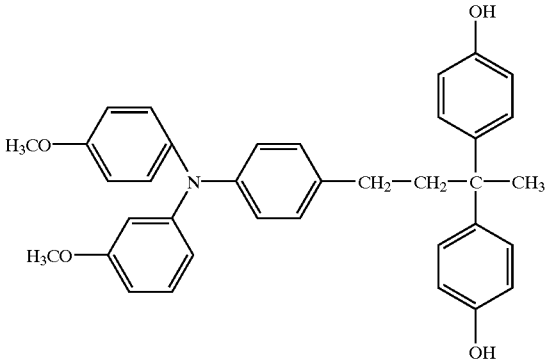
(4-20)
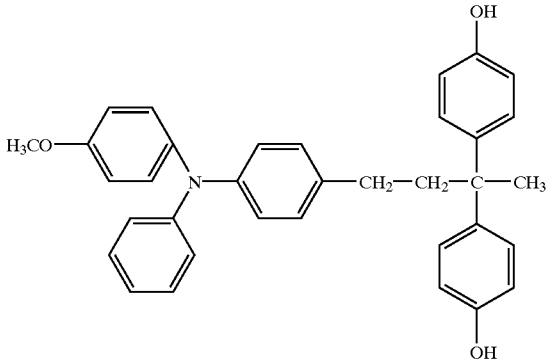
(4-21)
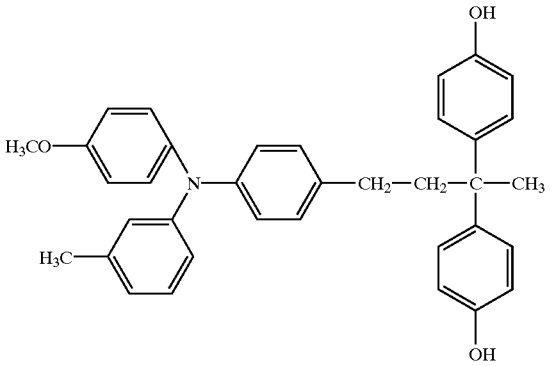
(4-22)
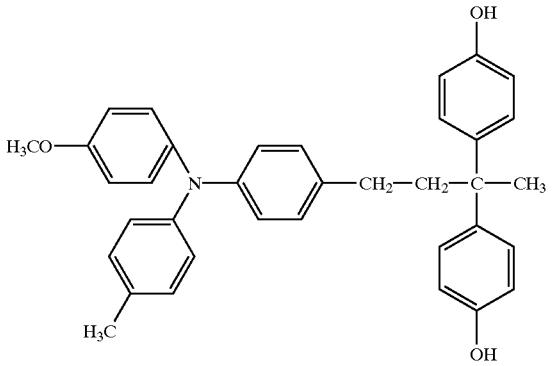

-continued
(4-23)
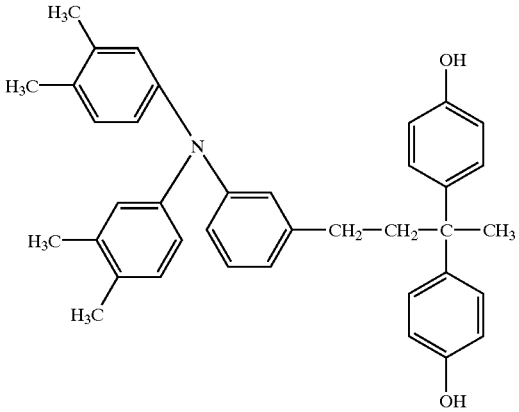
(4-24)
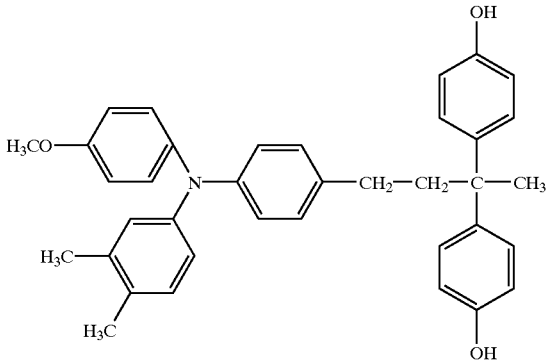
(4-25)
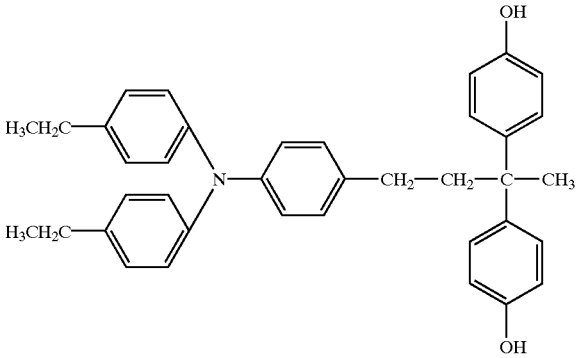
(4-26)
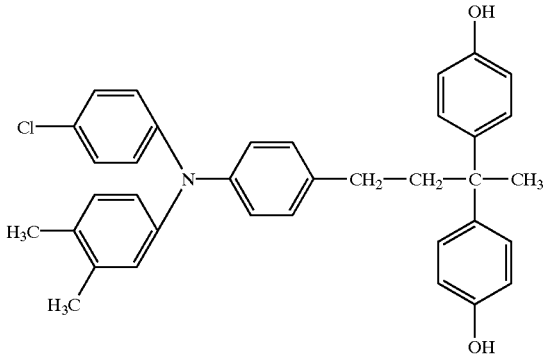
(4-27)
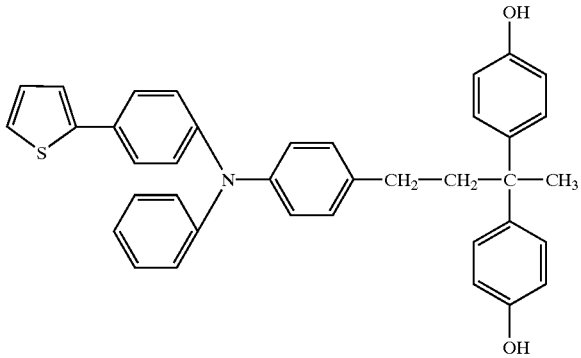
(4-28)
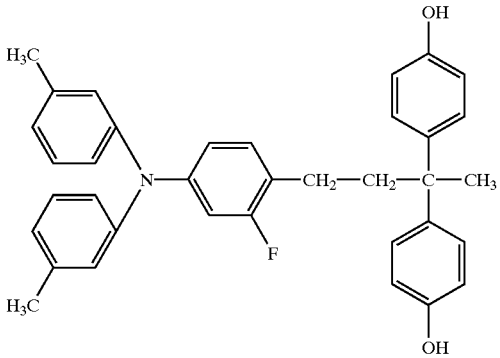
(4-29)
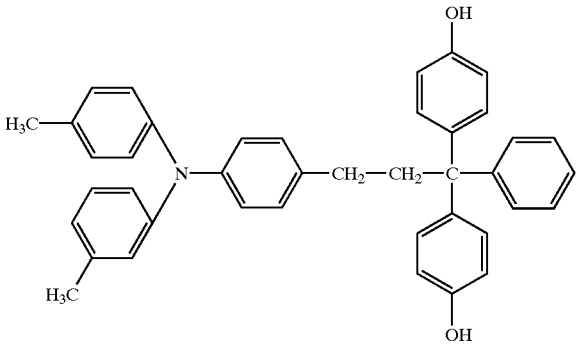
(4-30)
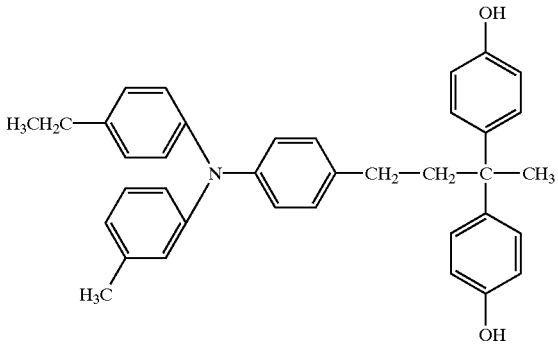

-continued
(4-31)
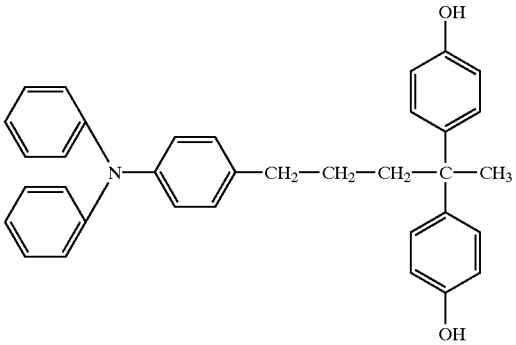
(4-32)
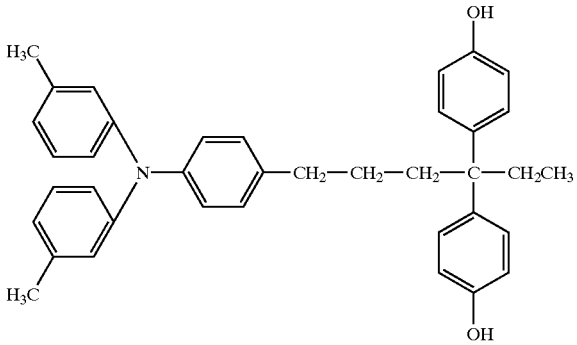
(4-33)
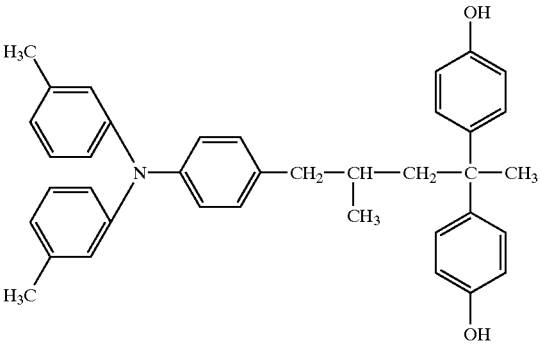
(4-34)
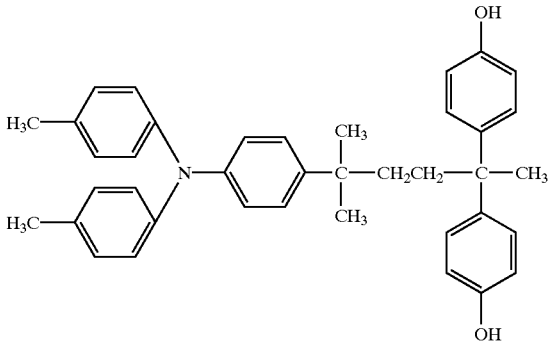
(4-35)
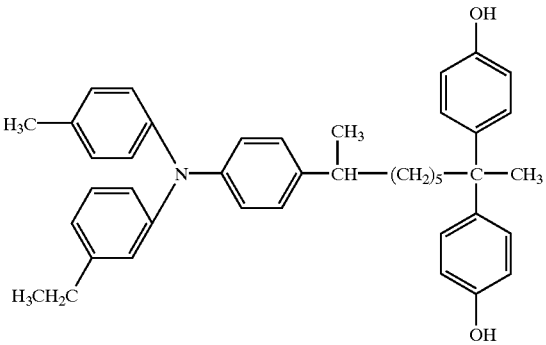
(4-36)
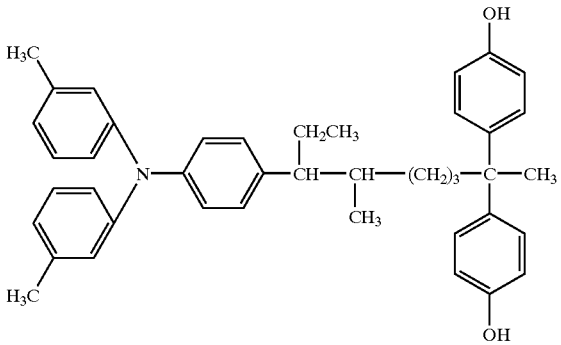
(4-37)
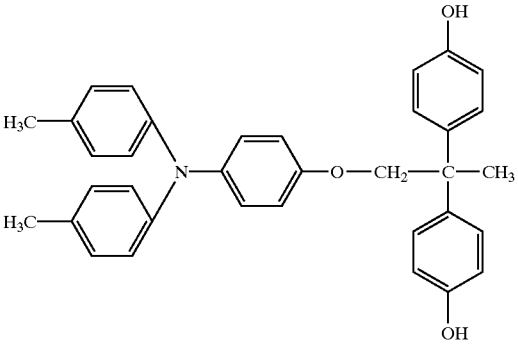
(4-38)
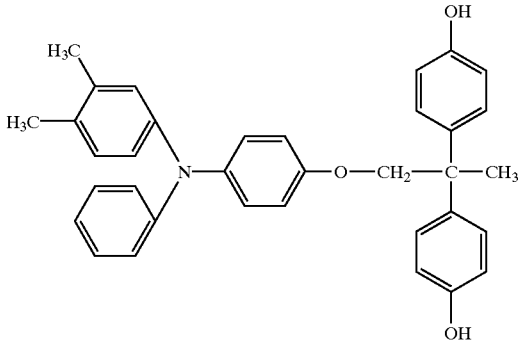

-continued
(4-39)
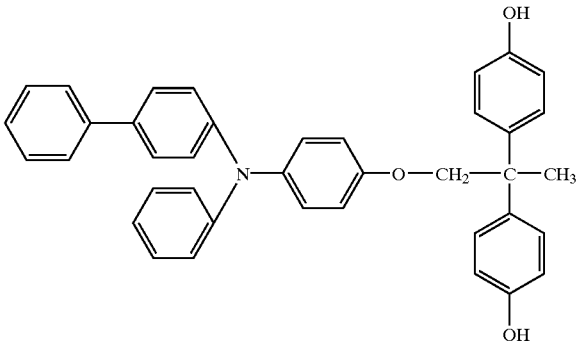
(4-40)
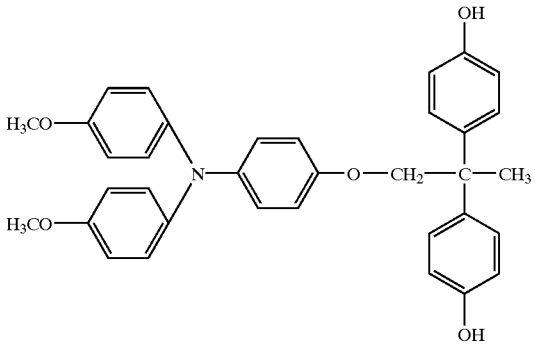
(4-41)
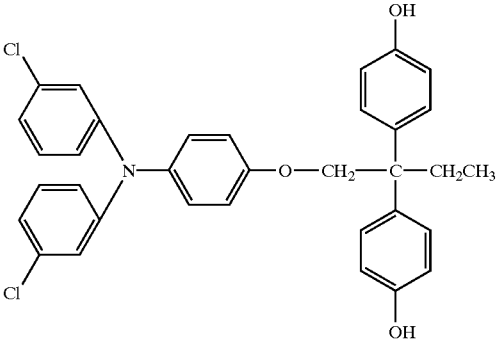
(4-42)
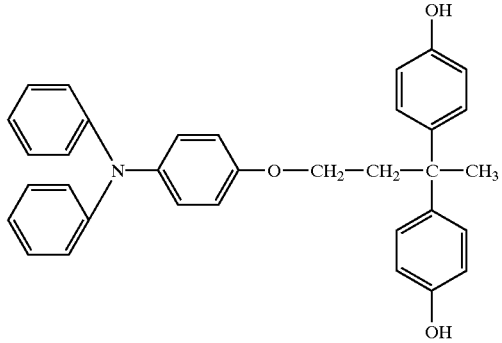
(4-43)
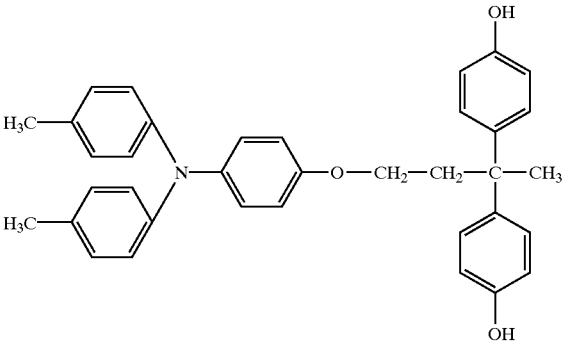
(4-44)
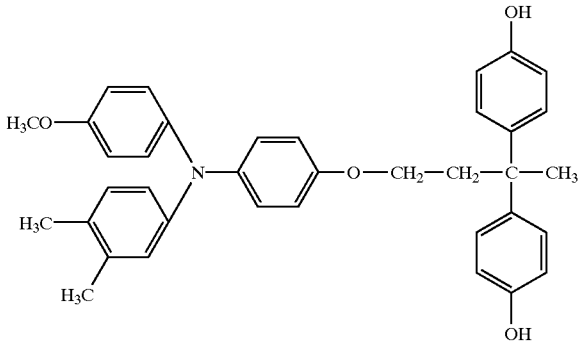
(4-45)
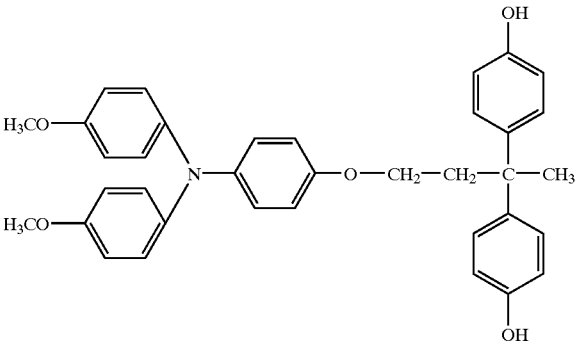
(4-46)
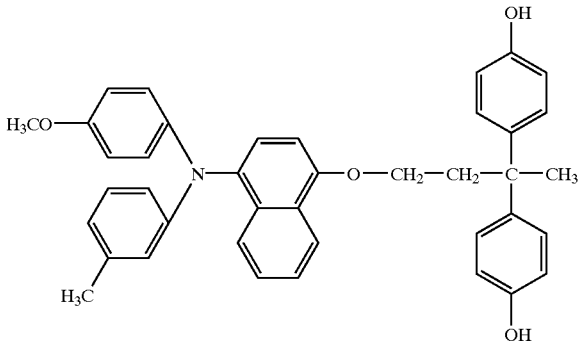

-continued
(4-47)
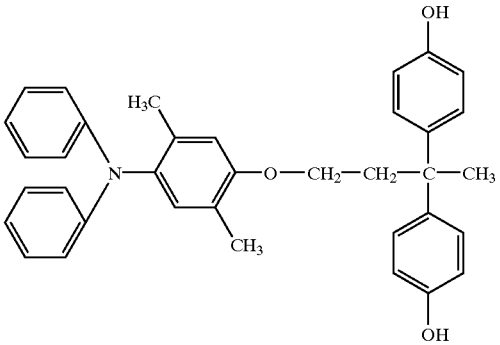
(4-48)
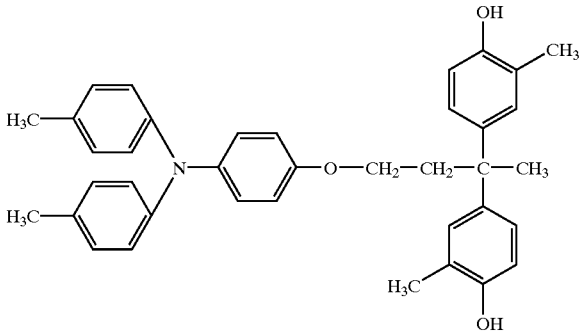
(4-49)
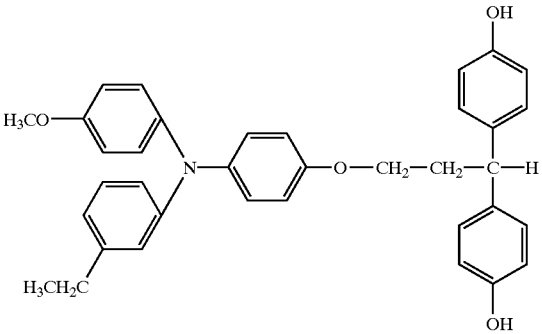
(4-50)
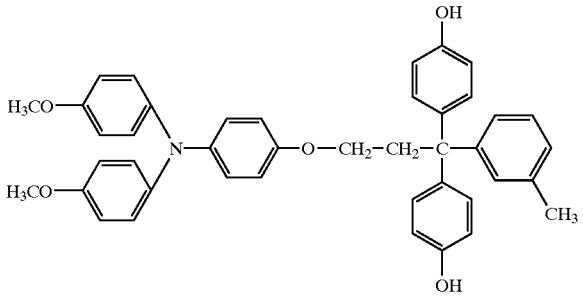
(4-51)
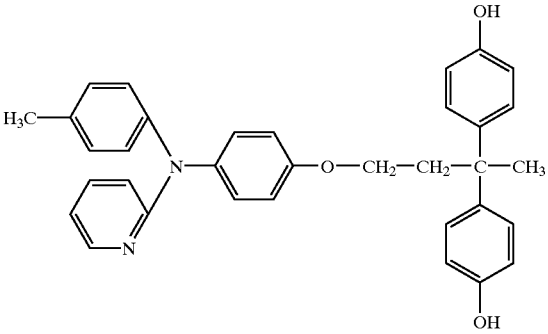
(4-52)
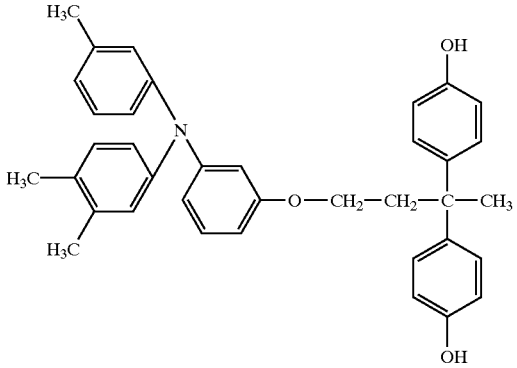
(4-53)
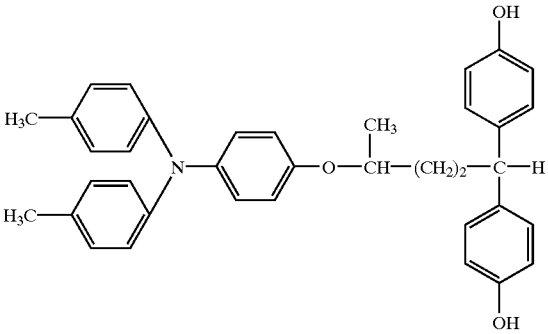
(4-54)
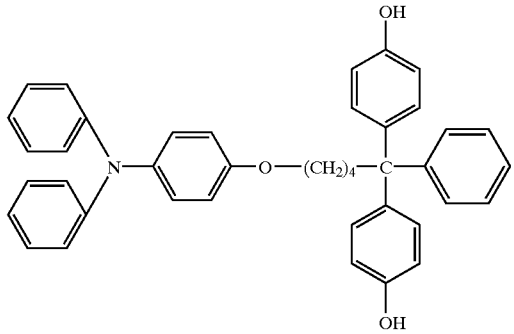

-continued
(4-55)
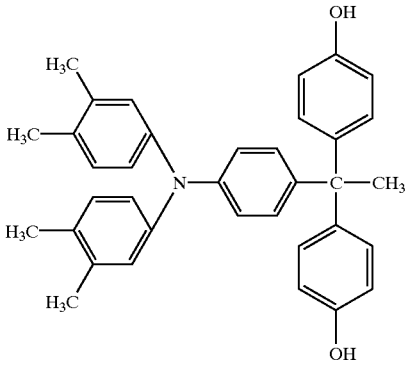
(5-1)
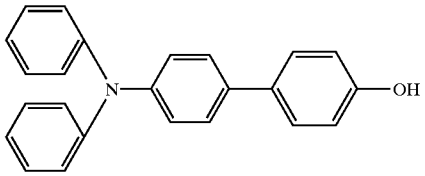
(5-2)
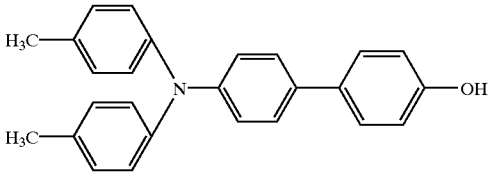
(5-3)
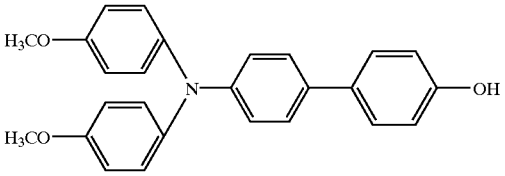
(5-4)
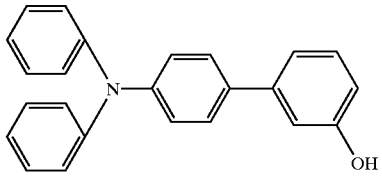
(5-5)
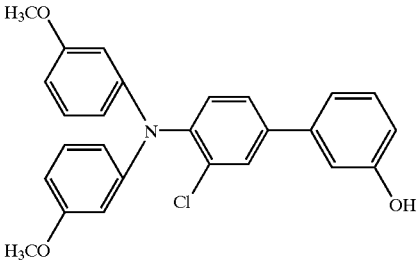
(5-6)
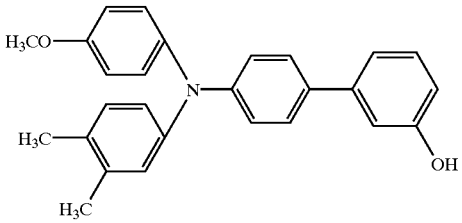
(5-7)
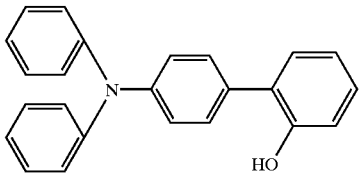
(5-8)
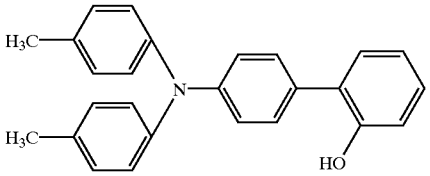
(5-9)
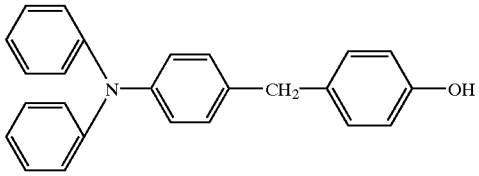
(5-10)
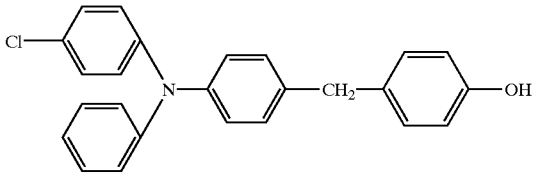
(5-11)
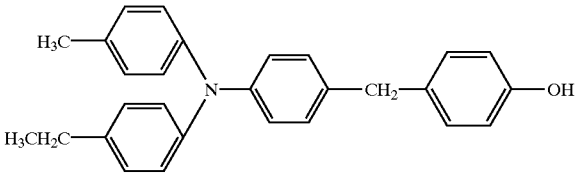

-continued
(5-12)
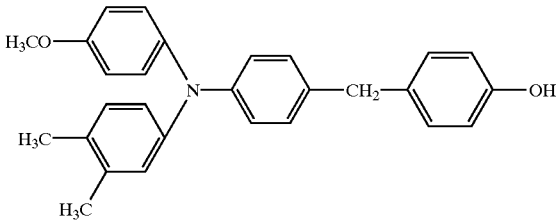
(5-13)
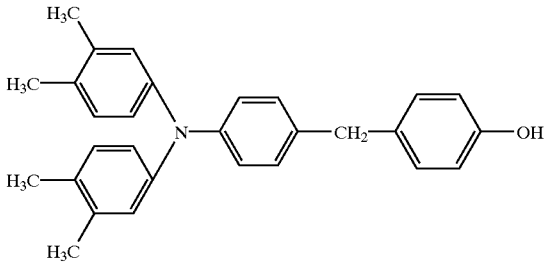
(5-14)
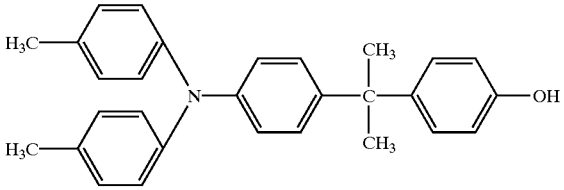
(5-15)
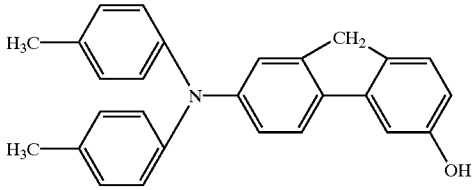
(5-16)
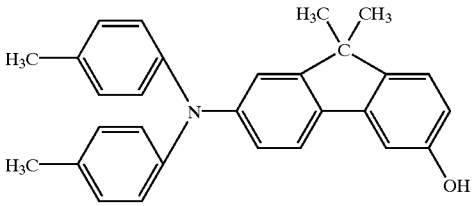
(5-17)
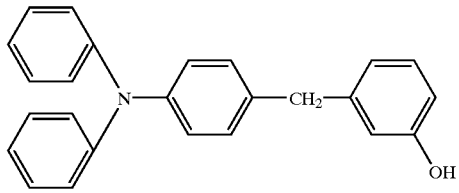
(5-18)
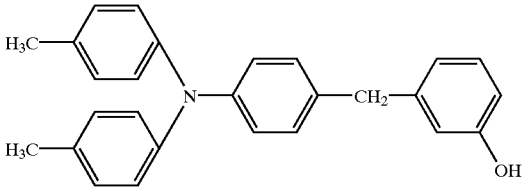
(5-19)
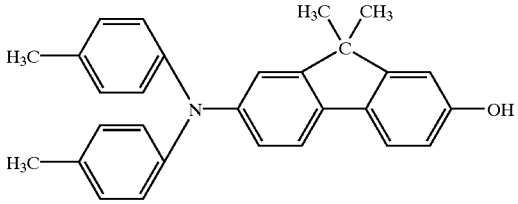
(5-20)
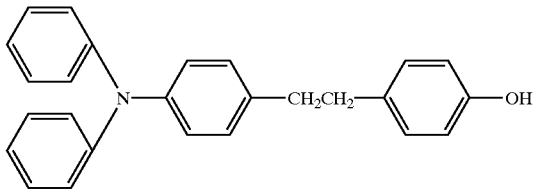
(5-21)
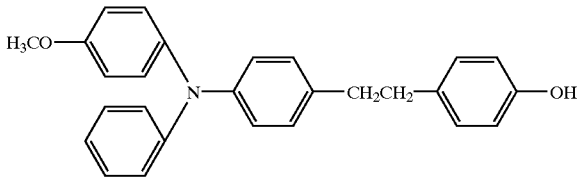
(5-22)
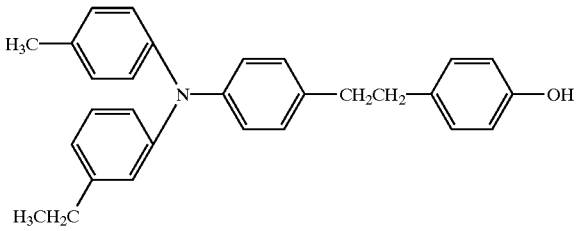
(5-23)
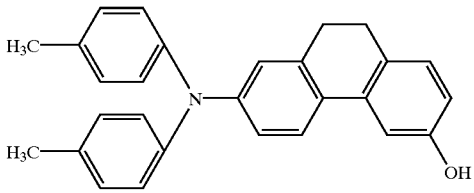

-continued
(5-24)
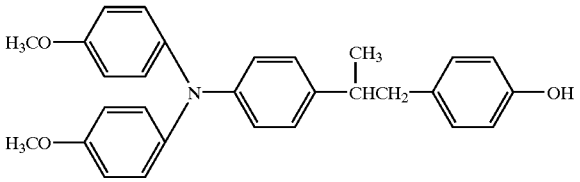
(5-25)
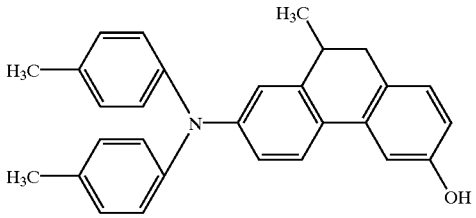
(5-26)
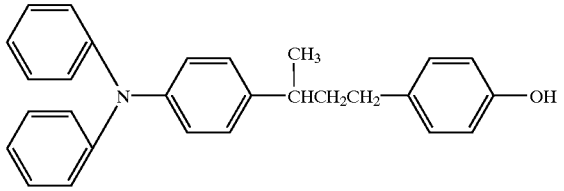
(5-27)
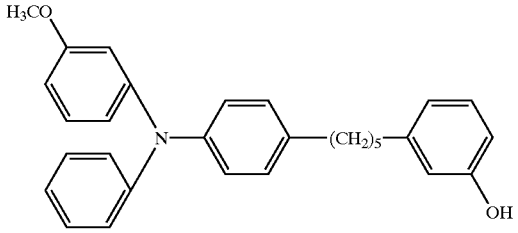
(5-28)
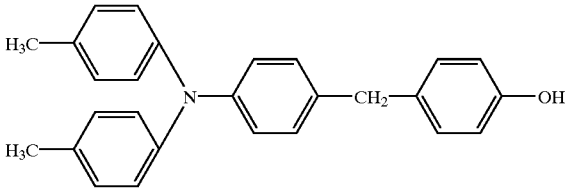
(5-29)
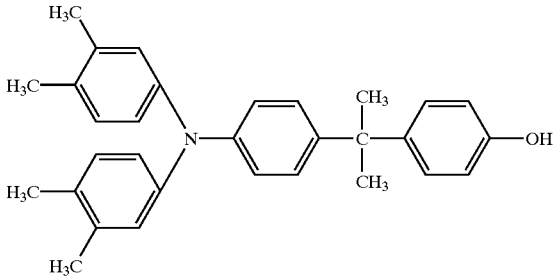
(6-1)
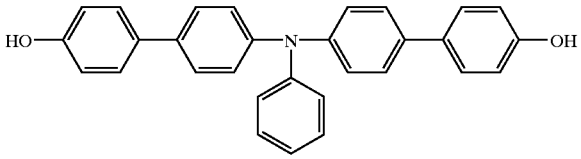
(6-2)
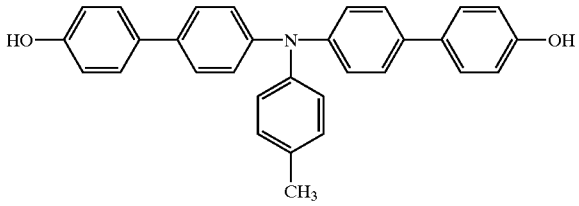
(6-3)
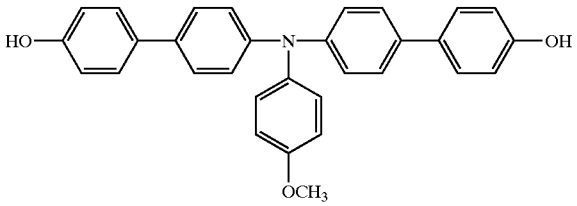
(6-4)
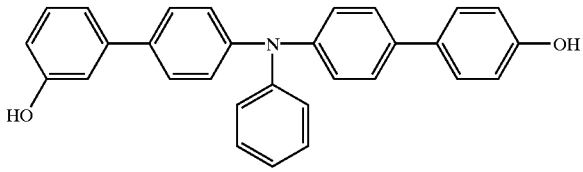
(6-5)
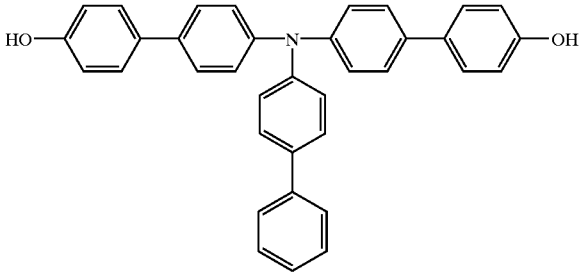
(6-6)
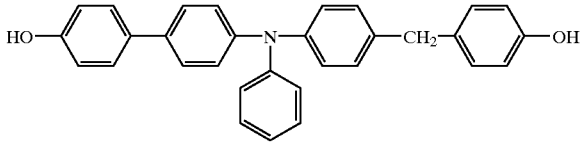

-continued
(6-7)
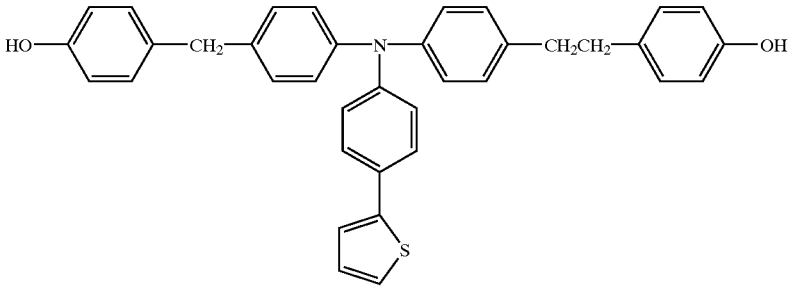
(6-8)
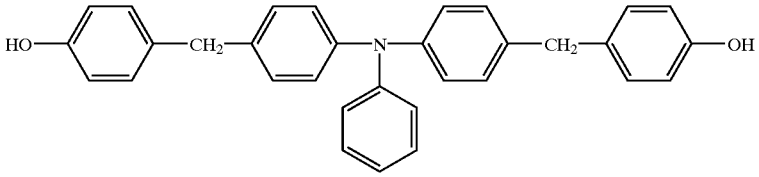
(6-9)
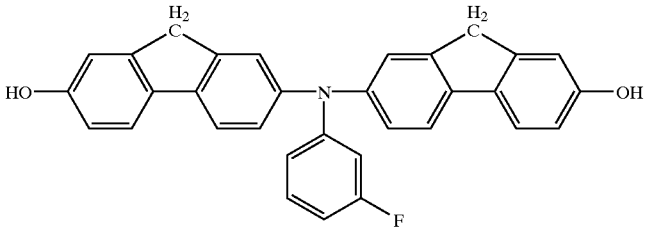
(6-10)
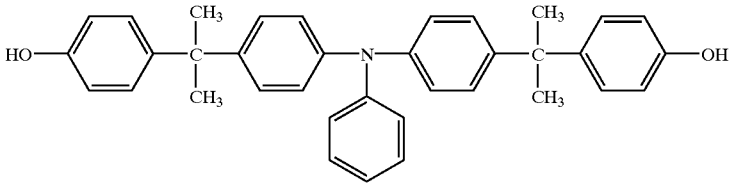
(6-11)
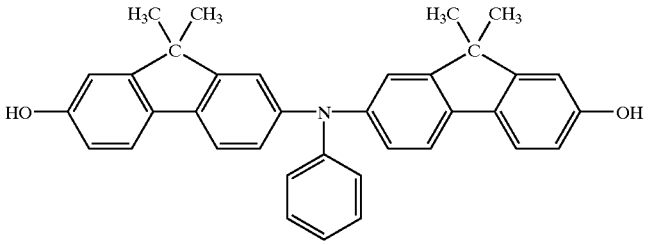
(6-12)
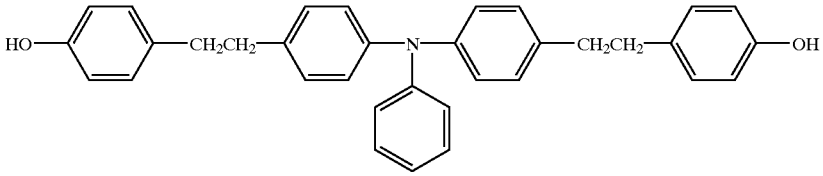
(6-13)
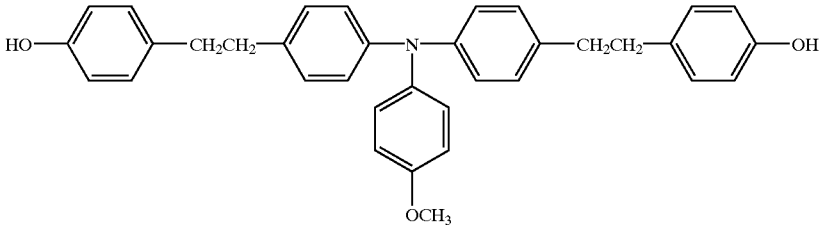

-continued
(6-14)
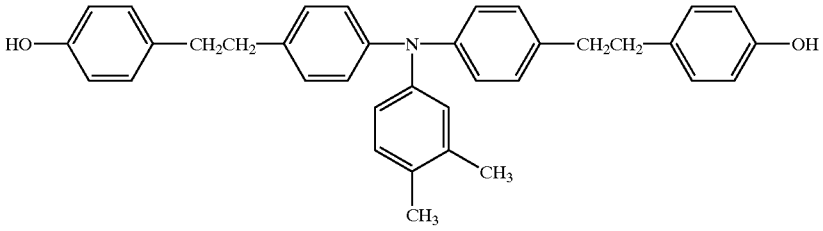
(6-15)
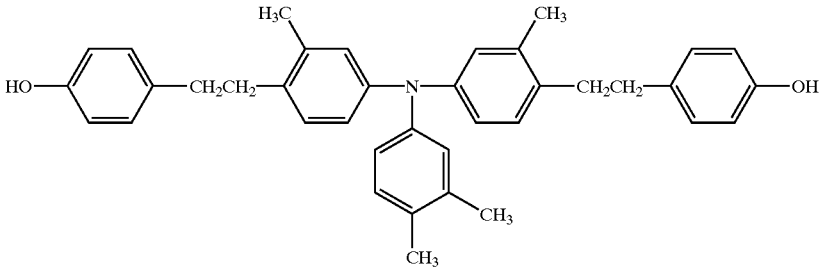
(6-16)
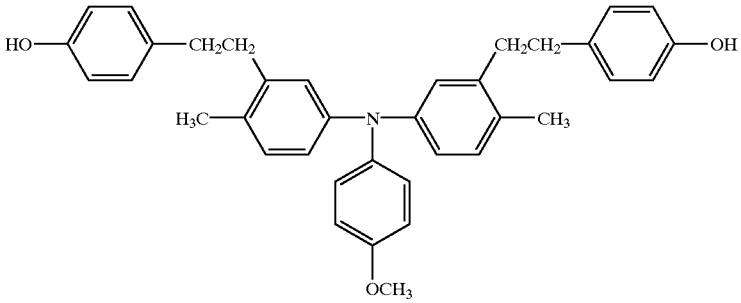
(6-17)
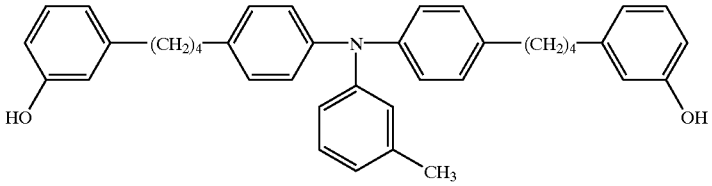
(6-18)
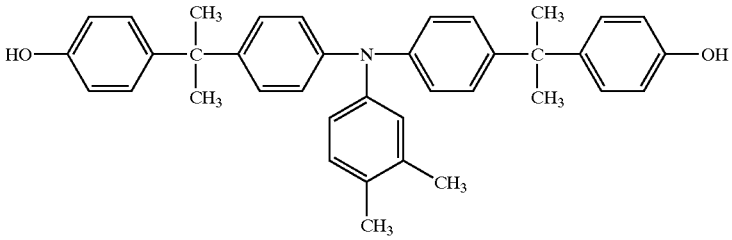
(6-19)
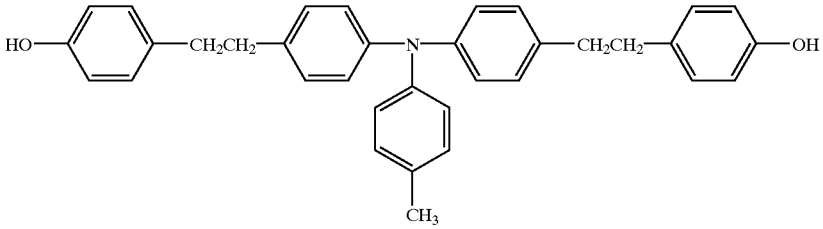

-continued (6-20)

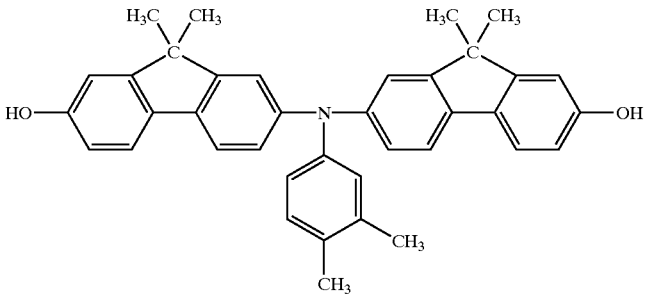

Among the charge-transporting compounds represented by the above formula (4), Example Compounds (4-6), (4-8), (4-13), (4-14) and (4-55) are preferred, and Example Compounds (4-14) and (4-55) are particularly preferred.

Among the charge-transporting compounds represented by the above formula (5), Example Compounds (5-13), (5-14), (5-16), (5-18), (5-19), (5-28) and (5-29) are preferred, and Example Compound (5-29) is particularly preferred.

Among the charge-transporting compounds represented by the above formula (6), Example Compounds (6-10), (6-11), (6-12), (6-14), (6-15), (6-18), (6-19) and (6-20) are preferred, and Example Compounds (6-14), (6-18), (6-19) and (6-20) are particularly preferred.

From the viewpoint of providing an increased strength of the protective layer, it is preferred to use a charge-transporting compound having a phenolic residue group capable of crosslinking three-dimensionally to be cured together with the phenolic resin constituting the protective layer. On the other hand, from the viewpoint of suppressing the lowering in sensitivity and the increase in residual potential, it is preferred to use a charge-transporting compound having a hydroxyalkyl group or a hydroxyalkoxy group for providing a protective layer less liable to be affected by a change in humidity.

In order to provide a further better mutual solubility between the charge-transporting compound and the curable phenolic resin, it is preferred that the divalent hydrocarbon groups denoted by $R_{11}$, $R_{12}$, $R_{13}$, $R_{21}$, $R_{22}$, $R_{23}$, $R_{31}$, $R_{32}$, $R_{33}$, $R_{34}$, $R_{51}$, $R_{61}$ and $R_{62}$ in the formulae (1)–(6) have at most 4 carbon atoms, and the charge-transporting compound has at least two of hydroxyalkyl groups, hydroxyalkoxy groups or hydroxyphenyl groups (i.e., phenolic residue groups).

The coating liquid for a protective layer may be formed by uniformly dissolving or dispersing the charge-transporting compound and the curable phenolic resin together with an appropriate solvent and applied onto a photosensitive layer, followed by curing, to provide a protective layer. In the coating liquid, the charge-transporting compound and the curable phenolic resin may preferably be contained in a weight ratio range of 0.1/10–20/10, more preferably 0.5/10–10/10. If the amount of the charge-transporting compound relative to the phenolic resin is excessively small, the effect of lowering the residual potential is lowered, and if excessive on the contrary, the strength of the protective layer is liable to be lowered.

If the protective layer having the above organization is caused to further contain electroconductive particles, the effect of lowering the residual potential can be enhanced.

The electroconductive particles may include particles of metals, metal oxides and carbon black. More specifically, metal particles may include particles of metals such as aluminum, zinc, copper, chromium, nickel, silver, and stainless steel, and plastic particles coated with a vapor-deposited film of these metals. Examples of the metal oxide particles may include: particles of metal oxides, such as zinc oxide, titanium oxide, antimony oxide, indium oxide, bismuth oxide, tin-doped indium oxide, antimony-doped tin oxide, tantalum-doped tin oxide, and antimony-doped zirconium oxide. These electroconductive particles may be used singly or in combination of two or more species. In the case of using two or more species in combination, they may be used simply in mixture or in the form of a solid solution or a melt-attached form.

Among the above-mentioned electroconductive particles, it is particularly preferred to use metal oxide particles in view of the transparency of the resultant protective layer. Further, among the metal oxide particles, it is particularly preferred to use tin oxide particles, which may be surface-treated for the purpose of improving the dispersibility and the stability of the coating liquid, or doped with antimony or trantalum for the purpose of resistivity control.

The electroconductive particles may preferably have a volume-average particle size of at most 0.3 $\mu$m, particularly 0.1 $\mu$m or smaller, in view of the transparency of the resultant protective layer. The average particle size may be measured by using an ultra-centrifugal particle size distribution measurement apparatus for particles in a coating liquid for the protective layer. It is also preferred that the metal or metal oxide particles exhibit a volume resistivity of $10^{-1}$–$10^{6}$ ohm.cm, more preferably $10^{0}$–$10^{5}$ ohm.cm as measured by the tablet method wherein ca. 0.5 g of sample particles are placed in a cylinder having a bottom area of 2.23 $cm^2$ and sandwiched between a pair of electrodes under a pressure of 15 kg to measure a resistance value under application of 100 volts in an environment of 23° C./50% RH.

In the protective layer of the electrophotographic photosensitive member of the present invention, not the charges are transported by a low-resistivity conductor function of the protective layer, but the charges are transported by the function of the charge-transporting compound contained in the protective layer to retain the sensitivity and lower the residual potential of the photosensitive member provided with such a protective layer. Accordingly, the volume resistivity of the protective layer need not be set to a low value but can be retained at a level of $1\times10^{12}$ ohm.cm or higher, thereby effectively suppressing difficulties, such as image flow of electrostatic latent images formed thereon.

Accordingly, the electroconductive particles may be contained in the protective layer only as an auxiliary agent for controlling the volume resistivity of the protective layer and can be omitted, if not required. Anyway, a larger content of electroconductive particles results in a mechanically weaker protective layer, so that the content thereof should preferably be minimized within allowable ranges of volume resistivity and residual potential of the protective layer.

The surface releasability of the photosensitive member of the present invention can be further improved by incorporating fluorine-containing resin particles as lubricant particles.

Examples of the fluorine-containing resin providing the preferred class of lubricant particles may include: tetrafluoro-ethylene resin, trifluorochloroethylene, hexafluoroethylene-propylene resin, vinyl fluoride resin, vinylidene fluoride resin, difluorodichloroethylene resin, and copolymers of these. These resin particles may be used singly or in combination of appropriately selected two or more species. Particles of tetrafluoroethylene resin and vinylidene fluoride resin are particularly preferred. The molecular weight and the particle size of these resin particles may appropriately be selected and need not be particularly restricted In the case of dispersing such fluorine-containing resin particles together with the electroconductive particles in a coating resin liquid of the protective layer, it is preferred to add a fluorine-containing compound in the coating liquid prior to the dispersion of the electroconductive particles, or to surface-treat the electroconductive particles with a fluorine-containing compound prior to the addition thereof, so as to minimize the agglomeration of the electroconductive particles together with the fluorine-containing resin particles. By the addition of or surface treatment with such a fluorine-containing compound, it becomes possible to remarkably improve the dispersibility and dispersion stability of the electroconductive particles and the fluorine-containing resin particles in the coating liquid. Further, by dispersing the fluorine-containing resin particles into a coating liquid wherein the electroconductive particles have been dispersed together with the fluorine-containing compound or the electroconductive particles surface-treated with the fluorine-containing compound have been dispersed, it becomes possible to obtain a coating liquid with good dispersion stability with time and free from formation of the secondary particles of the dispersed particles.

The fluorine-containing compound suitably usable for the above purpose may be a fluorine-containing silane coupling agent, a fluorinated silicone oil or a fluorine-containing surfactant, examples of which may be enumerated hereinbelow.

These are however not exhaustive.

[Fluorine-Containing Silane Coupling Agents]

$CF_3CH_2CH_2Si(OCH_3)_3$
$C_{10}F_{21}CH_2CH_2SCH_2CH_2Si(OCH_3)_3$
$C_4F_9CH_2CH_2Si(OCH_3)_3$
$C_6F_{13}CH_2CH_2Si(OCH_3)_3$
$C_8F_{17}CH_2CH_2Si(OCH_3)_3$
$C_8F_{17}CH_2CH_2Si(OCH_2CH_2CH_3)_3$
$C_{10}F_{21}Si(OCH_3)_3$
$C_6F_{13}CONHSi(OCH_3)_3$
$C_8F_{17}CONHSi(OCH_3)_3$
$C_7F_{15}CONHCH_2CH_2CH_2Si(OCH_3)_3$
$C_7F_{15}CONHCH_2CH_2CH_2Si(OCH_2CH_3)_3$
$C_7F_{15}COOCH_2CH_2CH_2Si(OCH_3)_3$
$C_7F_{15}COSCH_2CH_2CH_2Si(OCH_3)_3$
$C_7F_{15}SO_2NHCH_2CH_2CH_2Si(OCH_3)_3$

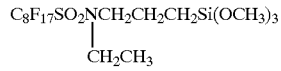

$C_8F_{17}CH_2CH_2SCH_2CH_2Si\ (OCH_3)_3$
$C_{10}F_{21}CH_2CH_2SCH_2CH_2Si\ (OCH_3)_3$

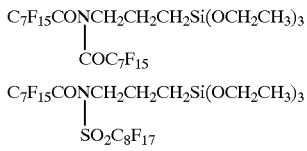

[Fluorinated Silicone Oil]

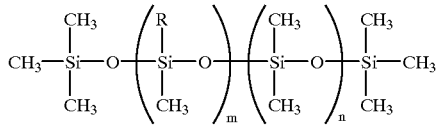

R: $—CH_2CH_2CF_3$, m & n: positive integer

[Fluorine-Containing Surfactants]

$X—SO_2NRCH_2COOH$
$X—SO_2NRCH_2CH_2O\ (CH_2CH_2O)_nH$ (n=5, 10, 15)
$X—SO_2N(CH_2CH_2CH_2OH)_2$
$X—RO(CH_2CH_2O)_n$(n=5, 10, 15)
$X—(RO)_n$ (n=5, 10, 15)
$X—(RO)_nR$ (n=5, 10, 15)

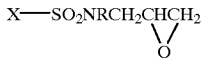

$X—COOH$, $X—CH_2CH_2COOH$
$X—ORCOOH$
$X—ORCH_2COOH$, $X—SO_3H$
$X—ORSO_3H$, $X—CH_2CH_2COOH$

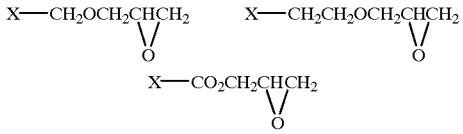

R: alkyl, aryl or aralkyl, X: fluorocarbon group, such as $—CF_3$, $—C_4F_9$, or $—C_8F_{17}$ For the surface treatment of the electroconductive particles, the electroconductive particles may be mixed and disposed together with a surface-treating agent (fluorine-containing compound) in an appropriate solvent so as to attach the surface-treating agent onto the electroconductive particles. For the dispersion, ordinary dispersion means such as a ball mill or a sand mill, may be used. Then, the solvent may be removed from the dispersion liquid to fix the surface-treating agent onto the electroconductive particles, optionally followed by a heat treatment. As desired, the electroconductive particles after the surface-treatment may be disintegrated or pulverized.

The fluorine-containing compound may be used so as to provide a surface treating amount of 1–65 wt. %, preferably 1–50 wt. %, based on the total weight of the surface-treated electroconductive particles.

In another preferred embodiment of the present invention, a phenolic resin exhibiting a better environmental stability is provided by adding a siloxane compound as represented by a formula shown below into a coating liquid or surface-treating the electroconductive particles with such a siloxane compound prior to the dispersion of the electroconductive particles in the coating liquid:

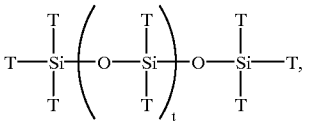

wherein each T represents a hydrogen atom or a methyl group with the proviso that the hydrogen atom occupies 0.1–50% of total T sites, and t is an integer of at least 0.

By using a coating liquid obtained by dispersing the electroconductive particles after addition of the siloxane compound or after the surface-treatment with the siloxane compound, it becomes possible to obtain a coating liquid exhibiting good dispersion stability with time and free from formation of secondary particles of the dispersed particles and provide a protective layer having a high transmittance and excellent environmental stability by using the coating liquid.

The molecular weight of the siloxane compound represented by the above formula need not be particularly restricted but may preferably be on the order of several hundred to several tens of hundred in terms of a weight-average molecular weight in order to avoid an excessively high viscosity for easiness of surface treatment in the case of the surface treatment.

The surface treatment may be effected in a dry system or a wet system. In the wet treatment, the electroconductive particles may be mixed and dispersed together with the siloxane compound in an appropriate solvent to attach the siloxane compound onto the particle surfaces. For the dispersion, ordinary dispersion means, such as a ball mill or a sand mill, may be used. During the heating for removal of the solvent for attaching the siloxane compound, the Si—H bond in the siloxane bond is oxidized with oxygen in the air to form a new siloxane bond, thereby developing a three-dimensional network structure of siloxane by which the electroconductive particles are covered. In this way, the surface treatment is completed by attachment of the siloxane compound onto the electroconductive particles, but the thus surface-treated particles can be further disintegrated or pulverized, as desired.

In the dry system treatment, the siloxane compound and the electroconductive particles are blended and kneaded without using a solvent to attach the siloxane compound onto the particle surfaces.

Thereafter, the particles are heated and pulverized or disintegrated to complete the surface treatment.

The surface treating amount with the siloxane compound may preferably be 1–50 wt. %, more preferably 3–40 wt. %, based on the surface-treated particles, while it can depend on the particle size and ratio of methyl/hydrogen in the siloxane compound.

The solvent for forming a coating liquid for forming a protective layer (protective layer-coating liquid) together with the above-mentioned ingredients including the curable phenolic resin and the charge-transporting compound, may preferably be one which well dissolves the curable phenolic resin and the charge-transporting compound, and when electroconductive particles are use, can well disperse the particles. Moreover, if further optional ingredients, such as the fluorine-containing resin particles, the fluorine-containing compound and the siloxane compound, are included, the solvent may preferably exhibit good dissolving power or processability to these ingredients, and may preferably be one not adversely affecting the photosensitive layer (or a charge transport layer therein) disposed below the protective layer.

Examples of the solvent may include: alcohols, such as methanol, ethanol and 2-propanol; ketones, such as acetone and methyl ethyl ketone; esters, such as methyl acetate and ethyl acetate; ethers, such as tetrahydrofuran and dioxane; aromatic hydrocarbons, such as toluene and xylene, and halogenated hydrocarbons, such as chlorobenzene and dichloromethane. These solvents can also be used in mixture. Among these, alcohols, such as methanol, ethanol and 2-propanol, are most suitable for use in combination with the phenolic resin.

Most conventional charge-transporting materials are generally insoluble or scarcely soluble in an alcohol solvent, but most charge-transporting compounds used in the present invention are soluble in a solvent principally comprising an alcohol, so that they can be well dispersed in a phenolic resin-based coating liquid.

The application of the protective layer-coating liquid may be performed by ordinary coating methods, such as dipping, spray coating, spinner coating, roller coating, wire bar coating and blade coating.

As for the thickness of the protective layer, too small a thickness fails to improve the durability of the photosensitive member, and too large a thickness is liable to cause an increase in residual potential. Accordingly, it is necessary to adopt an appropriate thickness, which is preferably in a range of 0.1–10 $\mu$m, more preferably 0.5–7 $\mu$m.

The protective layer can further contain another additive, such as an anti-oxidant for preventing the surface layer deterioration due to attachment of active substances, such as ozone and $NO_x$ occurring in the charging step.

Next, the organization of the photosensitive layer will be described.

The electrophotographic photosensitive member of the present invention may preferably have a laminate-type photosensitive layer including a charge generation layer containing a charge-generating material and a charge transport layer containing a charge-transporting material.

Figure 1B:
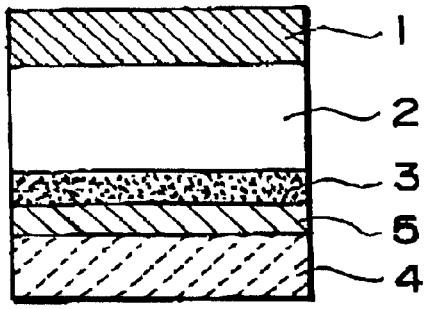
Figure 1C:
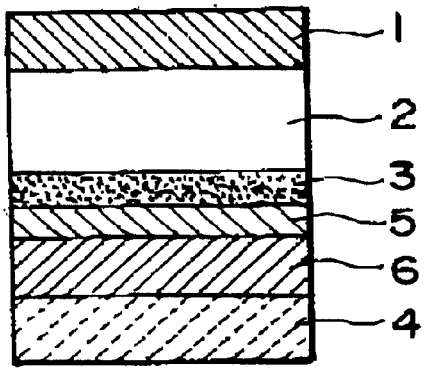

FIGS. 1A–1C show three embodiments of laminate structure of the electrophotographic photosensitive member each including such a laminate-type photosensitive layer. More specifically, the electrophotographic photosensitive member shown in FIG. 1A includes an electroconductive support 4, and a charge generation layer 3 and a charge transport layer 2 successively disposed thereon, and further a protective layer 1 as the surface most layer. As shown in FIGS. 1B and 1C, the photosensitive member can further include an undercoating layer 5, and further an electroconductive layer 6 for the purpose of, e.g., preventing the occurrence of interference fringes.

The electroconductive support 4 may be composed of a material which per se shows electroconductivity, such as aluminum, aluminum alloy or stainless steel; such an electroconductive support or a plastic support coated with a vapor deposition layer of aluminum, aluminum alloy or indium oxide-tin oxide campsite; a support comprising plastic or paper impregnated with electroconductive fine particles, such as carbon black, and fine particles of tin oxide, titanium oxide, and silver, together with an appropriate binder resin; or a shaped support comprising an electroconductive resin.

The undercoating layer 5 having a barrier function and an adhesive function may be disposed between the electroconductive layer 4 and the photosensitive layer (2 and 3). More specifically, the undercoating layer 5 is inserted for the purpose of improving the adhesion of the photosensitive layer thereon, improving the applicability of the photosensitive layer, protecting the support, coating defects on the support, improving the charge injection from the support, and protecting the photosensitive layer from electrical breakdown. The undercoating layer 5 may be formed of, eg., casein, polyvinyl alcohol, ethyl cellulose, ethylene-acrylic acid copolymer, polyamide, modified polyamide, polyurethane, gelatin or aluminum oxide. The undercoating layer 5 may preferably have a thickness of at most 5 $\mu$m, particularly 0.1–3 $\mu$m.

Examples of the charge-generating material constituting the charge generation layer 3 may include: (1) azo pigments, such as a mono-azo, dis-azo and tris-azo pigments, (2) phthalocyanine pigments, such as metallophthalocyanines and non-metallic phthalocyanine, (3) indigo pigments, such as indigo and thioindigo, (4) perylene pigments, such as perylenetetracarboxylic dianhydride and perylenetetracarboxylic diimide, (5) polycyclic quinone pigments, such as anthraquinone and pyrenequinone, (6) squalylium colorants, (7) pyrylium salts and thiopyrylium salts, (8) triphenylmethane colorants, (9) inorganic substances, such as selenium, selenium-tellurium and amorphous silicon, (10) quinacridone pigments. (11) azulenium salt pigments, (12) cyanine dyes, (13) xanthene colorants, (14) quinoneimine colorants, (15) styryl colorants, (16) cadmium sulfide and (17) zinc oxide.

Examples for the binder resin for the charge generation layer 3 may include: polycarbonate resin, polyester resin, polyarylate resin, butyral resin, polystyrene resin, polyvinyl acetal resin, diallyl phthalate resin, acrylic resin, methacrylic resin, vinyl acetate resin, phenolic resin, silicone resin, polysulfone resin, styrene-butadiene copolymer resin, alkyd resin, epoxy resin, urea resin, and vinyl chloride-vinyl acetate copolymer resin. These are however not exhaustive. These resins may be used singly or in mixture or copolymer of two or more species.

The solvent for forming a paint for forming the charge generation layer 3 may be selected depending on the solubility and dispersion stability of the resin are charge-generating material used, e.g., from organic solvents, such as alcohols, sulfoxides, ketones, ethers, esters, aliphatic halogenated hydrocarbons and aromatic compounds.

The charge generation layer 2 may be formed by dispersing and mixing the charge-generating material together with 0.3–4 times by weight thereof of the binder resin and a solvent by means of a homogenizer, an ultrasonic disperser, a ball mill, a sand mill, an attritor or a roll mill to form a coating liquid, which is then applied and dried to form the charge generation layer 3. The thickness may preferably be at most 5 $\mu$m, particularly in a range of 0.01–1 $\mu$m.

The charge generation layer 3 can further contain various additives, such as a sensitizer, an anti-oxidant, an ultraviolet absorber and a plasticizer.

Examples of the charge-transporting material constituting the charge transport layer 2 may include: triarylamine compounds, hydrazone compounds, styryl compounds, stilbene compounds, pyrazoline compounds, oxazole compounds, thiazole compounds and triarylmethane compounds.

Examples of the binder resin for forming the charge transport layer 2 may include acrylic resin, styrene resin, polyester, polycarbonate resin, polyarylate, polysulfone, polyphenylene oxide, epoxy resin, polyurethane resin, alkyl resin and unsaturated resin. Particularly preferred examples thereof may include: polymethyl methacrylate, polystyrene, styrene-acrylonitrile copolymer, polycarbonate resin and diallyl phthalate resin.

The charge transport layer 2 may generally be formed by dissolving the charge transporting material and the binder resin in a solvent to form a coating liquid, followed by application and drying of the coating liquid. The charge-transporting material and the binder resin may be blended in a weight ratio of ca. 2:1 to 1:2. Examples of the solvent may include: ketones, such as acetone and methyl ethyl ketone, aromatic hydrocarbons, such as toluene and xylene, chlorinated hydrocarbons, such as chlorobenzene, chloroform and carbon tetrachloride, and ethers, such as tetrahydrofuran and dioxane.

For application of the coating liquid, it is possible to use a coating method, such as dip coating, spray coating or spinner coating. The drying may be performed at a temperature of 10–200° C., preferably 20–150° C., for a period of 5 min. to 5 hours, preferably 10 min. to 2 hours, under air blowing or standing.

The charge transport layer 2 is electrically connected with the above-mentioned charge generation layer 3, and functions to receive charge carriers injected from the charge generation layer 3 and transport the charge carriers to the boundary with the protective layer 1 thereabove under the action of an electric field. In view of the limitation for charge transportation, the charge transport layer 2 cannot be made thicker than necessity but may preferably have a thickness in the range of 5–40 mm, particularly 7–30 $\mu$m.

The charge transport layer 2 can further contain various additives, such as an antioxidant, and ultraviolet absorber, and a lubricant, in addition to the charge-transporting material.

The electrophotographic photosensitive member of the present invention may be formed by disposing the above-mentioned protective layer 1 on the charge transport layer 2.

Next, some description will be made on the process cartridge and the electrophotographic apparatus according to the present invention.

Figure 2:
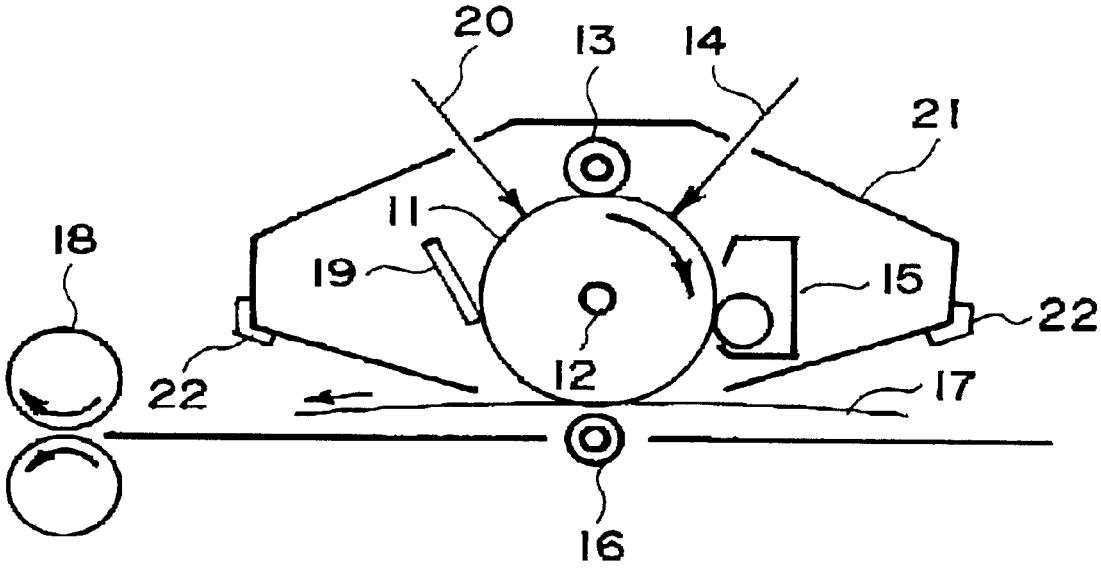
FIG. 2 is a schematic illustration of an electrophotographic apparatus including a process cartridge, which in turn includes an electrophotographic photosensitive member of the invention.

FIG. 2 shows a schematic structural view of an electrophotographic apparatus including a process cartridge using an electrophotographic photosensitive member of the invention. Referring to FIG. 2, a photosensitive member 11 in the form of a drum is rotated about an axis 12 at a prescribed peripheral speed in the direction of the arrow shown inside of the photosensitive member 11. The peripheral surface of the photosensitive member 11 is uniformly charged by means of a primary charger 13 to have a prescribed positive or negative potential. At an exposure part, the photosensitive member 11 is imagewise exposed to light 14 (as by slit exposure or laser beam-scanning exposure) by using an image exposure means (not shown), whereby an electrostatic latent image is successively formed on the surface of the photosensitive member 11. The thus formed electrostatic latent image is developed by using a developing means 15 to form a toner image. The toner image is successively transferred to a transfer (-receiving) material 17 which is supplied from a supply part (not shown) to a position between the photosensitive member 11 and a transfer charger 15 in synchronism with the rotation speed of the photosensitive member 11, by means of the transfer charger 16. The transfer material 17 carrying the toner image thereon is separated from the photosensitive member 11 to be conveyed to a fixing device 18, followed by image fixing to print out the transfer material 17 as a copy outside the electrophotographic apparatus. Residual toner particles remaining on the surface of the photosensitive member 11 after the transfer operation are removed by a cleaning means 19 to provide a cleaned surface, and residual charge on the surface of the photosensitive member 11 is erased by a pre-exposure means issuing per-exposure light 20 to prepare for the next cycle. The pre-exposure means can be omitted, as the case may be.

According to the present invention, in the electrophotographic apparatus, it is possible to integrally assemble a plurality of elements or components thereof, such as the above-mentioned photosensitive member 11, the primary charger (charging means) 13, the developing means and the cleaning means 19, into a process cartridge detachably mountable to the apparatus main body, such as a copying machine or a laser beam printer. The process cartridge may, for example, be composed of the photosensitive member 11 and at least one of the primary charging means 13, the developing means 15 and cleaning means 19, which are integrally assembled into a single unit capable of being attached to or detached from the apparatus body by the medium of a guiding means such as a rail of the apparatus body.

In the case where the electrophotographic apparatus is used as a copying machine or a printer, for example, the imagewise exposure light 14 may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

The electrophotographic photosensitive member according to the present invention may be used not only in an electrophotographic copying machine and a laser beam printer, but also in other electrophotography-applied apparatus, such as a CRT printer, an LED printer, a facsimile apparatus, a liquid crystal printer and a laser plate making.

Hereinbelow, the present invention will be described more specifically with reference to Examples and Comparative Examples wherein "parts" and "%" used for describing a relative amount of a component or a material are by weight unless specifically noted otherwise.

EXAMPLE 1

An aluminum cylinder of 30 mm in diameter and 260.5 mm in length (made of aluminum alloy according to JIS-A3003), as a support, was coated by dipping with a coating liquid comprising a 5 wt. %-solution in methanol of a polyamide resin ("AMILAN CM 8000", available from Toray K.K.). followed by drying to form a 0.5 $\mu$m-thick undercoating layer.

Separately, a coating liquid for providing a charge generation layer was prepared by mixing 4 parts of oxytitanium phthalocyanine pigment represented by a formula shown below and characterized by strong peaks at Bragg angles (2θ±0.2 deg.) of 9.6 deg., and 27.3 deg. according to Cu Kα characteristic X-ray diffraction:

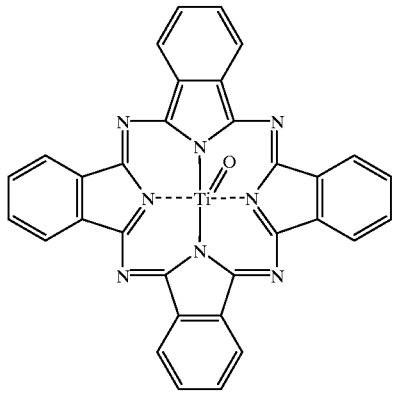

with 2 parts of polyvinyl butyral resin ("BX-1" available from Sekisui Kagaku Kogyo K.K.) and 110 parts of cyclohexanone, dispersing the mixture liquid for 4 hours in a sand mill containing 1 mm-dia. glass beads. After dilution with 130 parts of ethyl acetate, the resultant coating liquid was applied by dipping onto the undercoating layer and heated for drying to form a 0.18 $\mu$m-thick charge generation layer.

Then, a solution of 7,5 parts of a charge-transporting compound of the following formula:

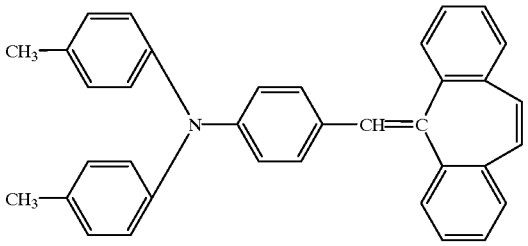

and 10 parts of bisphenol Z-type polycarbonate resin ("Z-200", available from Mitsubishi Gas Kagaku K.K.) in a mixture of 60 parts of monochrolobenzene and 20 parts of dichloromethane, was applied by dipping onto the charge generation layer and heated with hot air for drying at 110° C. for 1 hour to form a 20 $\mu$-thick charge transport layer.

Then, a coating liquid for providing a protective layer was prepared as follows. First, 35 parts of 7%-surface-treated antimony-doped tin oxide fine particles,i.e., surface-treated with 7% (7 parts for 100 parts of the fine particles) of a fluorine-containing silane coupling agent ("LS-1090", made by Shin-Etsu Kagaku Kogyo K.K.) represented by a formula below.

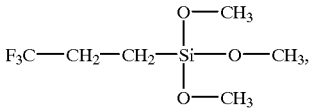

was mixed with 150 parts of ethanol for 66 hours of dispersion in a sand mill to form a dispersion liquid containing the tin oxide particles in a volume-average particle size (Dv) of 0.03 $\mu$m, and then 20 parts of polytetrafluoroethylene fine particles (Dv=0.18 $\mu$m) was added thereto, followed by further 12 hours dispersion. Then, 54 parts (non-volatile matter content=45%) of resole-type phenolic resin ("PR-53123", made by Sumitomo Durez K.K.) and the above-mentioned Example Compound (1-23) (charge-transporting compound having a hydroxyalkyl group) were dissolved in the above-formed dispersion liquid, followed by dilution with 35 parts of ethanol, to form a coating liquid.

The thus-prepared protective layer coating liquid was then applied by dipping onto the above-formed charge transport layer and dried and cured by heating with hot air at 145° C. to form a 3 μm-thick protective layer, thereby obtaining a photosensitive member. The coating liquid exhibited a good dispersion of the particles therein, and the resultant protective layer provided a uniform surface with no irregularity.

The electroptotographic performances of the above-prepared photosensitive member were evaluated by setting it in a remodeled product of a commercially available laser beam printer ("LBP-NX", made by Canon K.K.) and evaluated in environments of NT/NH (normal temperature/normal humidity=23° C./60% RH) and NT/LH (normal temperature/low humidity=23° C./10% RH). For measurement of electrophotographic sensitivity, the photosensitive member was charged to a dark potential of −700 volts, and then a light quantity required to lower the potential to −200 volts was measured as a measure of sensitivity ($E_{500}$(μJ/cm$^2$)) and a potential after irradiation with a light quantity of 20 μJ/cm$^2$ was measured as a residual dual potential (Vr (-volts)), respectively by irradiation with laser light at a wavelength of 780 nm. Further, by using the laser beam printer, the photosensitive member was subjected to measurement of a transfer efficiency at an initial stage and an abrasion after continuous printing on 5000 sheets.

Separately from the above electrophotographic performance evaluation, the protective layer was evaluated with respect to a hardness (HU) and a volume resistivity (Rv) by forming a separate protective layer sample from the above protective layer-coating liquid.

More specifically, for the hardness measurement, the protective layer-coating liquid was applied on a glass plate and cured under an identical condition as for the provision of the protective layer on the photosensitive layer. This was repeated 3–4 times to form a 10 μm-thick protective layer sample. Then, a diamond stylus having a pyramid tip apex angle of 136 deg. was pressed under a load W (N) down to a depth of 1 μm in the protective layer film, and the resultant depression trace surface Sd (mm$^2$) was measured to calculated a universal hardness value HU (N/mm$^2$) according to the following formula (I):

$$HU\ (N/mm^2)\ W/Sd \ldots \quad (I).$$

For the resistivity measurement, the protective layer-coating liquid was applied by a wire bar over a polyethylene terephthalate film already provided thereon with comb-shaped electrodes of vapor-deposited aluminum with a gap of 180 μm and cured by a hot air drying under an identical condition as the formation on the protective layer on the protective layer to form an identical thickness of protective layer film. The film sample was then supplied with a voltage of 100 volts by a tester ("pA-METER 4140B", made by Hewlett Packard Corp.). The measurement was performed in an environment of 23° C. and 50% RH.

The results of the above evaluation are inclusively shown in Table 1 together with those of the following Examples.

EXAMPLES 2–9

Eight photosensitive members were prepared and evaluated in the same manner as in Example 1 except for using protective layer-coating liquids obtained by using an Example Compound or a mixture of Example Compounds listed in Table 1 instead of Example Compound (1-23 as the charge-transporting compound.

EXAMPLES 10–13

Four photosensitive members were prepared and evaluated in the same manner as in Examples 1, 5, 6 and 9, respectively, except for using protective layer-coating liquids obtained by reducing the amount of the 7%-surface-treated antimony-doped tin oxide fine particles to 20 parts and further adding 15 parts of 20%-surface-treated antimony-doped tin oxide fine particles (surface-treated with methyl hydrogen silicone oil ("KF99", made by Shin-Etsu Silicone

EXAMPLES 14–17

Four photosensitive members were prepared and evaluated in the same manner as in Examples 1, 5, 6 and 9, respectively, except for using protective layer-coating liquids obtained by using 35 parts of surface-untreated antimony-doped tin oxide fine particles ("T-1", made by Mitsubishi Material K.K.) instead of the 7%-surface-treated antimony-doped tin oxide fine particles and further adding 3.5 parts of the fluorine-containing silane coupling agent ("LS-1090") used in Example 1, followed by the dispersion.

EXAMPLES 18–21

Four photosensitive members were prepared and evaluated in the same manner as in Example 1 except for using protective layer-coating liquids obtained by further adding 1.5 parts of methyl hydrogen silicone oil ("KF99", made by Shin-Etsu Silicone K.K.) to the protective layer-coating liquids obtained in Examples 14–17, followed further by 4 hours of stirring.

EXAMPLES 22–25

Four protective layer-coating liquids were prepared by dispersing 35 parts of the 7%-surface-treated antimony-doped tin oxide fine particles used in Example 1 together with 150 parts of ethanol in a sand mill for 66 hours, and then adding thereto 67 parts of the resole-type phenolic resin (non-volatile matter content 45%) used in Example 1 and 15 parts of Example Compounds (charge-transporting compounds), respectively, listed in Table 1, followed by 4 hours of stirring.

Four photosensitive members were prepared and evaluated in the same manner as in Example 1 except for using the above-prepared four protective layer-coating liquids.

EXAMPLES 26–30

Five protective layer-coating liquids were prepared by dissolving 67 parts of the phenolic resin (non-volatile matter content=45%) used in Example 1 and 21 parts each of Example Compounds (charge-transporting compounds), respectively listed in Table 1, in 82 parts of ethanol.

Five photosensitive members were prepared and evaluated in the same manner as in Example 1 except for using the above-prepared five protective layer-coating liquids.

EXAMPLE 31

A photosensitive member was prepared and evaluated in the same manner as in Example 1 except for using a protective layer-coating liquid obtained by using 42 parts (non-volatile matter content=58 %) of a resole-type phenolic resin ("PL-531230") (and containing similarly 15 parts of Example Compound (1-23) as a charge-transporting compound having a hydroxyalkyl group).

EXAMPLES 32–35

Four photosensitive members were prepared and evaluated in the same manner as in Example 31 except for using a protective layer-coating liquid obtained by using Example Compounds (charge-transporting compounds), respectively, listed in Table 1 instead of Example Compound (1-23).

EXAMPLES 36–39

Four protective layer-coating liquids were prepared by dissolving 52 parts of the phenolic resin (non-volatile matter content=58%) used in Example 31 and 21 parts each of Example Compounds (charge-transporting compounds), respectively, listed in Table 1 together with 82 parts of ethanol, followed by 4 hours of stirring.

Four photosensitive members were prepared and evaluated in the same manner as in Example 1 except for using the above-prepared four protective layer-coating liquids.

EXAMPLE 40

A protective layer-coating liquid was prepared by dispersing 35 parts of the 7%-surface-treated antimony-doped tin oxide fine particles used in Example 1 together with 150 parts of ethanol in a sand mill for 66 hours, adding thereto 18 parts of polytetrafluoroethylene fine particles (Dv=0.18$\mu$m) followed by 12 hours of dispersion in the sand mill, and adding thereto 54 parts of the resole-type phenolic resin ("PR-53123", non-volatile matter content=45%) and 15 parts of Example Compound (4-14) (a charge-transporting compound having a hydroxyphenyl group) for dissolution therein, followed by dilution with 35 parts of acetone.

A photosensitive member was prepared and evaluated in the same manner as in Example 1 except for using the above-prepared protective layer-coating liquid.

EXAMPLES 41–45

Five photosensitive members were prepared and evaluated in the same manner as in Example 40 except for using a protective layer-coating liquid obtained by using Example Compounds (charge-transporting compounds), respectively, listed in Table 1, instead of Example Compound (4-14).

EXAMPLES 46–48

Three photosensitive members were prepared and evaluated in the same manner as in Examples 40, 42 and 44, respectively, except for using protective layer-coating liquids obtained by reducing the amount of the 7%-surface-treated antimony-doped tin oxide fine particles to 20 parts and further adding 15 parts of 20%-surface-treated antimony-doped tin oxide fine particles (surface-treated with methyl hydrogen silicone oil ("KF99", made by Shin-Etsu Silicone K.K.))

EXAMPLES 49–51

Three photosensitive members were prepared and evaluated in the same manner as in Examples 40, 42 and 44, respectively, except for using protective layer-coating liquids obtained by using 35 parts of surface-treated antimony-doped tin oxide fine particles ("T-1", made by Mitsubishi Material K.K.) instead of the 7%-surface-treated antimony-doped tin oxide fine particles and further adding 3.5 parts of the fluorine-containing silane coupling agent ("LS-1090") used in Example 1, followed by the dispersion.

EXAMPLES 52–54

Three photosensitive members were prepared and evaluated in the same manner as in Example 40 except for using protective layer-coating liquids obtained by further adding 1.5 parts of methyl hydrogen silicone oil ("KF99", made by Shin-Etsu Silicone K.K.) to the protective layer-coating liquids obtained in Examples 49–51, followed further by 4 hours of stirring.

EXAMPLES 55–57

Three protective layer-coating liquids were prepared by dispersing 35 parts of the 7%-surface-treated antimony-doped tin oxide fine particles used in Example 40 together with 150 parts of ethanol in a sand mill for 66 hours, and then adding thereto 67 parts of the resole-type phenolic resin (non-volatile matter content=45%) used in Example 40 and 15 parts of Example Compounds (charge-transporting compounds), respectively listed in Table 1, followed by dilution with 35 parts of acetone and 4 hours of stirring.

Four photosensitive members were prepared and evaluated in the same manner as in Example 40 except for using the above-prepared four protective layer-coating liquids.

EXAMPLES 58–64

Seven protective layer-coating liquids were prepared by dissolving 67 parts of the phenolic resin (non-volatile matter content=45%) used in Example 40 and 21 parts each of Example Compounds (charge-transporting compounds), respectively listed in Table 1, together with 58 parts of ethanol and 24 parts of acetone, followed by 4 hours of stirring.

Seven photosensitive members were prepared and evaluated in the same manner as in Example 1 except for using the above-prepared seven protective layer-coating liquids.

EXAMPLE 65

A photosensitive member was prepared and evaluated in the same manner as in Example 40 except for using a protective layer-coating liquid obtained by using 42 parts (non-volatile matter content 58%) of a resole-type phenolic resin ("PL-2211", made by Gun'ei Kagaku Kogyo K.K.) instead of the phenolic resin ("PL-53123") and using 15 parts of Example Compound (4-44) as a charge-transporting compound instead of Example Compound (4-14).

EXAMPLES 66–68

Three photosensitive members were prepared and evaluated in the same manner as in Example 65 except for using protective layer-coating liquids obtained by using Example Compounds (charge-transporting compounds), respectively listed in Table 1, instead of Example Compound (4-44).

EXAMPLES 69–74

Six protective layer-coating liquids were prepared by dissolving 52 parts of the phenolic resin (non-volatile matter content=58%) used in Example 65 and 21 parts each Example Compounds (charge-transporting compounds), respectively listed in Table 1, together with 58 parts of ethanol and 24 parts of acetone, followed by 4 hours of stirring.

Six photosensitive members were prepared and evaluated in the same manner as in Example 40 except for using the above-prepared four protective layer-coating liquids.

EXAMPLES 75–81

Seven photosensitive members were prepared and evaluated in the same manner as in Example 1 except for using protective layer-coating liquids obtained by using Example Compounds, respectively listed in Table 1, instead of Example Compound (1-23) as the charge-transporting compound.

EXAMPLES 82–88

Seven photosensitive members were prepared and evaluated in the same manner as in Example 26 except for using protective layer-coating liquids obtained by using Example Compounds, respectively listed in Table 1, instead of Example Compound (1-23) as the charge-transporting compound.

EXAMPLES 89–92

Four photosensitive members were prepared and evaluated in the same manner as in Example 40 except for using protective layercoating liquids obtained by using Example Compounds, respectively listed in Table 1, instead of Example Compound (4-14) as the charge-transporting compound.

EXAMPLES 93–96

Four photosensitive members were prepared and evaluated in the same manner as in Example 58 except for using protective layer-coating liquids obtained by using Example Compounds, respectively listed in Table 1, instead of Example Compound (4-6) as the charge-transporting compound.

The results of the above-described Examples are inclusively shown in Table 1 below.

TABLE 1

| | Example Compound No. | | Protective layer performances | | | | | | | |
|---|---|---|---|---|---|---|---|---|---|---|
| | | | NT/NH(23° C./65% RH) | | NT/LH(23° C./10% RH) | | | Abrasion (μm) | | |
| Ex. | (Charge transporter) | wt. Parts | $E_{500}$ (μJ/cm$^2$) | Vr (−volts) | $E_{500}$ (μJ/sm$^2$) | Vr (−volts) | Transfer efficiency (%) | after 500 sheets | Hardness HO (W/mm$^2$) | Resistivity Rv (Ohm · cm) |
| 1 | 1–23 | 15 | 0.38 | 33 | 0.40 | 40 | 92 | 0.5 | 282 | $3.6 \times 10^{12}$ |
| 2 | 1–4 | 15 | 0.42 | 35 | 0.44 | 41 | 93 | 0.4 | 279 | $5.7 \times 10^{12}$ |
| 3 | 1–12/1–21 | 6/9 | 0.39 | 33 | 0.40 | 38 | 92 | 0.5 | 281 | $5.1 \times 10^{12}$ |
| 4 | 1–25 | 15 | 0.40 | 34 | 0.42 | 39 | 93 | 0.5 | 280 | $6.0 \times 10^{12}$ |
| 5 | 2–30 | 15 | 0.39 | 32 | 0.40 | 38 | 94 | 0.5 | 277 | $7.3 \times 10^{12}$ |
| 6 | 1–47/2–10 | 10/5 | 0.39 | 33 | 0.41 | 38 | 91 | 0.5 | 286 | $3.9 \times 10^{13}$ |
| 7 | 2–20 | 15 | 0.40 | 36 | 0.41 | 42 | 92 | 0.4 | 275 | $8.7 \times 10^{12}$ |
| 8 | 3–8 | 15 | 0.37 | 32 | 0.39 | 37 | 93 | 0.5 | 280 | $4.7 \times 10^{12}$ |
| 9 | 1–50/3–9 | 11/4 | 0.38 | 32 | 0.39 | 37 | 92 | 0.5 | 293 | $1.2 \times 10^{13}$ |
| 10 | 1–23 | 15 | 0.39 | 35 | 0.41 | 40 | 93 | 0.5 | 281 | $4.2 \times 10^{12}$ |
| 11 | 2–30 | 15 | 0.42 | 34 | 0.44 | 40 | 93 | 0.5 | 281 | $5.5 \times 10^{13}$ |
| 12 | 1–47/2–10 | 10/5 | 0.40 | 35 | 0.42 | 42 | 94 | 0.5 | 284 | $3.6 \times 10^{12}$ |
| 13 | 1–50/3–9 | 11/4 | 0.38 | 33 | 0.41 | 39 | 92 | 0.4 | 279 | $8.1 \times 10^{12}$ |
| 14 | 1–23 | 15 | 0.38 | 32 | 0.40 | 39 | 93 | 0.5 | 284 | $9.9 \times 10^{12}$ |
| 15 | 2–30 | 15 | 0.39 | 33 | 0.40 | 38 | 92 | 0.5 | 285 | $8.1 \times 10^{12}$ |
| 16 | 1–47/2–10 | 10/5 | 0.41 | 36 | 0.43 | 41 | 92 | 0.4 | 280 | $3.8 \times 10^{13}$ |
| 17 | 1–50/3–9 | 11/4 | 0.38 | 34 | 0.40 | 40 | 93 | 0.5 | 281 | $5.4 \times 10^{12}$ |
| 18 | 1–23 | 15 | 0.39 | 37 | 0.40 | 44 | 91 | 0.5 | 282 | $7.0 \times 10^{12}$ |
| 19 | 2–30 | 15 | 0.40 | 35 | 0.41 | 41 | 92 | 0.5 | 280 | $4.8 \times 10^{12}$ |
| 20 | 1–47/2–10 | 10/5 | 0.40 | 35 | 0.42 | 41 | 92 | 0.5 | 278 | $1.1 \times 10^{13}$ |
| 21 | 1–50/3–9 | 11/4 | 0.38 | 35 | 0.41 | 40 | 92 | 0.5 | 280 | $7.7 \times 10^{12}$ |
| 22 | 1–23 | 15 | 0.38 | 31 | 0.40 | 38 | 89 | 0.5 | 295 | $5.9 \times 10^{12}$ |
| 23 | 2–30 | 15 | 0.39 | 32 | 0.40 | 38 | 89 | 0.5 | 285 | $6.2 \times 10^{12}$ |
| 24 | 1–47/2–10 | 10/5 | 0.40 | 31 | 0.42 | 36 | 87 | 0.5 | 279 | $5.7 \times 10^{12}$ |
| 25 | 1–50/3–9 | 11/4 | 0.37 | 32 | 0.29 | 37 | 87 | 0.6 | 278 | $6.4 \times 10^{12}$ |
| 26 | 1–23 | 21 | 0.29 | 40 | 0.30 | 46 | 90 | 0.3 | 299 | $2.6 \times 10^{13}$ |
| 27 | 1–50/2–33 | 18/3 | 0.31 | 39 | 0.32 | 45 | 88 | 0.4 | 313 | $3.0 \times 10^{13}$ |
| 28 | 2–22 | 21 | 0.27 | 39 | 0.29 | 45 | 88 | 0.3 | 305 | $2.8 \times 10^{13}$ |
| 29 | 1–25/3–19 | 18/3 | 0.28 | 38 | 0.30 | 45 | 89 | 0.3 | 320 | $4.7 \times 10^{13}$ |
| 30 | 1–50/3–9 | 18/3 | 0.29 | 37 | 0.31 | 42 | 87 | 0.3 | 310 | $5.5 \times 10^{13}$ |
| 31 | 1–23 | 15 | 0.36 | 32 | 0.38 | 39 | 94 | 0.5 | 282 | $5.0 \times 10^{12}$ |
| 32 | 1–6/1–44 | 3/12 | 0.37 | 30 | 0.42 | 36 | 93 | 0.4 | 286 | $6.3 \times 10^{12}$ |
| 33 | 1–21/2–22 | 12/3 | 0.36 | 31 | 0.40 | 36 | 93 | 0.5 | 277 | $7.7 \times 10^{12}$ |
| 34 | 2–23 | 15 | 0.38 | 30 | 0.42 | 34 | 93 | 0.5 | 290 | $3.7 \times 10^{12}$ |
| 35 | 1–50/3–9 | 11/4 | 0.36 | 33 | 0.42 | 37 | 92 | 0.5 | 285 | $8.9 \times 10^{12}$ |
| 36 | 1–23 | 21 | 0.28 | 41 | 0.29 | 46 | 89 | 0.3 | 329 | $4.2 \times 10^{13}$ |
| 37 | 1–50/2–33 | 18/3 | 0.29 | 40 | 0.31 | 45 | 89 | 0.3 | 318 | $2.7 \times 10^{13}$ |
| 38 | 2–30 | 21 | 0.30 | 38 | 0.31 | 43 | 90 | 0.3 | 325 | $2.9 \times 10^{12}$ |
| 39 | 1–50/3–9 | 18/3 | 0.29 | 38 | 0.31 | 43 | 88 | 0.3 | 325 | $4.1 \times 10^{13}$ |
| 40 | 4–14 | 15 | 0.40 | 32 | 0.45 | 47 | 93 | 0.5 | 299 | $4.2 \times 10^{12}$ |
| 41 | 4–8 | 15 | 0.40 | 33 | 0.44 | 47 | 93 | 0.5 | 297 | $5.6 \times 10^{12}$ |
| 42 | 5–12 | 15 | 0.39 | 33 | 0.45 | 45 | 94 | 0.5 | 301 | $4.4 \times 10^{12}$ |
| 43 | 4–13/5–18 | 8/7 | 0.40 | 32 | 0.45 | 46 | 93 | 0.4 | 305 | $8.3 \times 10^{12}$ |
| 44 | 4–17/6–15 | 12/3 | 0.38 | 35 | 0.47 | 44 | 92 | 0.5 | 295 | $3.7 \times 10^{12}$ |
| 45 | 6–13 | 15 | 0.39 | 34 | 0.48 | 48 | 93 | 0.4 | 307 | $1.2 \times 10^{13}$ |
| 46 | 4–14 | 15 | 0.41 | 36 | 0.46 | 50 | 91 | 0.4 | 295 | $6.1 \times 10^{12}$ |
| 47 | 5–12 | 15 | 0.40 | 37 | 0.46 | 49 | 92 | 0.5 | 297 | $4.3 \times 10^{12}$ |
| 48 | 4–17/6–15 | 12/3 | 0.38 | 36 | 0.47 | 51 | 90 | 0.5 | 288 | $1.0 \times 10^{12}$ |
| 49 | 4–14 | 15 | 0.39 | 35 | 0.46 | 49 | 93 | 0.5 | 306 | $7.2 \times 10^{12}$ |
| 50 | 5–12 | 15 | 0.38 | 34 | 0.48 | 49 | 92 | 0.4 | 302 | $9.4 \times 10^{12}$ |

TABLE 1-continued

| Ex. | Example Compound No. (Charge transporter) | wt. Parts | Protective layer performances: NT/NH(23° C./65% RH) $E_{500}$ ($\mu$J/cm$^2$) | Vr (−volts) | NT/LH(23° C./10% RH) $E_{500}$ ($\mu$J/sm$^2$) | Vr (−volts) | Transfer efficiency (%) | Abrasion ($\mu$m) after 500 sheets | Hardness HO (W/mm$^2$) | Resistivity Rv (Ohm · cm) |
|---|---|---|---|---|---|---|---|---|---|---|
| 51 | 4–17/6–15 | 12/3 | 0.41 | 34 | 0.49 | 50 | 90 | 0.5 | 303 | $5.5 \times 10^{12}$ |
| 52 | 4–14 | 15 | 0.40 | 36 | 0.45 | 49 | 93 | 0.5 | 300 | $1.4 \times 10^{12}$ |
| 53 | 5–12 | 15 | 0.39 | 37 | 0.45 | 52 | 90 | 0.5 | 297 | $6.7 \times 10^{12}$ |
| 54 | 4–17/6–15 | 12/3 | 0.41 | 36 | 0.47 | 50 | 93 | 0.5 | 301 | $8.2 \times 10^{12}$ |
| 55 | 4–4/4–45 | 7/8 | 0.39 | 32 | 0.44 | 48 | 89 | 0.4 | 322 | $1.0 \times 10^{13}$ |
| 56 | 5–13 | 15 | 0.40 | 32 | 0.46 | 49 | 88 | 0.5 | 325 | $6.6 \times 10^{12}$ |
| 57 | 6–15 | 15 | 0.41 | 32 | 0.45 | 47 | 87 | 0.5 | 318 | $4.8 \times 10^{12}$ |
| 58 | 4–6 | 21 | 0.32 | 38 | 0.42 | 52 | 87 | 0.3 | 341 | $2.4 \times 10^{13}$ |
| 59 | 4–11 | 21 | 0.32 | 37 | 0.41 | 50 | 88 | 0.3 | 338 | $4.1 \times 10^{13}$ |
| 60 | 4–44 | 21 | 0.31 | 39 | 0.39 | 54 | 90 | 0.3 | 346 | $3.6 \times 10^{13}$ |
| 61 | 5–14 | 21 | 0.29 | 39 | 0.40 | 49 | 88 | 0.4 | 342 | $3.5 \times 10^{13}$ |
| 62 | 4–14/5–22 | 14/7 | 0.33 | 36 | 0.41 | 49 | 87 | 0.3 | 334 | $6.2 \times 10^{13}$ |
| 63 | 6–14 | 21 | 0.30 | 37 | 0.38 | 53 | 87 | 0.4 | 338 | $5.5 \times 10^{13}$ |
| 64 | 4–11/6–13 | 14/7 | 0.31 | 37 | 0.41 | 52 | 89 | 0.3 | 340 | $5.2 \times 10^{13}$ |
| 65 | 4–44 | 15 | 0.38 | 32 | 0.45 | 47 | 93 | 0.5 | 300 | $7.0 \times 10^{12}$ |
| 66 | 4–37 | 15 | 0.39 | 34 | 0.46 | 45 | 92 | 0.4 | 297 | $6.9 \times 10^{12}$ |
| 67 | 4–49/6–12 | 12/3 | 0.37 | 35 | 0.45 | 46 | 92 | 0.5 | 304 | $4.9 \times 10^{12}$ |
| 68 | 5–24 | 15 | 0.39 | 33 | 0.46 | 45 | 93 | 0.5 | 301 | $4.8 \times 10^{12}$ |
| 69 | 4–11 | 21 | 0.33 | 37 | 0.41 | 51 | 89 | 0.3 | 351 | $2.7 \times 10^{13}$ |
| 70 | 4–18 | 21 | 0.31 | 38 | 0.42 | 50 | 89 | 0.3 | 348 | $2.6 \times 10^{12}$ |
| 71 | 4–44 | 21 | 0.30 | 37 | 0.40 | 51 | 88 | 0.3 | 344 | $1.9 \times 10^{10}$ |
| 72 | 5–14 | 21 | 0.29 | 36 | 0.38 | 48 | 88 | 0.3 | 347 | $4.2 \times 10^{13}$ |
| 73 | 6–14 | 21 | 0.31 | 36 | 0.40 | 49 | 88 | 0.4 | 356 | $3.9 \times 10^{13}$ |
| 74 | 4–11/6–13 | 14/7 | 0.29 | 38 | 0.39 | 50 | 87 | 0.3 | 341 | $2.6 \times 10^{13}$ |
| 75 | 1–5 | 15 | 0.32 | 31 | 0.36 | 36 | 93 | 0.3 | 305 | $4.5 \times 10^{12}$ |
| 76 | 1–22 | 15 | 0.32 | 30 | 0.37 | 35 | 94 | 0.3 | 307 | $8.2 \times 10^{12}$ |
| 77 | 1–41 | 16 | 0.33 | 29 | 0.35 | 35 | 94 | 0.4 | 300 | $6.6 \times 10^{12}$ |
| 78 | 1–54 | 15 | 0.31 | 31 | 0.36 | 36 | 94 | 0.3 | 301 | $6.3 \times 10^{12}$ |
| 79 | 2–29 | 15 | 0.34 | 33 | 0.38 | 37 | 93 | 0.3 | 300 | $5.0 \times 10^{12}$ |
| 80 | 3–10 | 15 | 0.32 | 29 | 0.36 | 36 | 93 | 0.4 | 299 | $6.2 \times 10^{12}$ |
| 81 | 3–23 | 15 | 0.31 | 29 | 0.36 | 36 | 94 | 0.3 | 297 | $7.1 \times 10^{12}$ |
| 82 | 1–5 | 21 | 0.27 | 35 | 0.29 | 39 | 91 | 0.2 | 320 | $1.2 \times 10^{13}$ |
| 83 | 1–22 | 21 | 0.28 | 35 | 0.29 | 38 | 90 | 0.3 | 326 | $9.6 \times 10^{12}$ |
| 84 | 1–41 | 21 | 0.27 | 36 | 0.28 | 40 | 92 | 0.2 | 323 | $2.2 \times 10^{13}$ |
| 85 | 1–54 | 21 | 0.28 | 34 | 0.30 | 37 | 91 | 0.3 | 330 | $1.0 \times 10^{12}$ |
| 86 | 2–29 | 21 | 0.27 | 36 | 0.29 | 39 | 91 | 0.2 | 329 | $9.8 \times 10^{12}$ |
| 87 | 3–10 | 21 | 0.27 | 34 | 0.28 | 38 | 91 | 0.2 | 330 | $8.6 \times 10^{12}$ |
| 88 | 3–23 | 21 | 0.27 | 35 | 0.28 | 37 | 91 | 0.3 | 333 | $9.1 \times 10^{12}$ |
| 89 | 4–55 | 16 | 0.33 | 32 | 0.41 | 46 | 94 | 0.3 | 336 | $3.2 \times 10^{12}$ |
| 90 | 6–29 | 15 | 0.34 | 31 | 0.40 | 45 | 93 | 0.4 | 329 | $4.6 \times 10^{12}$ |
| 91 | 6–18 | 15 | 0.33 | 30 | 0.42 | 47 | 92 | 0.3 | 337 | $3.0 \times 10^{12}$ |
| 92 | 6–19 | 15 | 0.32 | 31 | 0.43 | 45 | 93 | 0.3 | 341 | $5.3 \times 10^{12}$ |
| 93 | 4–55 | 21 | 0.27 | 34 | 0.32 | 46 | 90 | 0.2 | 366 | $1.6 \times 10^{12}$ |
| 94 | 5–29 | 21 | 0.28 | 34 | 0.33 | 45 | 90 | 0.1 | 360 | $2.1 \times 10^{13}$ |
| 95 | 6–18 | 21 | 0.27 | 35 | 0.32 | 47 | 91 | 0.2 | 358 | $8.3 \times 10^{12}$ |
| 96 | 6–19 | 21 | 0.27 | 35 | 0.31 | 48 | 91 | 0.1 | 362 | $1.7 \times 10^{12}$ |

Comparative Example 1

A protective layer-coating liquid was prepared as a solution of the resole-type phenolic resin ("PR-53123", made by Sumitomo Durez K.K.) used in Example 1.

A photosensitive member was prepared and evaluated in the same manner as in Example 1 except for using the above-prepared protective layer-coating liquid, for application by dipping, followed by 1 hour of hot air drying at 145° C., to form a 3 $\mu$m-thick protective layer.

The results of evaluations are inclusively shown in Table 2 appearing hereinafter together with those of the following Comparative Examples.

Comparative Example 2

A protective layer-coating liquid was prepared as a solution of the resole-type phenolic resin ("PL-2211", made by Gun'ei Kagaku Kogyo K.K.) used in Example 31.

A photosensitive member was prepared and evaluated in the same manner as in Example 1 except for using the above-prepared protective layer-coating liquid, for application by dipping, followed by 1 hour of hot air drying at 145° C., to form a 3 $\mu$m-thick protective layer.

Comparative Examples 3–10

Eight protective layer-coating liquid were prepared by using 67 parts of the resole-type phenolic resin ("PR-53123") used in Example 1 and 21 parts each of Comparative Compounds 1-8 shown below, respectively, instead of Example Compound (1-23) for dissolution together with 400 parts of 1,4-dioxane and 180 parts of THF (tetrahydrofuran), followed by 4 hours of stirring.

Eight photosensitive members were prepared and evaluated in the same manner as in Example 1 except for using the above-prepared protective layer-coating liquids for application by spraying followed 1 hour of hot air drying at 145° C. to form a 3 $\mu$m-thick protective layer.

Comparative Compound 1
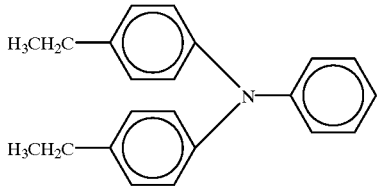
Comparative Compound 2
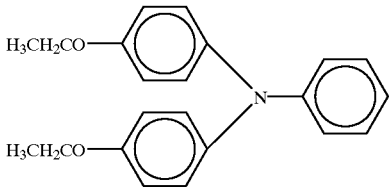
Comparative Compound 3
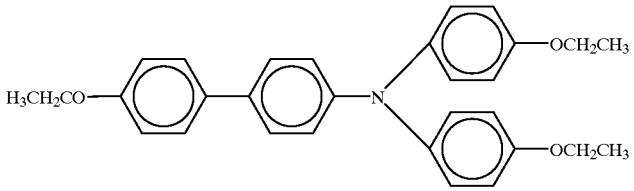
Comparative Compound 4
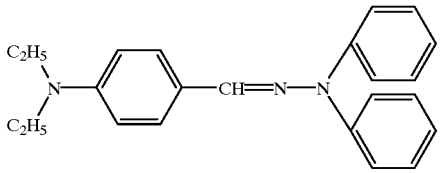
Comparative Compound 5
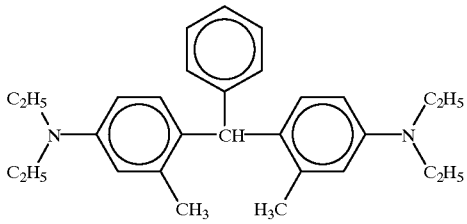
Comparative Compound 6
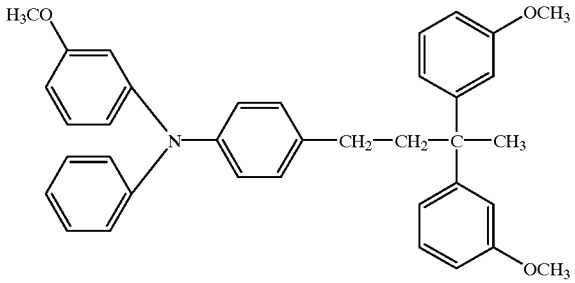
Comparative Compound 7
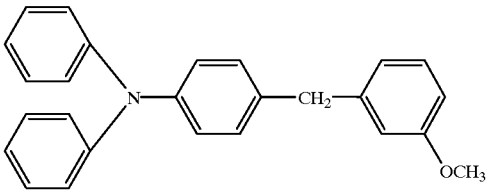

-continued

Comparative Compound 8

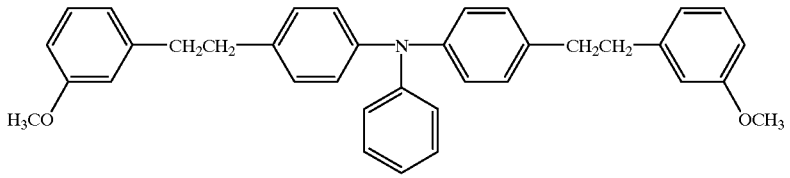

Comparative Examples 11 and 12

Two protective layer-coating liquids were prepared by dispersing 35 parts of the 7%-surface-treated antimony-doped tin oxide fine particles together with 150 parts of 1,4-dioxane in a and mill for 66 hours, adding thereto 18 parts of polytetrafluoroethylene fine particles (Dv=0.18 μm) followed by 12 hours of dispersion in the sand mill, and adding thereto 24 parts (as resin) of PMKA (polymethyl methacrylate) ("J-899", made by Seiko Kagaku K.K.) and further 15 parts each of Example Compound (1-23) (Comparative Example 11) or (1-15) (Comparative Example 12) (charge-transporting compound) as shown in Table 2 for dissolution, followed by 1 hour of dispersion in the sand mill and dilution with 700 parts of 1,4-dioxane and 370 parts of THF.

Two photosensitive members were prepared and evaluated in the same manner as in Example 1 except for using the above-prepared protective layer-coating liquids for application by spraying, followed by 30 min. of drying at 100° C. to form a 3 μm-thick protective layer.

Comparative Example 13

A photosensitive member was prepared in the same manner as in Example 1 except for omitting the protective layer.

The results of evaluation of the above-described Comparative Examples are inclusively shown in the following Table 2.

The results in Tables 1 and 2 show that the electrophotographic photosensitive members provided with a protective layer according to the present invention (shown in Table 1) exhibited little lowering in sensitivity ($E_{500}$) or little increase in residual potential (Vr) accompanying the provision of such a protective layer while exhibiting advantageous features such as a high transfer efficiency, a high film strength (a high universal hardness HU) and a good abrasion resistance which are desirable for good and stable image forming performances in a continuous image formation on a large number of sheets.

As a result of the continuous image formation, the photosensitive members of the present invention continually provided clear and good images free from image flow because of a high volume resistivity (Rv) of the protective layer. On the other hand, the photosensitive members of Comparative Examples 3–12 exhibited lower quality images accompanied with image flow presumably due to a low volume resistivity of the protective layer.

As described above, according to the present invention, there is provided an electrophotographic photosensitive member provided with a protective layer effective for providing a high transfer efficiency, a high durability and a high stability suitable for continually providing good images while suppressing the lowering in photosensitivity and the-

TABLE 2

Protective layer performances (Comparative)

| Comp. Ex. | Example Compound No. Charge transporter) | wt. Parts | NT/NH(23° C./65% RH) $E_{500}$ (μJ/cm²) | NT/NH(23° C./65% RH) Vr (−volts) | NT/LH(23° C./10% RH) $E_{500}$ (μJ/cmμu 2) | NT/LH(23° C./10% RH) Vr (−volts) | Transfer efficiency % | Abrasion (μm) after 5000 sheets | Hardness HO (W/mm²) | Resistivity Rv (Ohm · cm) |
|---|---|---|---|---|---|---|---|---|---|---|
| 1 | — | — | N.M.* | 315 | N.M.* | 431 | — | — | 362 | $8.2 \times 10^{14}$ |
| 2 | — | — | N.M.* | 307 | N.M.* | 422 | — | — | 358 | $7.1 \times 10^{14}$ |
| 3 | Comp. 1 | 15 | 1.76 | 157 | 2.88 | 191 | 78 | 1.5 | 235 | $1.1 \times 10^{11}$ |
| 4 | Comp. 2 | 15 | 1.87 | 168 | N.M.* | 217 | 74 | 1.3 | 237 | $7.9 \times 10^{10}$ |
| 5 | Comp. 3 | 15 | 2.21 | 178 | N.M.* | 223 | 77 | 1.2 | 232 | $2.3 \times 10^{11}$ |
| 6 | Comp. 4 | 15 | 1.85 | 104 | 2.91 | 194 | 74 | 2.6 | 218 | $6.7 \times 10^{10}$ |
| 7 | Comp. 5 | 15 | 1.87 | 122 | 2.99 | 198 | 73 | 2.9 | 211 | $8.8 \times 10^{10}$ |
| 8 | Comp. 6 | 15 | 1.62 | 162 | 2.88 | 195 | 77 | 1.2 | 241 | $8.9 \times 10^{10}$ |
| 9 | Comp. 7 | 15 | 1.67 | 160 | N.M.* | 211 | 76 | 1.1 | 239 | $7.6 \times 10^{10}$ |
| 10 | Comp. 8 | 15 | 1.72 | 166 | 3.15 | 200 | 72 | 1.1 | 220 | $8.1 \times 10^{10}$ |
| 11 | 1 – 23 | 15 | 1.12 | 86 | 1.44 | 107 | 76 | 13 | 181 | $5.2 \times 10^{8}$ |
| 12 | 1 – 15 | 15 | 1.14 | 75 | 1.61 | 136 | 72 | 13 | 183 | $2.7 \times 10^{4}$ |
| 13 | — | — | 0.23 | 19 | 0.24 | 26 | 84 | 11 | — | — |

N.M.* = Not measurable because the potential could not be lowered down to −200 volts from the initial value of −700 volts.

increase in residual potential. Accordingly, a process cartridge and an electrophotographic apparatus including the photosensitive member can also exhibit excellent electrophotographic performances.

What is claimed is:

1. An electrophotographic photosensitive member, comprising: a support, a photosensitive layer and a protective layer in this order; wherein said protective layer comprises a cured product of a resole-type phenolic resin and a charge-transporting compound having at least one group selected from the group consisting of hydroxyalkyl groups, hydroxyalkoxy groups and hydroxyphenyl groups capable of having a substituent.

2. A photosensitive member according to claim 1, wherein said charge-transporting compound has a hydroxyalkyl group.

3. A photosensitive member according to claim 2, wherein said charge-transporting compound has a structure represented by any one of structural formulae (1)–(3) shown below:

(1)

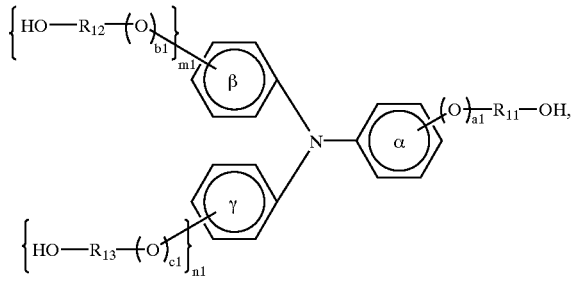

wherein $R_{11}$, $R_{12}$ and $R_{13}$ independently denote a linear or branched divalent hydrocarbon group having 1–8 carbon atoms; α, β and γ independently denote a benzene ring capable of having one or more substituents selected from halogen atoms, alkyl groups, alkoxy groups, aryl groups and heterocyclic groups each being further capable of a substituent except for the halogen atoms; a1, b1and c1 are 0; and m1 and n1 are independently 1 or 0;

(2)

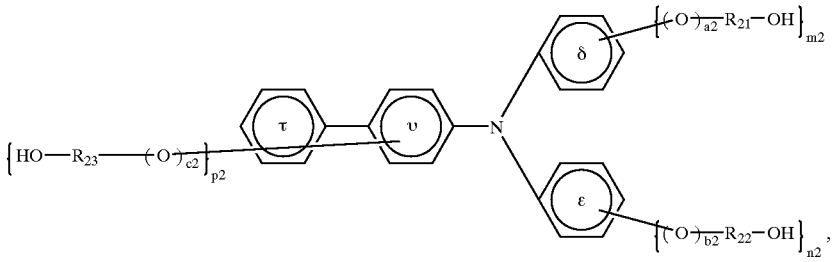

wherein $R_{21}$, $R_{22}$ and $R_{23}$ independently denote a linear or branched divalent hydrocarbon group having 1 –8 carbon atoms; δ, ϵ, τ and ν independently denote a benzene ring capable of having one or more substituents selected from halogen atoms, alkyl groups, alkoxy groups, aryl groups and heterocyclic group each being further capable of a having a substituent except for the halogen atoms, with the proviso that τ and ν can form a ring together via a substituent; a2, b2 and c2 are 0; and m2, n2 and p2 are independently 1 or 0 with the proviso that at least one of m2, n2 and p2 is 1; and (3)

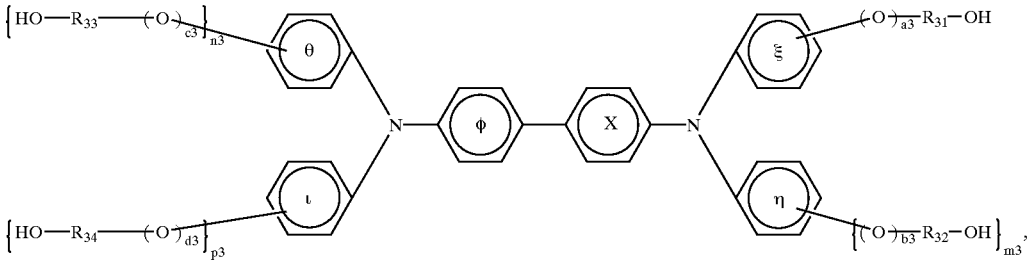

wherein $R_{31}$, $R_{32}$, $R_{33}$ and $R_{34}$ independently denote a linear or branched divalent hydrocarbon group having 1–8 carbon atoms; ξ, ζ, θ, ι, ϕ and χ independently denote a benzene ring capable of having one or more substituents selected from halogen atoms, alkyl groups, alkoxy groups, aryl groups and heterocyclic group each being further capable of a having a substituent except for the halogen atoms, with the proviso that ϕ and χ can form a ring together via a substituent; a3, b3, c3 and d3 are 0; and m3, n3 and p3 are independently 1 or 0.

4. A photosensitive member according to claim 1, wherein said charge-transporting compound has a hydroxyalkoxy group.

5. A photosensitive member according to claim 4, wherein said charge-transporting compound has a structure represented by any one of structural formulae (1)–(3) shown below:

(1)

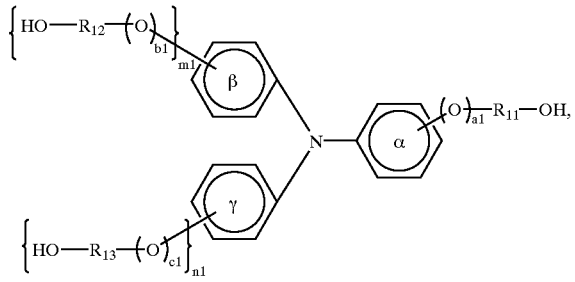

wherein $R_{11}$, $R_{12}$ and $R_{13}$ independently denote a linear or branched divalent hydrocarbon group having 1–8 carbon atoms; α, β and γ independently denote a benzene ring capable of having one or more substituents selected from halogen atoms, alkyl groups, alkoxy groups, aryl groups and heterocyclic groups each being further capable of a substituent except for the halogen atoms; a1, b1 and c1 are 0; and m1 and n1 are independently 1 or 0;

(2)

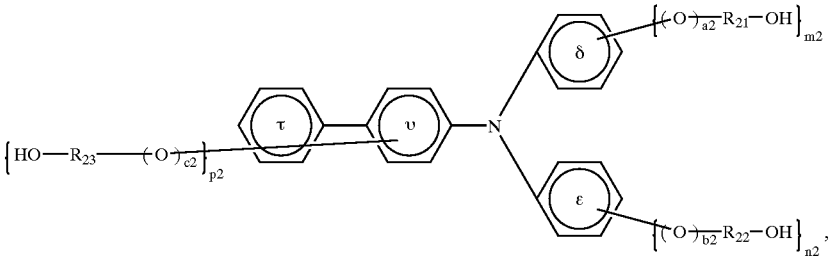

wherein $R_{21}$, $R_{22}$ and $R_{23}$ independently denote a linear or branched divalent hydrocarbon group having 1–8 carbon atoms; δ, ϵ, τ and ν independently denote a benzene ring capable of having one or more substituents selected from halogen atoms, alkyl groups, alkoxy groups, aryl groups and heterocyclic group each being further capable of a having a substituent except for the halogen atoms, with the proviso that τ and ν can form a ring together via a substituent; a2, b2 and c2 are 0; and m2, n2 and p2 are independently 1 or 0 with the proviso that at least one of m2, n2 and p2 is 1; and (3)

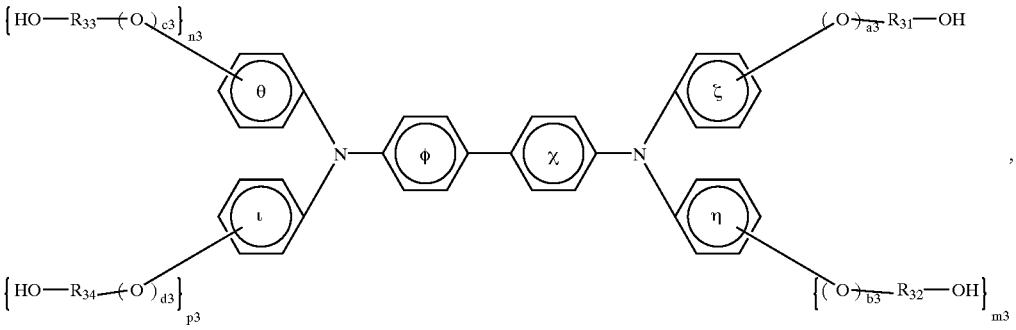

wherein $R_{31}$, $R_{32}$, $R_{33}$ and $R_{34}$ independently denote a linear or branched divalent hydrocarbon group having 1–8 carbon atoms; ξ, ζ, θ, ι, ϕ and χ independently denote a benzene ring capable of having one or more substituents selected from halogen atoms, alkyl groups, alkoxy groups, aryl groups and heterocyclic group each being further capable of a having a substituent except for the halogen atoms, with the proviso that ϕ and χ can form a ring together via a substituent; a3, b3, c3 and d3 are 0; and m3, n3 and p3 are independently 1 or 0.

6. A photosensitive member according to claim 1, wherein said charge-transporting compound has a hydroxyphenyl group capable of having a substituent.

7. A photosensitive member according to claim 6, wherein said charge-transporting compound has a structure represented by any one of formulae (4)–(6) shown below:

(4)

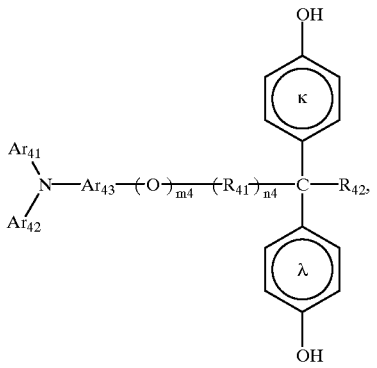

wherein $R_{41}$ denote a linear or branched divalent hydrocarbon group; $R_{42}$ denotes a hydrogen atom, an alkyl group, an aralkyl group or a phenyl group, each capable of having a substituent except for the hydrogen atom; $Ar_{41}$ and $Ar_{42}$ independently denote an alkyl group, an aralkyl group, an aryl group or a heterocyclic group each capable at having a substituent; $Ar_{43}$ denotes an arylene group or a divalent heterocyclic group each capable of having a substituent; m4 and n4 are independently 0 or 1 with the proviso that m4=0 when n4=0, and κ and λ independently denote a benzene ring capable of having one or more substituents selected from halogen atoms, alkyl groups, alkoxy groups, aryl groups, and heterocyclic each capable of having a substituent except for the halogen atoms;

(5)

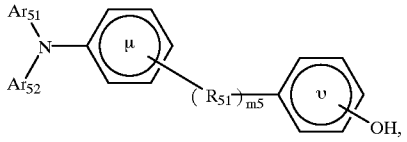

wherein $R_{51}$ denote a linear or branched divalent hydrocarbon group; $Ar_{51}$ and $Ar_{52}$ independently denote an alkyl group, an aralkyl group, an aryl group or a heterocyclic group each capable of having a substituent; μ and ν independently denote a benzene ring capable of having one or more substituents selected from halogen atoms, alkyl groups, alkoxy groups, aryl groups, and heterocyclic groups each capable of having a substituent except for the halogen atoms with the proviso that μ and ν can form a ring together with a substituent; and 5 is 0 or 1; and (6)

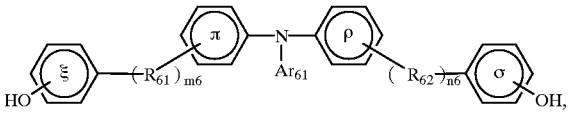

wherein $R_{61}$ and $R_{62}$ independently denote a linear or branched divalent hydrocarbon group; $Ar_{61}$ denotes an alkyl group, an aralkyl group, an aryl group or a heterocyclic group each capable of having a substituent; ξ, π, ρ and σ independently denote a benzene ring capable of having one or more substituents selected from halogen atoms, alkyl groups, alkoxy groups, aryl groups, and heterocyclic each capable of having a substituent except for the halogen atoms with the proviso that ξ and π or ρ and σ can form a ring together with a substituent and m1 and n1 are independently 0 or 1.

8. A photosensitive member according to claim 1, wherein said protective layer contains electroconductive particles.

9. A photosensitive member according to claim 8, wherein said electroconductive particles comprise tin oxide particles optionally doped or surface treated.

10. A photosensitive member according to claim 1, wherein said protective layer contains a fluorine-containing compound and fluorine-containing resin particles.

11. A photosensitive member according to claim 1, wherein said protective layer contains a fluorine-containing compound, fluorine-containing resin particles and a siloxane compound.

12. A process cartridge, comprising: an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member comprises an electrophotographic photosensitive member, comprising: a support, a photosensitive layer and a protective layer in this order; wherein said protective layer comprises a cured product of a resole-type phenolic resin and a charge-transporting compound having at least one group selected from the group consisting of hydroxyalkyl groups, hydroxyalkoxy groups and hydroxyphenyl groups capable of having a substituent.

13. An electrophotographic apparatus, comprising: an electrophotographic photosensitive member, and charging means, developing means and transfer means respectively disposed opposite to the electrophotographic photosensitive member, wherein said electrophotographic photosensitive member comprises an electrophotographic photosensitive member, comprising: a support, a photosensitive layer and a protective layer in this order; wherein said protective layer comprises a cured product of a resole-type phenolic resin and a charge-transporting compound having at least one group selected from the group consisting of hydroxyalkyl groups, hydroxyalkoxy groups and hydroxyphenyl groups capable of having a substituent.

* * * * *

UNITED STATES PATENT AND TRADEMARK OFFICE

CERTIFICATE OF CORRECTION

PATENT NO. : 6,555,279 B2
DATED : April 29, 2003
INVENTOR(S) : Kouichi Nakata et al.

It is certified that error appears in the above-identified patent and that said Letters Patent is hereby corrected as shown below:

Column 33,
Line 53, “denote” should read -- denotes --.

Column 34,
Line 20, “denote” should read -- denotes --.

Column 35,
Line 3, “substituent” should read -- substituent. --; and
Line 11, “phenetyl” should read -- phenethyl --.

Column 61,
Line 21, “restricted” should read -- restricted. --.

Column 64,
Line 4, “use,” should read -- used --; and
Line 67, “campsite;” should read -- composite --.

Column 65,
Line 47, “resin are charge-generating material used,” should read -- resin used as the charge-generating material --.

Column 67,
Line 10, “per-exposure” should read -- pre-exposure --.

Column 68,
Line 26, “7,5” should read -- 7.5 --.

UNITED STATES PATENT AND TRADEMARK OFFICE

CERTIFICATE OF CORRECTION

PATENT NO. : 6,555,279 B2
DATED : April 29, 2003
INVENTOR(S) : Kouichi Nakata et al.

It is certified that error appears in the above-identified patent and that said Letters Patent is hereby corrected as shown below:

Column 79,
Line 18, “and” should read -- sand --.

Signed and Sealed this

Eleventh Day of November, 2003

JAMES E. ROGAN
*Director of the United States Patent and Trademark Office*